US009586794B2

(12) United States Patent
Chung et al.

(10) Patent No.: US 9,586,794 B2
(45) Date of Patent: Mar. 7, 2017

(54) WINCH HAVING ADJUSTABLE INITIAL MECHANICAL ADVANTAGE

(71) Applicant: Illinois Tool Works Inc., Glenview, IL (US)

(72) Inventors: Brian Hyuk Joon Chung, Oakbrook Terrace, IL (US); Zhengzhong Zhu, Zhejiang (CN)

(73) Assignee: Illinois Tool Works Inc., Glenview, IL (US)

( * ) Notice: Subject to any disclaimer, the term of this patent is extended or adjusted under 35 U.S.C. 154(b) by 96 days.

(21) Appl. No.: 14/221,461

(22) Filed: Mar. 21, 2014

(65) Prior Publication Data

US 2014/0326936 A1 Nov. 6, 2014

Related U.S. Application Data

(60) Provisional application No. 61/819,256, filed on May 3, 2013.

(51) Int. Cl.
*B66D 1/30* (2006.01)
*B66D 1/04* (2006.01)

(52) U.S. Cl.
CPC *B66D 1/30* (2013.01); *B66D 1/04* (2013.01)

(58) Field of Classification Search
CPC ..... B66D 1/04; B66D 1/30; B65H 75/24
USPC ..... 254/334
See application file for complete search history.

(56) References Cited

U.S. PATENT DOCUMENTS 464,900 A 12/1891 Sciiwannecke
496,997 A 5/1893 Chisholm
504,576 A 9/1893 James
555,516 A * 3/1896 Knox ..... 242/395
570,920 A * 11/1896 Faut ..... B65H 75/24 157/1.41
803,274 A 10/1905 Deaver
819,419 A 5/1906 Franklin
997,518 A 7/1911 Taylor
1,272,359 A 7/1918 Bell
(Continued)

FOREIGN PATENT DOCUMENTS

GB 2 215 297 9/1989

OTHER PUBLICATIONS

"The Load Lock Stabilized Hull Cradle System for the Handy-Hooker Canoe and Kayak Storage Hoist", drdcorp.com, printed Aug. 24, 2011 (3 pages).

(Continued)

*Primary Examiner* — Michael Mansen
*Assistant Examiner* — Michael Gallion
(74) *Attorney, Agent, or Firm* — Neal, Gerber & Eisenberg LLP

(57) ABSTRACT

Various embodiments of the present disclosure provide a winch having a user-adjustable or variable initial mechanical advantage. In one embodiment, the winch of the present disclosure has an outer drum diameter adjustable between a minimum outer drum diameter, which is associated with a maximum initial mechanical advantage provided by the winch, and a maximum outer drum diameter, which is associated with a minimum initial mechanical advantage provided by the winch. This provides a user with the flexibility to adjust or vary the mechanical advantage of the winch to the user's preference.

10 Claims, 41 Drawing Sheets

(56) References Cited

U.S. PATENT DOCUMENTS 1,338,127 A 4/1920 Felt
1,392,660 A 10/1921 Sebest
1,432,299 A 10/1922 Plienes
1,442,579 A 1/1923 McArthur
1,813,095 A 7/1931 Starkey et al.
1,830,003 A 11/1931 Shailor
2,145,666 A 1/1939 Roethel
2,170,764 A * 8/1939 Penman ..... B65H 49/30 242/422.8
2,335,179 A * 11/1943 Feller ..... G03B 21/321 242/329
2,370,029 A * 2/1945 Gayle ..... B66D 1/16 187/262
2,370,868 A * 3/1945 Luebke ..... B65H 75/24 242/407.1
2,490,652 A 12/1949 Albert
2,499,791 A 3/1950 Spencer
2,557,510 A * 6/1951 Nau-Touron ..... D01H 1/18 242/128
2,625,357 A 1/1953 Atkinson
2,631,582 A 3/1953 Bensfield
2,634,186 A 4/1953 Zuss
2,643,662 A 6/1953 Bunce
2,643,749 A 6/1953 Greenlee
2,649,279 A 8/1953 Jones et al.
2,781,047 A * 2/1957 Whitehill ..... A45D 2/10 132/332
2,829,748 A 4/1958 Sacchini et al.
2,840,288 A 6/1958 Broddon
2,881,881 A 4/1959 Sacchini et al.
2,922,220 A 1/1960 Savvhini
2,927,551 A 3/1960 Bevis et al.
2,940,563 A 6/1960 Milenkovic et al.
2,983,465 A * 5/1961 Skubal ..... B21C 47/28 242/575.5
2,998,885 A 9/1961 Sruface
3,006,448 A 10/1961 Fox
3,011,605 A 12/1961 Tomko
3,058,607 A 10/1962 Kiley
3,088,545 A 5/1963 Meyer
3,104,745 A 9/1963 Wipke
3,110,380 A 11/1963 Barthold et al.
3,135,369 A 6/1964 Nisenson et al.
3,265,024 A 8/1966 Kramlich
3,302,762 A 2/1967 Conlon
3,307,663 A 3/1967 Luenberger
3,326,495 A * 6/1967 De Bruyn ..... B65H 49/305 242/577
3,340,975 A 9/1967 Edwin
3,433,446 A 3/1969 Meder
3,454,259 A 7/1969 Faulkner
3,529,703 A 9/1970 Kroeker
3,584,809 A * 6/1971 Ogden, Sr. ..... B65H 49/305 242/129
3,712,431 A 1/1973 Versoy
3,729,245 A 4/1973 Skifstrom
3,731,886 A * 5/1973 Macchi ..... B21C 47/28 242/129
3,750,347 A 8/1973 Homeyer
3,770,133 A 11/1973 Kolker et al.
3,805,054 A 4/1974 Wolf
3,834,670 A 9/1974 Pityo
3,872,972 A 3/1975 Cummins et al.
3,876,184 A 4/1975 Eudy et al.
3,887,038 A 6/1975 Buschbom et al.
3,888,398 A 6/1975 Payne et al.
3,904,094 A 9/1975 Correll et al.
3,907,113 A 9/1975 Kropelnitski et al.
3,915,268 A 10/1975 MacDonald et al.
3,920,106 A 11/1975 Nisenson-Trafalger Towers et al.
3,924,390 A 12/1975 Alexander et al.
3,924,751 A 12/1975 Ballenger et al.
3,945,469 A 3/1976 Dorcich
3,961,711 A 6/1976 Perks
3,966,170 A 6/1976 McKenna
4,076,218 A * 2/1978 Gault ..... F04B 47/02 254/286
4,130,028 A 12/1978 Solberg
4,135,655 A 1/1979 Brown
4,139,078 A 2/1979 Keller
4,174,076 A * 11/1979 Tolliver ..... B26D 1/08 242/527.5
4,184,570 A 1/1980 Edwards
4,199,139 A 4/1980 DeMaeo et al.
4,239,440 A 12/1980 James
4,280,606 A 7/1981 Taylor
4,372,432 A 2/1983 Waine et al.
4,372,442 A 2/1983 Fleischauer
4,413,801 A 11/1983 Lancaster et al.
4,427,100 A 1/1984 Rude et al.
4,433,765 A 2/1984 Rude et al.
4,456,020 A * 6/1984 van Deursen ..... A45D 2/24 132/237
4,456,246 A 6/1984 Szabo
4,469,198 A 9/1984 Crump
4,482,268 A 11/1984 Stevenson et al.
4,489,970 A 12/1984 Henke
4,541,769 A 9/1985 Clemens
4,558,833 A * 12/1985 Speck ..... B65H 49/30 242/403
4,568,132 A 2/1986 Watt
4,576,319 A 3/1986 Brown
4,591,308 A 5/1986 Imai
4,600,177 A 7/1986 Fritz
4,615,335 A 10/1986 Searcy
4,634,118 A 1/1987 Jensen et al.
4,648,594 A 3/1987 Schleffendorf et al.
4,652,202 A 3/1987 Kersten
4,653,707 A 3/1987 Hamilton et al.
4,666,151 A 5/1987 Chillier et al.
4,697,809 A 10/1987 Rockwell
4,700,944 A 10/1987 Sterba et al.
4,764,081 A 8/1988 Peterson
4,775,146 A 10/1988 Stankovic et al.
4,799,648 A 1/1989 Holm
4,804,307 A 2/1989 Motoda
4,850,263 A 7/1989 Rumsey et al.
4,865,155 A 9/1989 Montaigne
4,907,798 A 3/1990 Burchatz
4,921,242 A 5/1990 Watterson
4,923,103 A 5/1990 Sauber
4,934,659 A 6/1990 Yoke
4,971,506 A 11/1990 Givati
5,000,292 A 3/1991 Chapelain et al.
5,025,999 A * 6/1991 Littrell ..... B65H 54/58 242/577
5,051,027 A 9/1991 Horton
5,058,720 A 10/1991 Rude et al.
5,078,415 A 1/1992 Goral
5,101,935 A 4/1992 LaBianca
5,131,620 A 7/1992 Boundy
5,143,182 A 9/1992 Basta
5,154,569 A 10/1992 Eryou et al.
5,172,952 A 12/1992 Lasnetski
5,183,162 A 2/1993 Ritzenthaler
5,188,323 A 2/1993 David
D333,776 S * 3/1993 Cloutier ..... D8/358
5,190,509 A 3/1993 Davison et al.
5,193,479 A 3/1993 Bielefeld
5,199,843 A 4/1993 Sferra
5,203,619 A 4/1993 Welsch et al.
5,211,614 A 5/1993 Henes et al.
5,224,677 A 7/1993 Close
5,228,661 A 7/1993 Bigham et al.
5,242,094 A 9/1993 Finley
5,263,687 A 11/1993 Garbiso
5,277,463 A 1/1994 Singh et al.
5,290,214 A 3/1994 Chen
5,294,006 A 3/1994 Deschino
5,302,161 A 4/1994 Loubert et al.
5,318,236 A * 6/1994 Morello ..... B65H 75/248 242/574.3
5,320,121 A 6/1994 Alexanian

(56) References Cited

U.S. PATENT DOCUMENTS

| | | | | |
|---|---|---|---|---|
| 5,320,394 | A | 6/1994 | Urbank et al. | |
| 5,354,035 | A | 10/1994 | Helgren | |
| 5,372,072 | A | 12/1994 | Hamy | |
| 5,395,284 | A | 3/1995 | Frisk | |
| 5,417,633 | A | 5/1995 | Habing et al. | |
| 5,441,322 | A | 8/1995 | Jobmann et al. | |
| 5,460,274 | A | 10/1995 | Kramer et al. | |
| 5,460,280 | A | 10/1995 | Feddeler et al. | |
| 5,474,189 | A | 12/1995 | Peterson | |
| 5,507,237 | A | 4/1996 | Barrow | |
| 5,593,012 | A | 1/1997 | Aho et al. | |
| 5,626,208 | A | 5/1997 | Sprague | |
| 5,632,591 | A | 5/1997 | Henriquez | |
| 5,722,917 | A | 3/1998 | Olschansky | |
| 5,794,793 | A | 8/1998 | Frederick | |
| 5,850,891 | A | 12/1998 | Olms et al. | |
| 5,851,098 | A | 12/1998 | Buckenauer et al. | |
| 5,871,070 | A | 2/1999 | Contreras | |
| 5,893,696 | A | 4/1999 | Belinsky | |
| 5,901,862 | A | 5/1999 | Riga et al. | |
| 5,909,791 | A | 6/1999 | DiStefano | |
| 6,021,974 | A * | 2/2000 | Koskelainen | B65H 54/2896 242/118.62 |
| 6,056,274 | A | 5/2000 | Naas et al. | |
| 6,095,344 | A | 8/2000 | White | |
| 6,095,500 | A | 8/2000 | McVaugh et al. | |
| 6,109,125 | A | 8/2000 | Schubert et al. | |
| 6,116,797 | A | 9/2000 | Brewington et al. | |
| 6,119,841 | A | 9/2000 | Orlamunder | |
| 6,149,020 | A | 11/2000 | Gumpel et al. | |
| 6,161,702 | A | 12/2000 | Campbell | |
| 6,206,323 | B1 * | 3/2001 | Byars | B65H 54/543 242/127 |
| 6,223,862 | B1 | 5/2001 | Barnes | |
| 6,234,036 | B1 | 5/2001 | Kopko | |
| 6,237,781 | B1 | 5/2001 | Dahl | |
| 6,250,655 | B1 | 6/2001 | Sheeks | |
| 6,269,958 | B1 | 8/2001 | Pollock et al. | |
| 6,315,181 | B1 | 11/2001 | Bradley et al. | |
| 6,345,753 | B1 | 2/2002 | de Kock et al. | |
| 6,352,215 | B1 * | 3/2002 | Cash | B21C 47/30 242/574.2 |
| 6,386,515 | B1 | 5/2002 | Sachtleben | |
| 6,409,153 | B1 | 6/2002 | Norris | |
| 6,460,827 | B1 | 10/2002 | Baucom | |
| 6,484,861 | B1 | 11/2002 | Wussow | |
| 6,511,271 | B1 | 1/2003 | Saroka | |
| 6,533,205 | B1 * | 3/2003 | Kles | B65H 54/58 242/362 |
| 6,648,148 | B1 | 11/2003 | Bally | |
| 6,659,248 | B2 | 12/2003 | Terada | |
| 6,676,233 | B1 | 1/2004 | Evans et al. | |
| 6,685,171 | B2 | 2/2004 | Lob et al. | |
| 6,729,478 | B1 | 5/2004 | Boers | |
| 6,755,492 | B1 | 6/2004 | Hyde et al. | |
| 6,851,376 | B2 | 2/2005 | D'Agostino | |
| 6,976,598 | B2 | 12/2005 | Engel | |
| 7,097,409 | B2 | 8/2006 | Richter | |
| 7,150,449 | B1 | 12/2006 | Dueck et al. | |
| 7,341,420 | B1 | 3/2008 | Anderson | |
| 7,367,547 | B2 | 5/2008 | Plzak | |
| 7,367,548 | B2 | 5/2008 | Rosenfeldt et al. | |
| D570,765 | S | 6/2008 | Trusty et al. | |
| D571,279 | S | 6/2008 | Trusty et al. | |
| 7,513,580 | B2 | 4/2009 | Merrell, II | |
| 7,631,854 | B1 | 12/2009 | Mountain | |
| 7,681,853 | B2 | 3/2010 | Trusty et al. | |
| 7,841,448 | B2 | 11/2010 | Lair | |
| 8,020,667 | B2 | 9/2011 | Johnson | |
| 8,028,804 | B2 | 10/2011 | Lair | |
| 8,727,262 | B2 * | 5/2014 | Underbrink | B65H 49/24 242/573 |
| 8,808,166 | B2 * | 8/2014 | Hosaka | A61B 1/0052 600/106 |
| 2003/0221914 | A1 | 12/2003 | Smith | |
| 2005/0206282 | A1 | 9/2005 | Walburn | |
| 2006/0066189 | A1 | 3/2006 | Bond et al. | |
| 2007/0137944 | A1 | 6/2007 | Lam | |
| 2009/0084298 | A1 * | 4/2009 | McKim | B63H 9/1042 114/105 |
| 2009/0283484 | A1 | 11/2009 | Trusty et al. | |
| 2010/0108627 | A1 | 5/2010 | Lupinacci et al. | |
| 2011/0073729 | A1 | 3/2011 | DeSautel | |
| 2014/0199152 | A1 * | 7/2014 | Roodenburg | B66D 1/7405 414/800 |
| 2015/0008381 | A1 * | 1/2015 | Hausladen | B66D 1/30 254/288 |

OTHER PUBLICATIONS

Craftsman VersaTrack Ladder Hook, Hooktite Standard Double Hook, and VersaTrack Trackwall, Craftsman.com, printed Jul. 26, 2011 (5 pages).

Canadian Office Action dated Apr. 27, 2015 for Canadian Application No. 2,847,946 (4 pages).

Canadian Office Action for Canadian Application No. 2,847,946, dated Feb. 10, 2016 (3 pages).

* cited by examiner

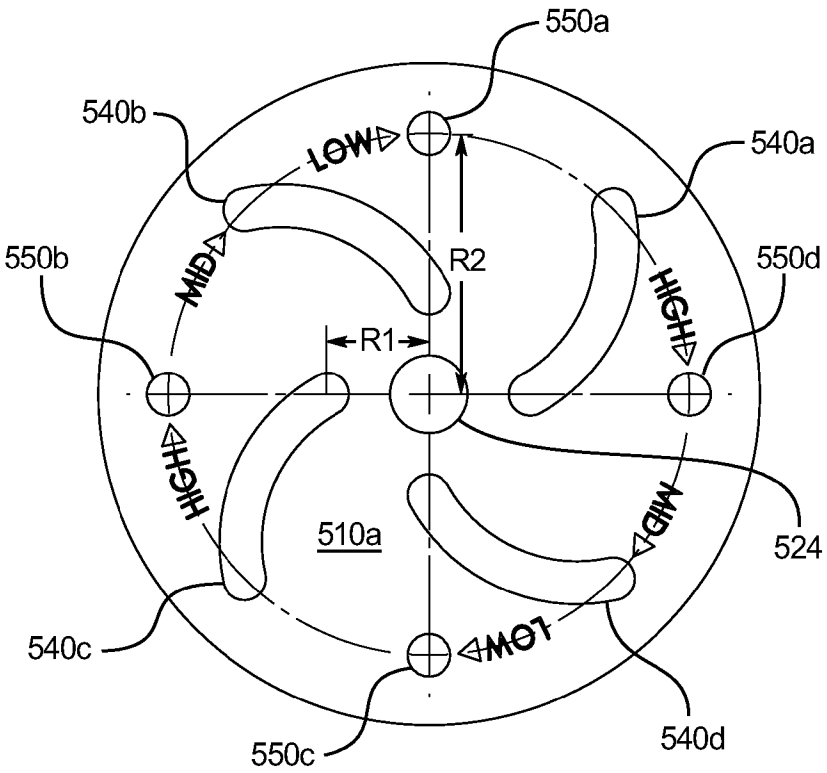
FIG. 7
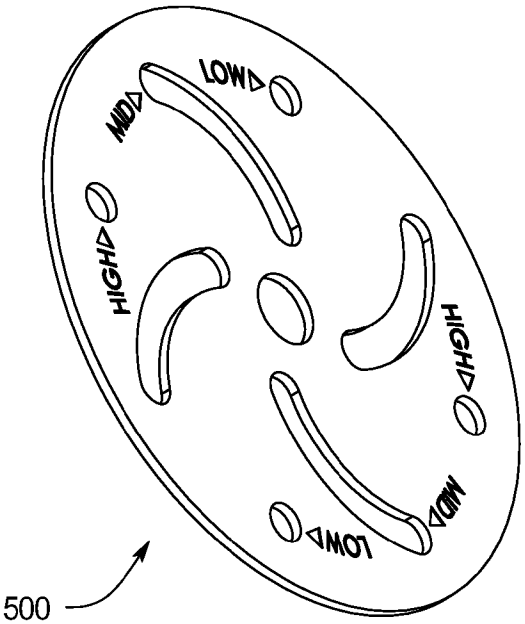

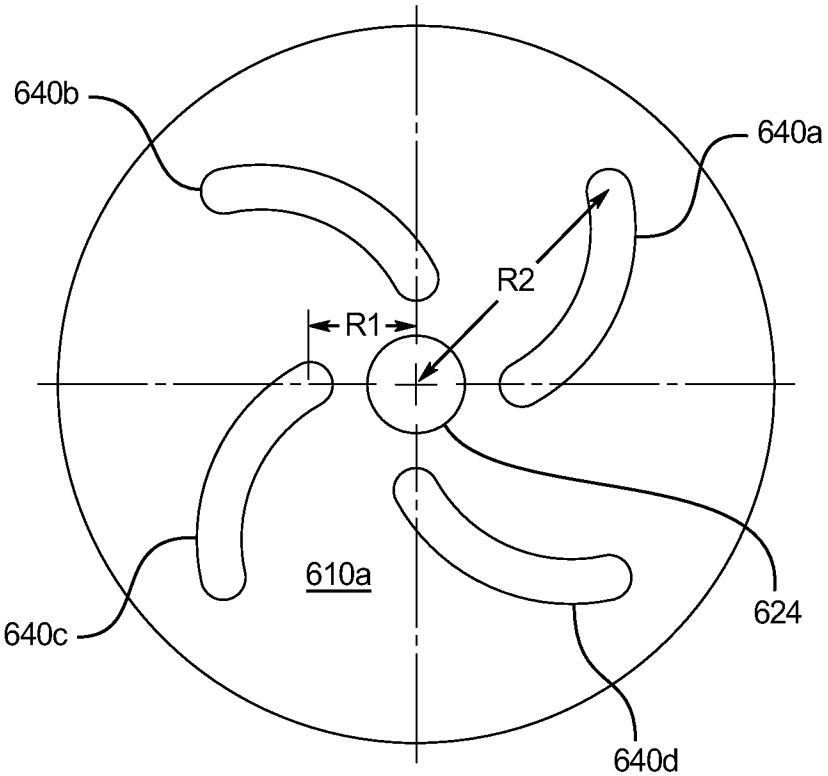
FIG. 8
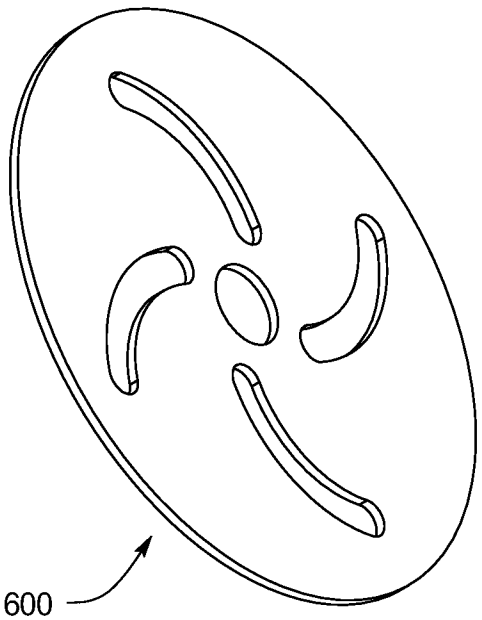

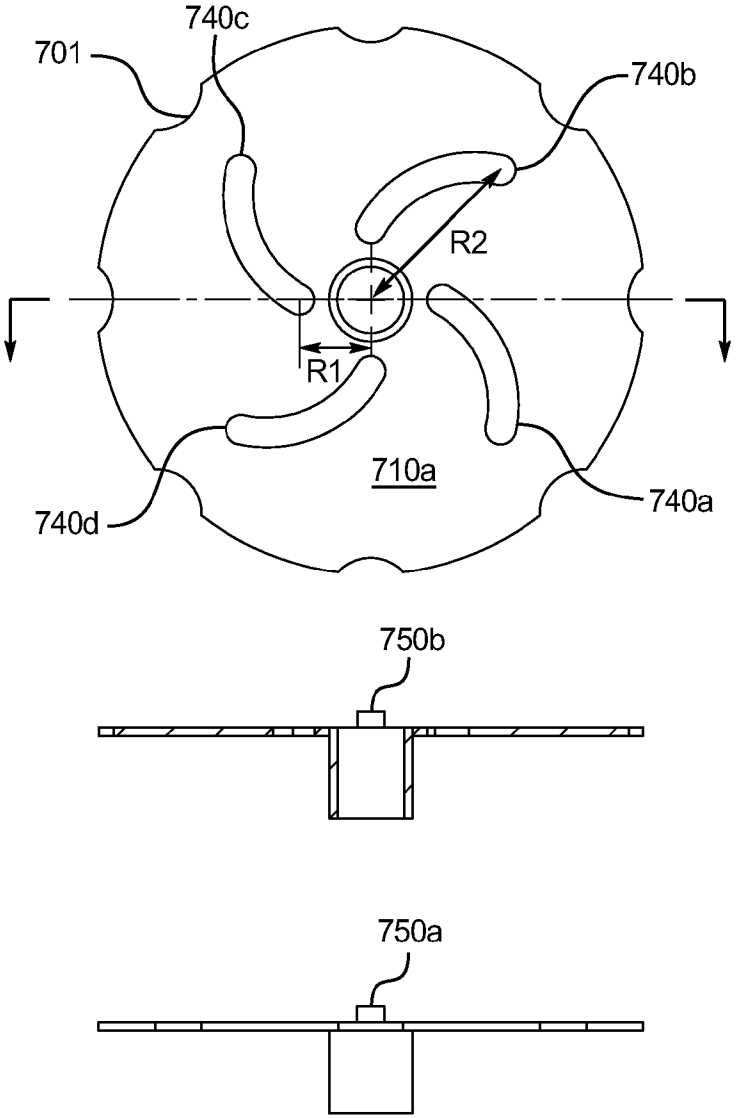
FIG. 9
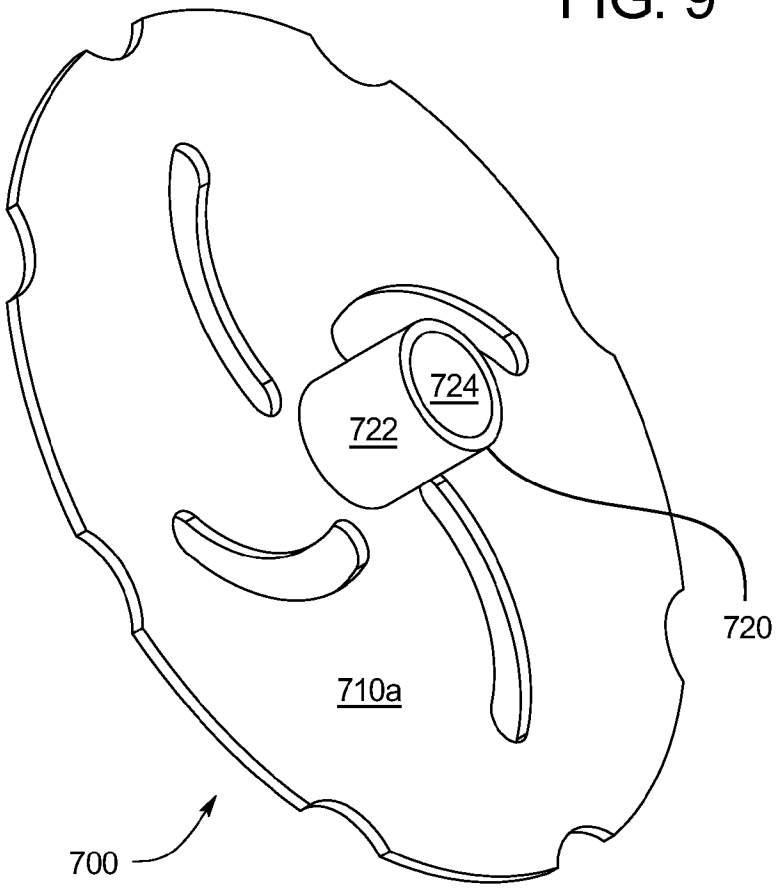

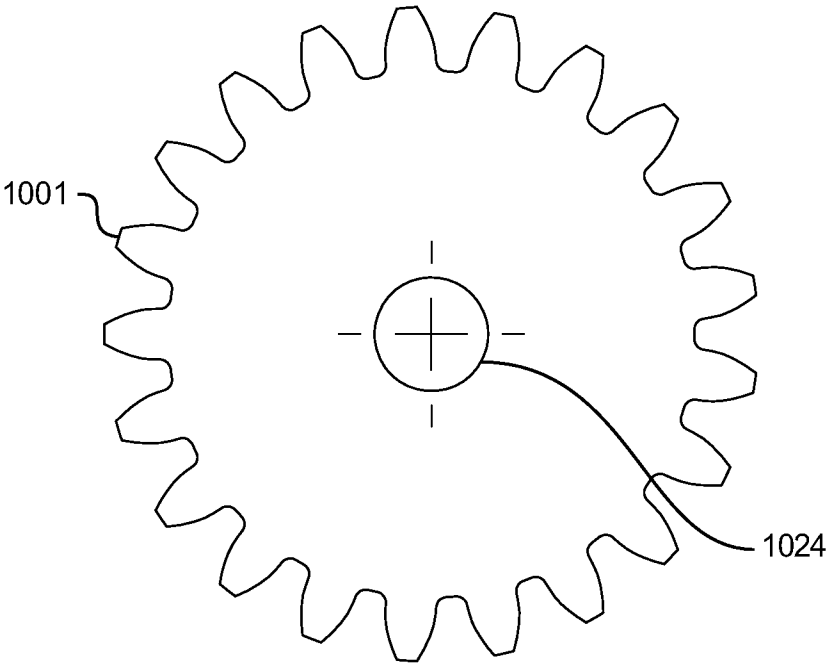
FIG. 12
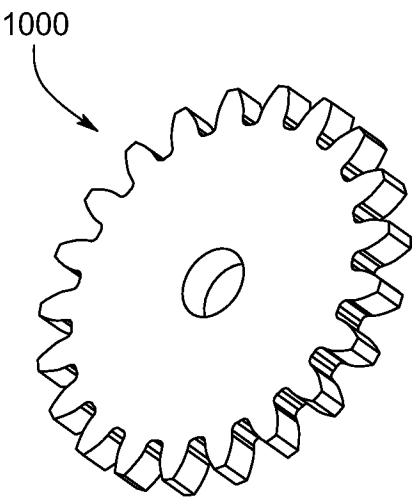

WINCH HAVING ADJUSTABLE INITIAL MECHANICAL ADVANTAGE

PRIORITY CLAIM

This patent application claims priority to and the benefit of U.S. Provisional Patent Application No. 61/819,256, filed on May 3, 2013, the entire contents of which are incorporated herein by reference.

BACKGROUND

Winches are well known. A conventional winch includes a drum; a crank arm configured to, when turned, rotate the drum; and a rope, cable, chain, wire, or strap having one end attached to the drum. In operation, when a user turns the crank arm in one direction, the winch winds the rope onto the drum, and when the user turns the crank arm in the opposite direction, the winch winds the rope off of the drum.

Winches are typically used (occasionally in conjunction with pulley systems) to lift objects, to lower objects, and/or to pull objects. A winch has an initial mechanical advantage that determines how difficult it is to initially turn the crank arm to lift (or lower or pull) the object and how many turns of the crank arm it takes to lift (or lower) the object to a desired height (or to pull the object a desired distance). The initial mechanical advantage of the winch is based in part on: (a) an outer diameter of the drum of the winch (and the outer circumference of the drum of the winch, which is calculated using the outer diameter); (b) the size and quantity of any gears employed in the winch; and (c) the length of the crank arm. The winch provides the initial mechanical advantage when the rope is wound completely off of the drum, and the mechanical advantage decreases as the rope is wound onto the drum and onto itself (which creates a larger effective outer diameter of the drum).

Thus, the outer diameter of the drum of the winch in part determines the initial mechanical advantage the winch provides when initially lifting (or lowering or pulling) an object. That is, the outer diameter of the drum of the winch in part determines how difficult it is to initially turn the crank arm to lift (or lower or pull) the object and how many turns of the crank arm it takes to lift (or lower) the object to a desired height (or to pull the object the desired distance). A winch providing a low initial mechanical advantage makes it more difficult to initially turn the crank arm to lift (or lower or pull) the object, but lifts (or lowers) the object to the desired height (or pulls the object the desired distance) after a relatively small number of turns of the crank arm. Conversely, a winch providing a high initial mechanical advantage makes it easier to initially turn the crank arm to lift (or lower or pull) the object, but lifts (or lowers) the object to the desired height (or pulls the object the desired distance) after a relatively large number of turns of the crank arm.

Conventional winches have drums having fixed or non-variable outer diameters and, therefore, such conventional winches have fixed or non-variable initial mechanical advantages. This can be frustrating for certain users. For instance, for a given winch, one user may prefer a higher initial mechanical advantage than the winch currently provides because the user desires to lift the object to the desired height in as few turns of the crank arm as possible. On the other hand, another user may prefer a lower initial mechanical advantage than the winch currently provides because the user finds it too difficult to turn the crank arm. Thus, there is a need for a new and improved winch having an adjustable or variable mechanical advantage that solves these problems.

SUMMARY

Various embodiments of the present disclosure provide a winch having a user-adjustable or variable initial mechanical advantage. In one embodiment, the winch of the present disclosure has an outer drum diameter that is adjustable or variable by a user between: (a) a minimum outer drum diameter, which is associated with a maximum initial mechanical advantage provided by the winch; and (b) a maximum outer drum diameter, which is associated with a minimum initial mechanical advantage provided by the winch. Generally, as the initial mechanical advantage provided by the winch increases, the difficulty of initially turning the crank arm of the winch to lift an object decreases, but the number of turns of the crank arm required to lift the object to a desired height increases. Thus, when the outer drum diameter of the winch is set to the minimum outer drum diameter, the crank arm is relatively easy to initially turn to lift the object and must be turned a relatively large number of times to lift the object to the desired height. Conversely, when the outer drum diameter of the winch is set to the maximum outer drum diameter, the crank arm is relatively difficult to initially turn to lift the object and must be turned a relatively small number of times to lift the object to the desired height.

The winch of the present disclosure solves the above-described problems by providing the user with the flexibility to adjust or vary the initial mechanical advantage of the winch to the user's preference based on, for example, the mass of the object to be lifted and the user's strength.

The winch of the present disclosure can be used in various different applications or mechanical apparatuses. For example, the winch of the present disclosure may be used to lift objects, to lower objects, or to pull objects, in certain instances in conjunction with a pulley system. The winch may be attached to a wall stud, a boat trailer, a truck, the deck of a boat, and any other suitable surface.

Additional features and advantages of the present disclosure are described in, and will be apparent from, the following Detailed Description and the Figures.

BRIEF DESCRIPTION OF THE DRAWINGS

FIG. 7 includes a perspective view and a front elevational view of the front plate of the winch of FIG. 1A.

FIG. 8 includes a perspective view and a front elevational view of the partition of the winch of FIG. 1A.

FIG. 9 includes a perspective view, a front elevational view, a front elevational view, and a cross-sectional view of the rear adjustment plate of the winch of FIG. 1A.

FIG. 12 includes a perspective view and a side elevational view of the drive gear of the winch of FIG. 1A.

DETAILED DESCRIPTION

Figure 1A:
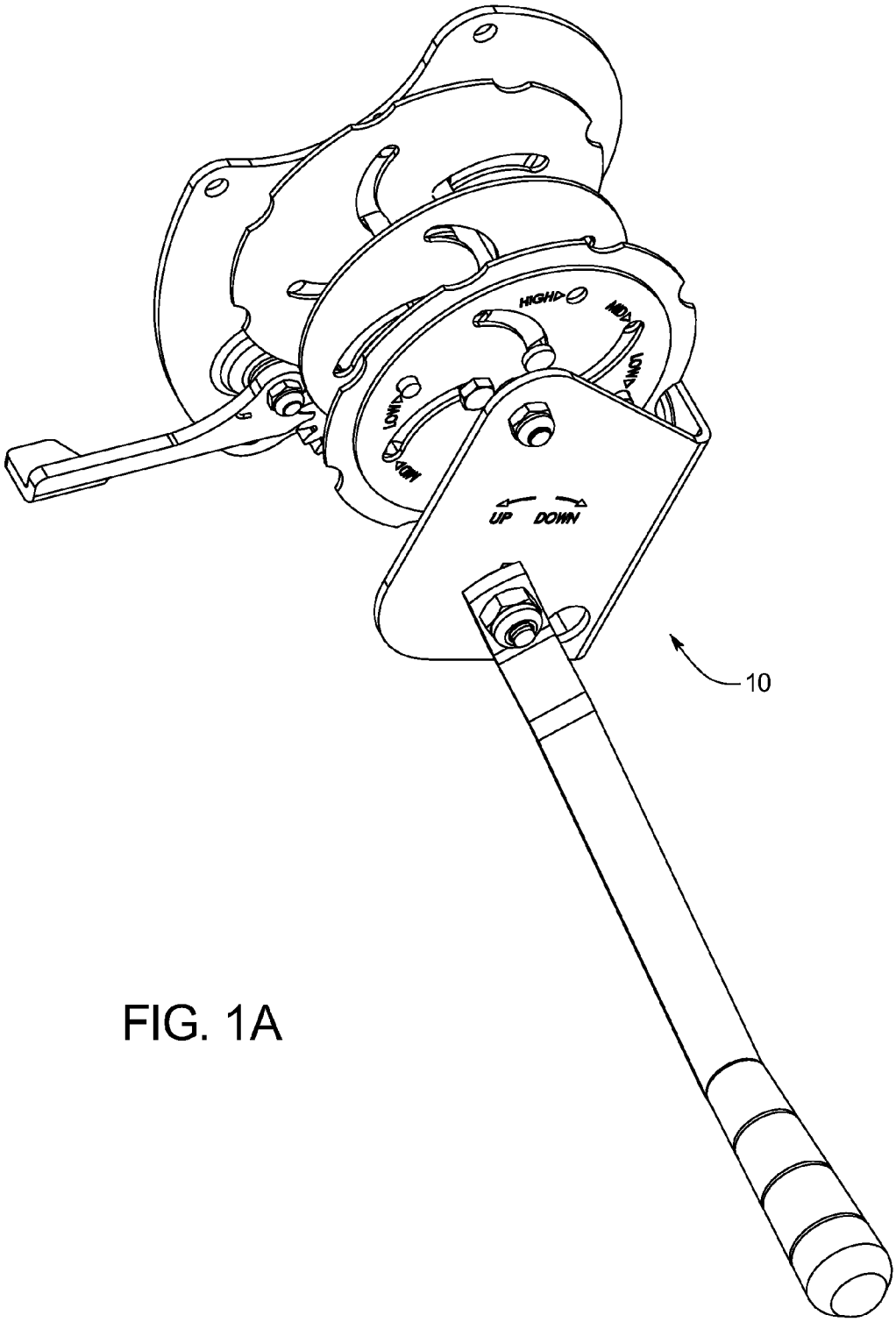
FIG. 1A is a top perspective view of the front and the right side of an example embodiment of the winch of the present disclosure.
Figure 1B:
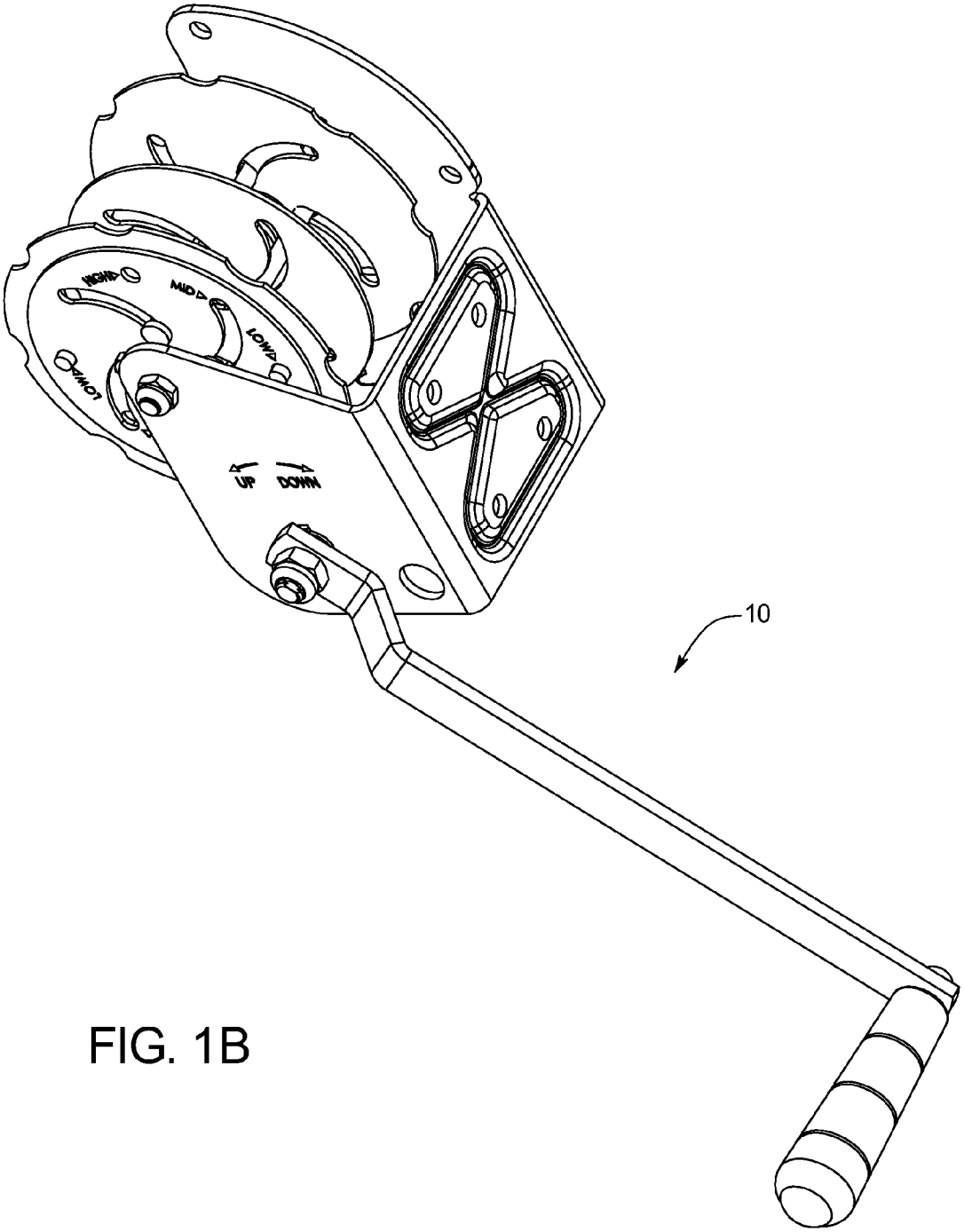
FIG. 1B is a top perspective view of the right side and the back of the winch of FIG. 1A.
Figure 1C:
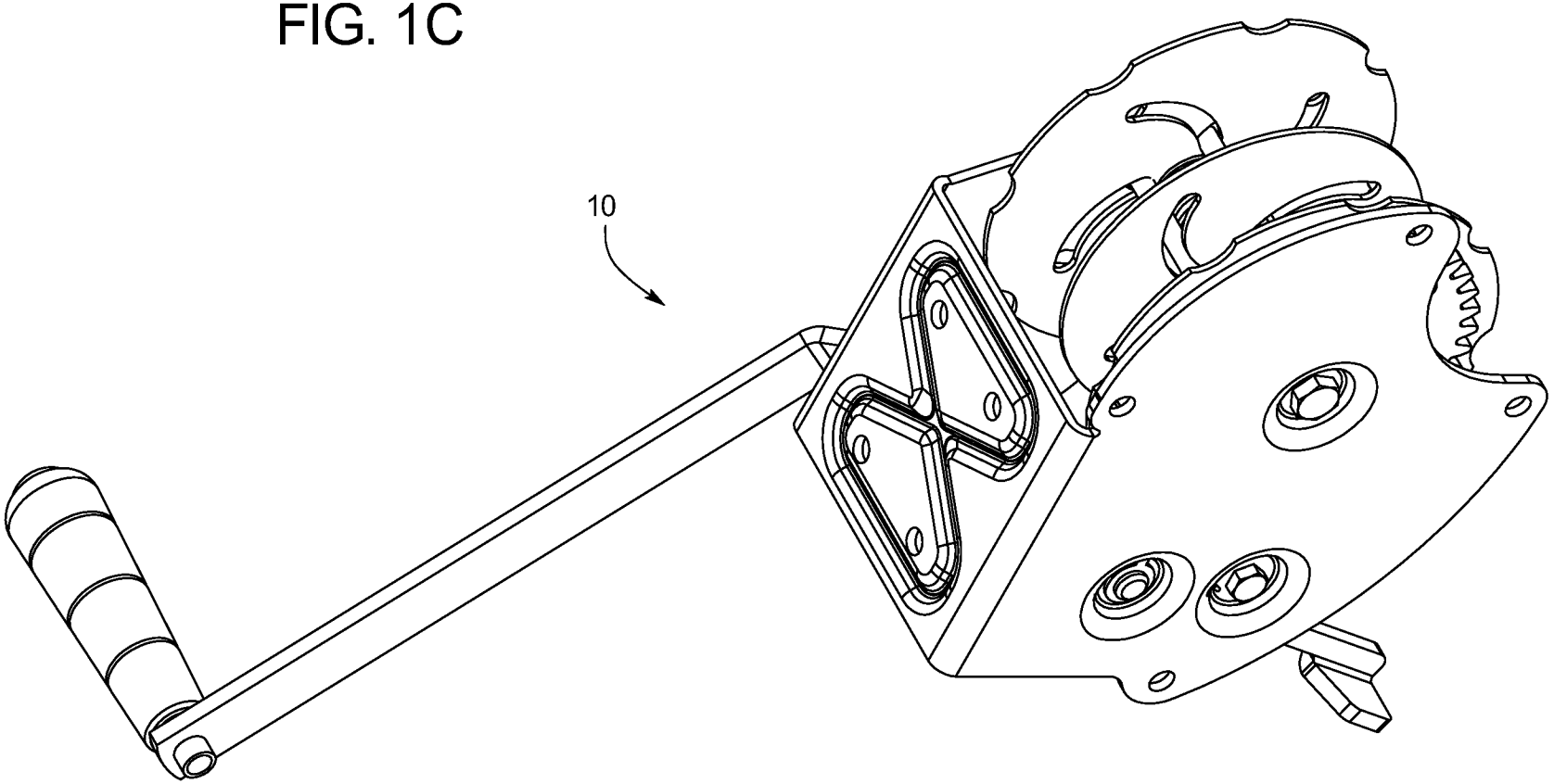
FIG. 1C is a top perspective view of the back and the left side of the winch of FIG. 1A.
Figure 1D:
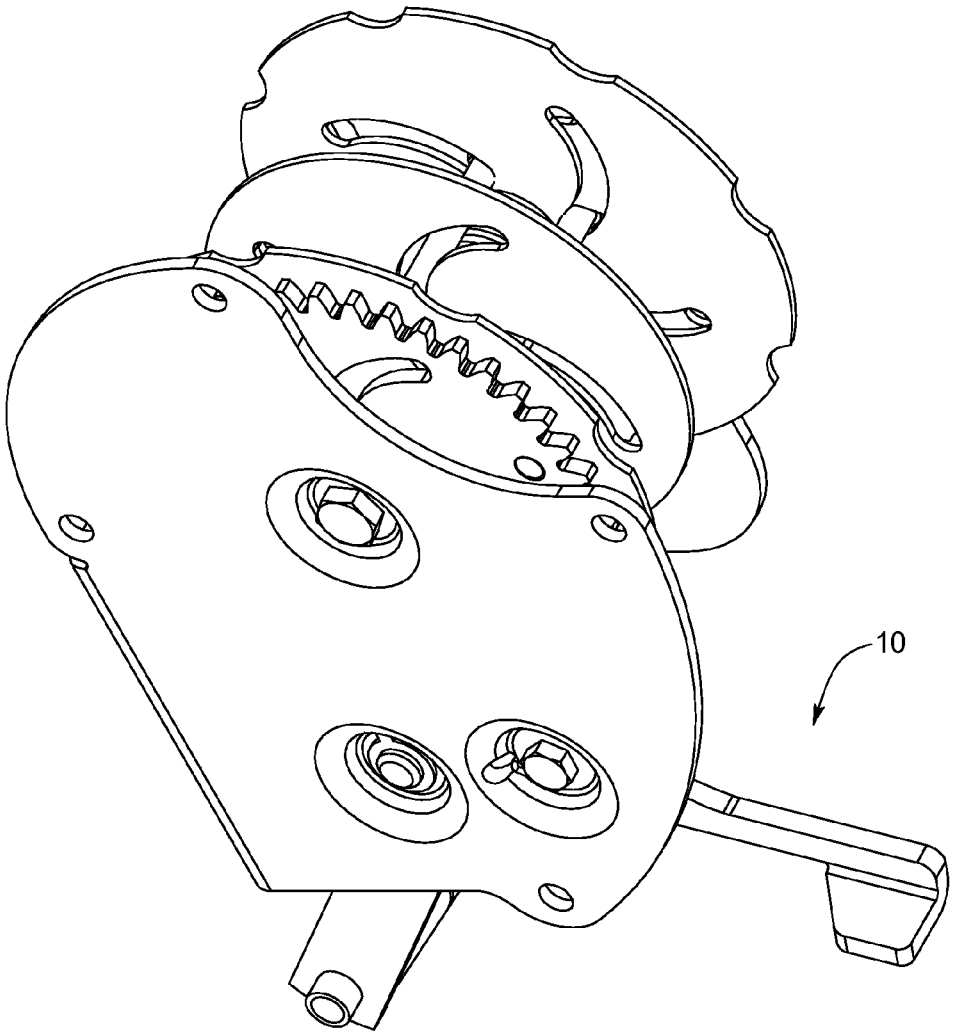
FIG. 1D is a top perspective view of the left side and the front of the winch of FIG. 1A.
Figure 1E:
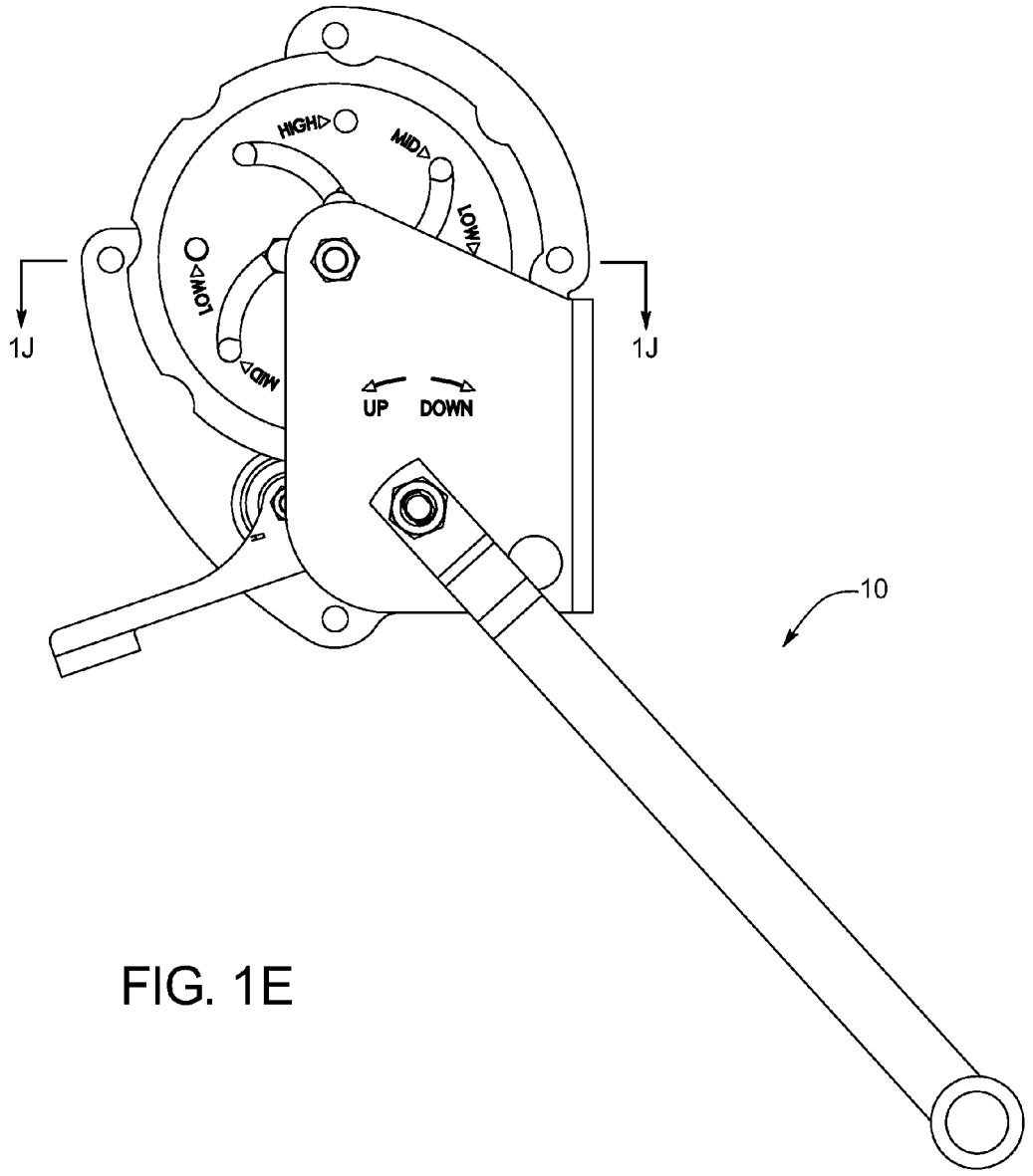
FIG. 1E is an elevational view of the right side of the winch of FIG. 1A.
Figure 1F:
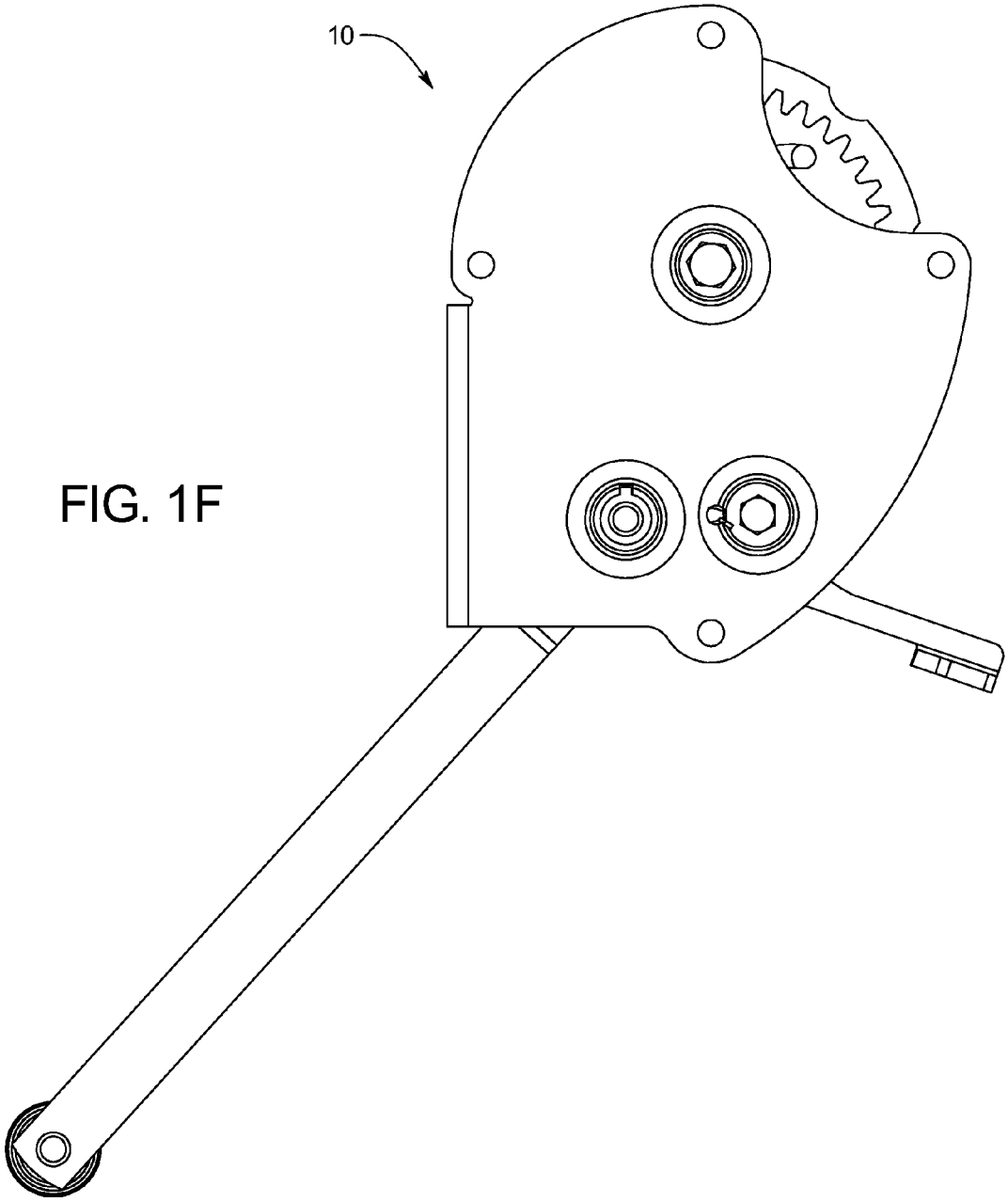
FIG. 1F is an elevational view of the left side of the winch of FIG. 1A.
Figure 1G:
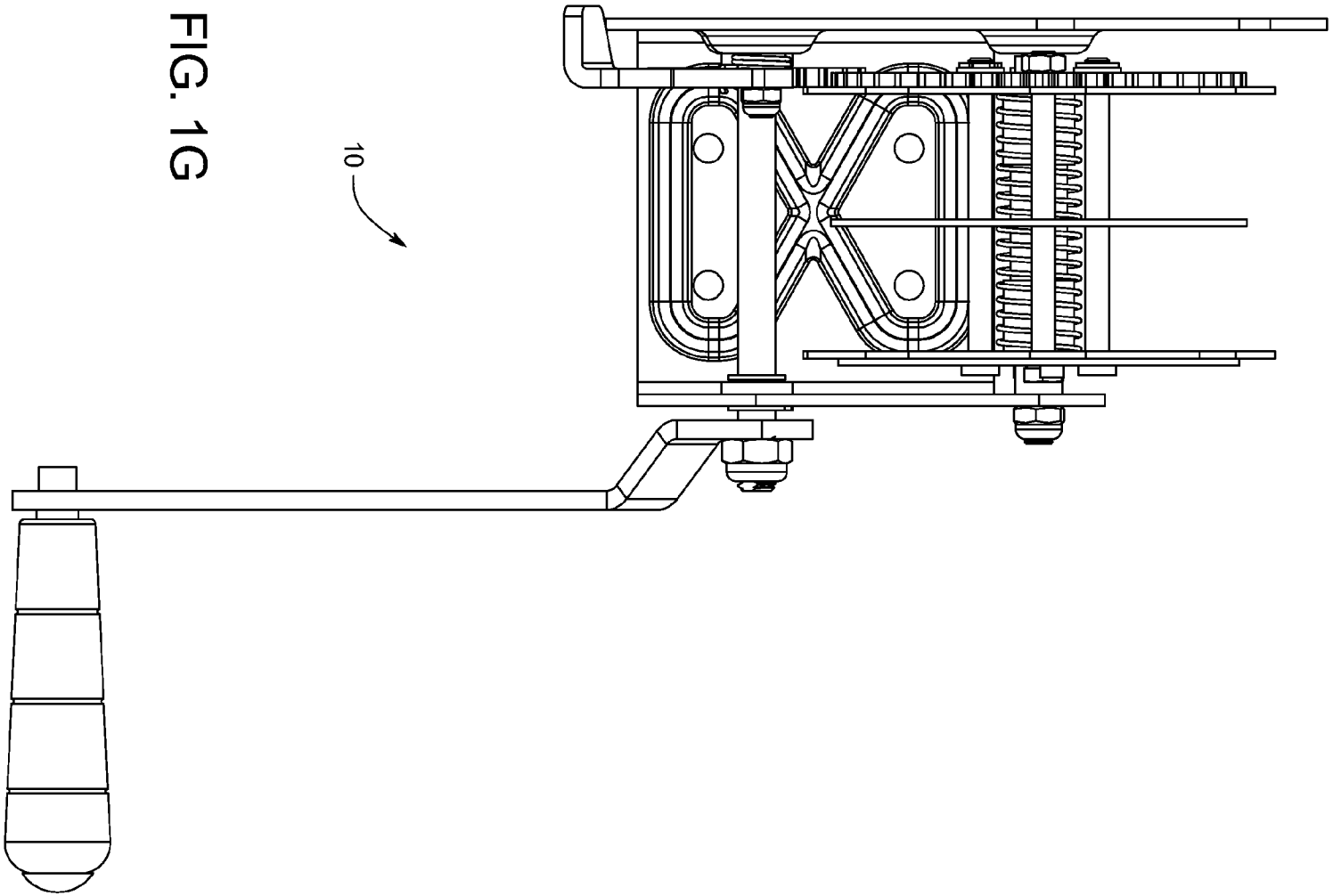
FIG. 1G is an elevational view of the front of the winch of FIG. 1A.
Figure 1H:
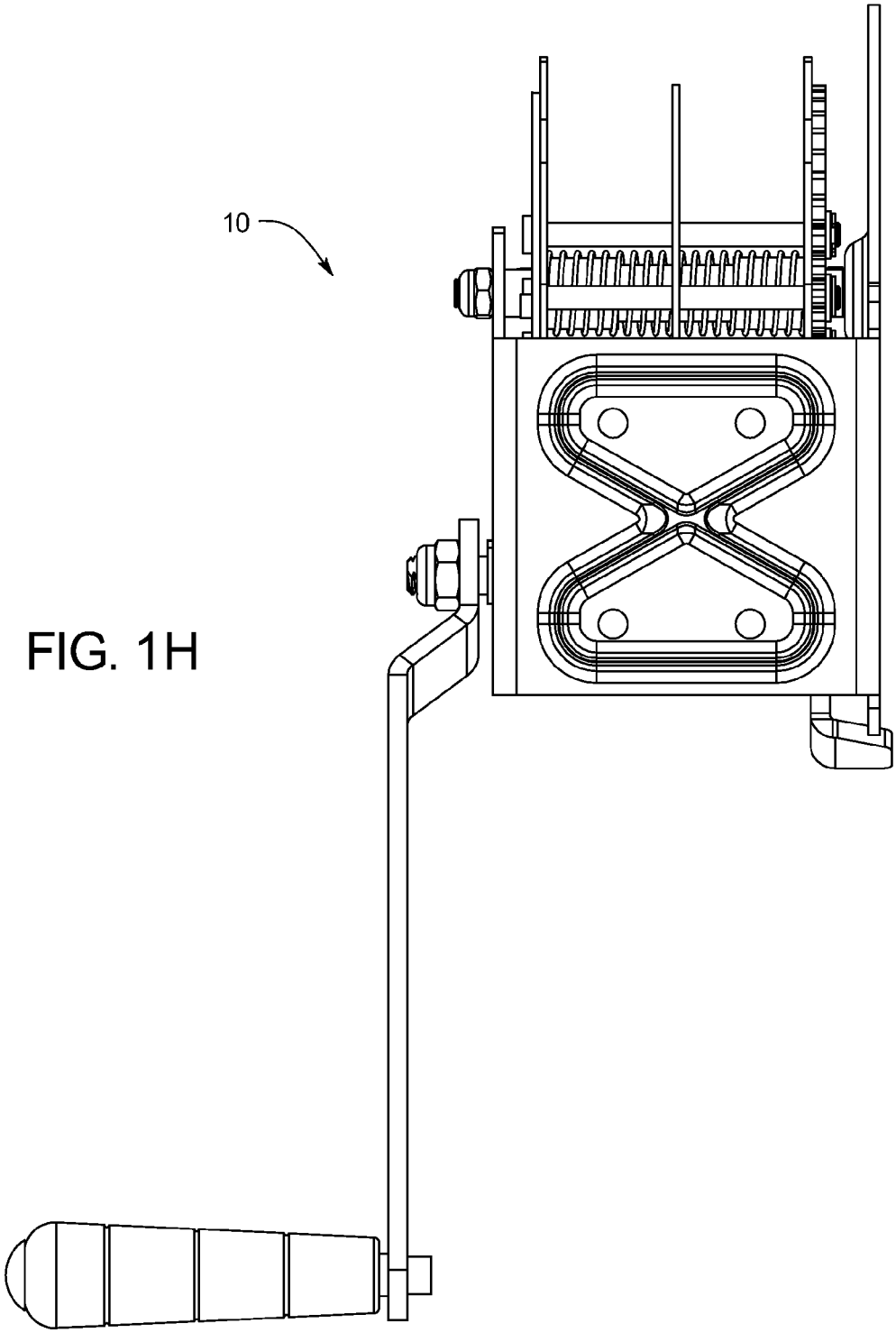
FIG. 1H is an elevational view of the back of the winch of FIG. 1A.
Figure 1I:
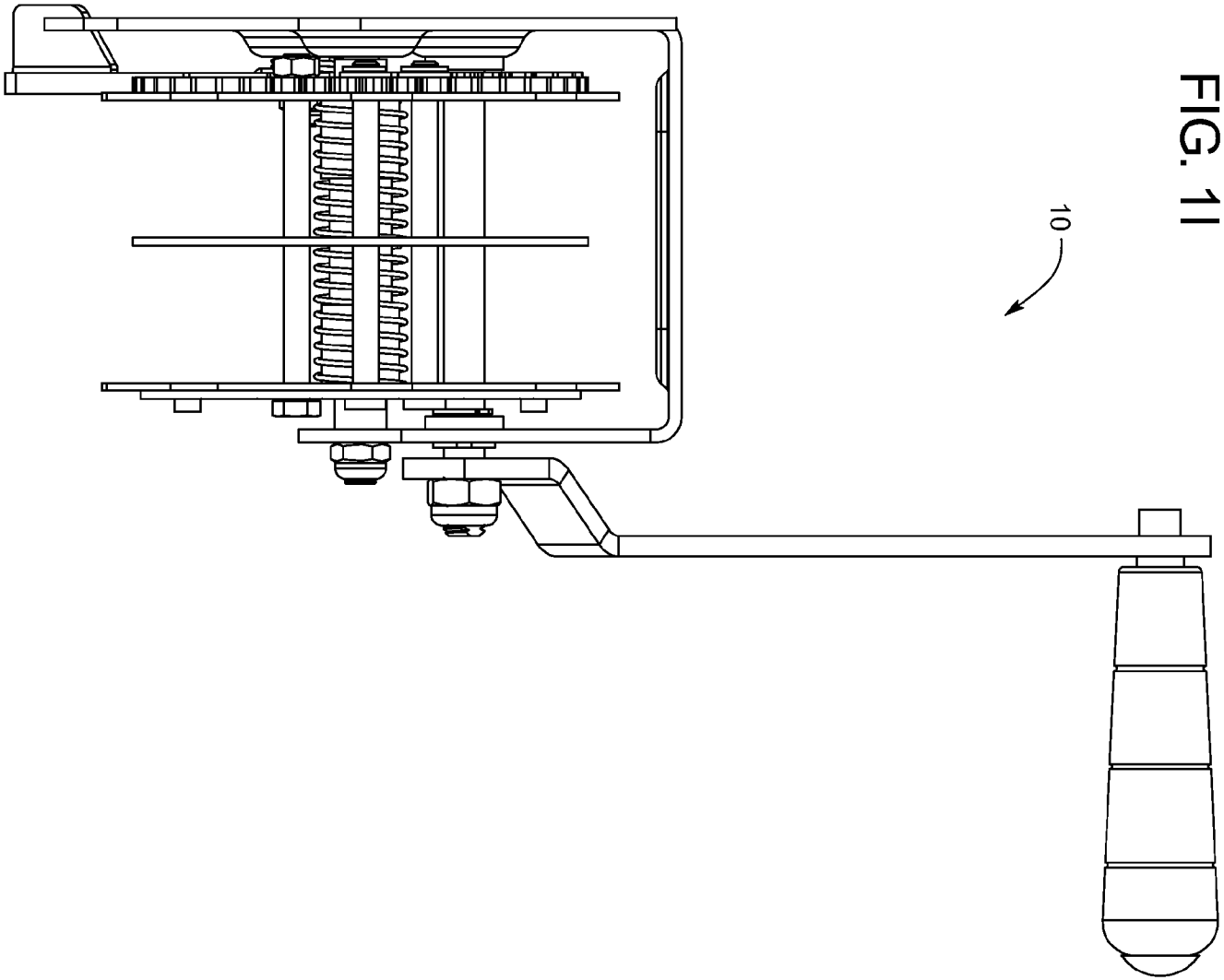
FIG. 1I is a top plan view of the winch of FIG. 1A.
Figure 1J:
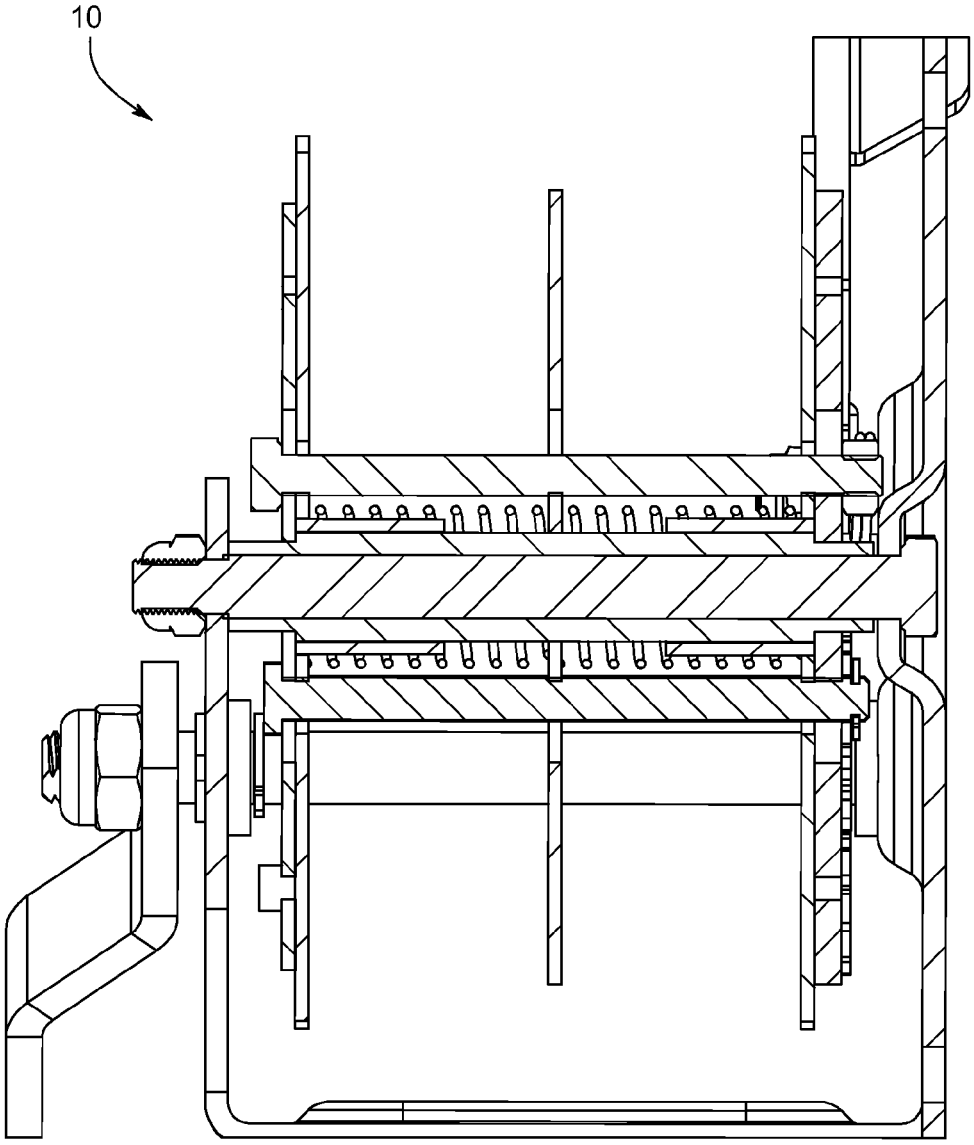
FIG. 1J is a cross-sectional view of the winch of FIG. 1A taken substantially along line 1J-1J of FIG. 1E.

Various embodiments of the present disclosure provide a winch having a user-adjustable or variable initial mechanical advantage. In one embodiment, the winch of the present disclosure has an outer drum diameter that is adjustable or variable by a user between: (a) a minimum outer drum diameter, which is associated with a maximum initial mechanical advantage provided by the winch; and (b) a maximum outer drum diameter, which is associated with a minimum initial mechanical advantage provided by the winch. Generally, as the initial mechanical advantage provided by the winch increases, the difficulty of initially turning the crank arm of the winch to lift an object decreases, but the number of turns of the crank arm required to lift the object to a desired height increases. Thus, when the outer drum diameter of the winch is set to the minimum outer drum diameter, the crank arm is relatively easy to initially turn to lift the object and must be turned a relatively large number of times to lift the object to the desired height. Conversely, when the outer drum diameter of the winch is set to the maximum outer drum diameter, the crank arm is relatively difficult to initially turn to lift the object and must be turned a relatively small number of times to lift the object to the desired height.

Winch Components

Referring now to the drawings, FIGS. 1A, 1B, 1C, 1D, 1E, 1F, 1G, 1H, 1I, 1J, 1K, 1L, 1M, 1N, 2A, and 2B illustrate one example embodiment of the winch of the present disclosure, which is generally indicated by numeral 10. FIGS. 3 to 16 illustrate various components of the winch 10.

The winch 10 includes the following components, each of which is described in further detail below: (a) a frame 100 to which various components of the winch 10 are mounted (either directly or indirectly); (b) a center shaft 200 fixedly mounted to the frame 100; (c) a center sleeve 300 rotatably mounted or journaled around the center shaft 200; (d) a driven gear 400 fixedly mounted to the center sleeve 300 proximate a left end of the center sleeve 300; (e) a front plate 500 fixedly mounted to the center sleeve 300 proximate a right end of the center sleeve 300; (f) a partition 600 fixedly mounted to the center sleeve 300 substantially at a point along the center of the length of the center sleeve 300 between the driven gear 400 and the front plate 500; (g) a front adjustment plate 1700 rotatably and slidably mounted to the center sleeve 300 between the front plate 500 and the partition 600; (h) a rear adjustment plate 700 rotatably and slidably mounted to the center sleeve 300 between the driven gear 400 and the partition 600; (i) a rear compression spring 800 rotatably and slidably mounted to the center sleeve 300 between the rear adjustment plate 700 and the partition 600; (j) a front compression spring 1800 rotatably and slidably mounted to the center sleeve 300 between the front adjustment plate 1700 and the partition 600; (k) a plurality of adjustment pins 900, each of which is mounted within and spans aligned portions of a set of corresponding adjustment slots of the front plate 500, the front adjustment plate 1700, the partition 600, the rear adjustment plate 700, and the driven gear 400; (l) a drive shaft 1100 rotatably mounted to the frame 100; (m) a drive gear 1000 fixedly mounted to the drive shaft 1100; (n) a crank arm 1200 connected to the drive shaft 1100; (o) a handle 1300 connected to the crank arm 1200; and (p) a lock lever 1400 rotatably mounted to the frame 100.

Figure 3:
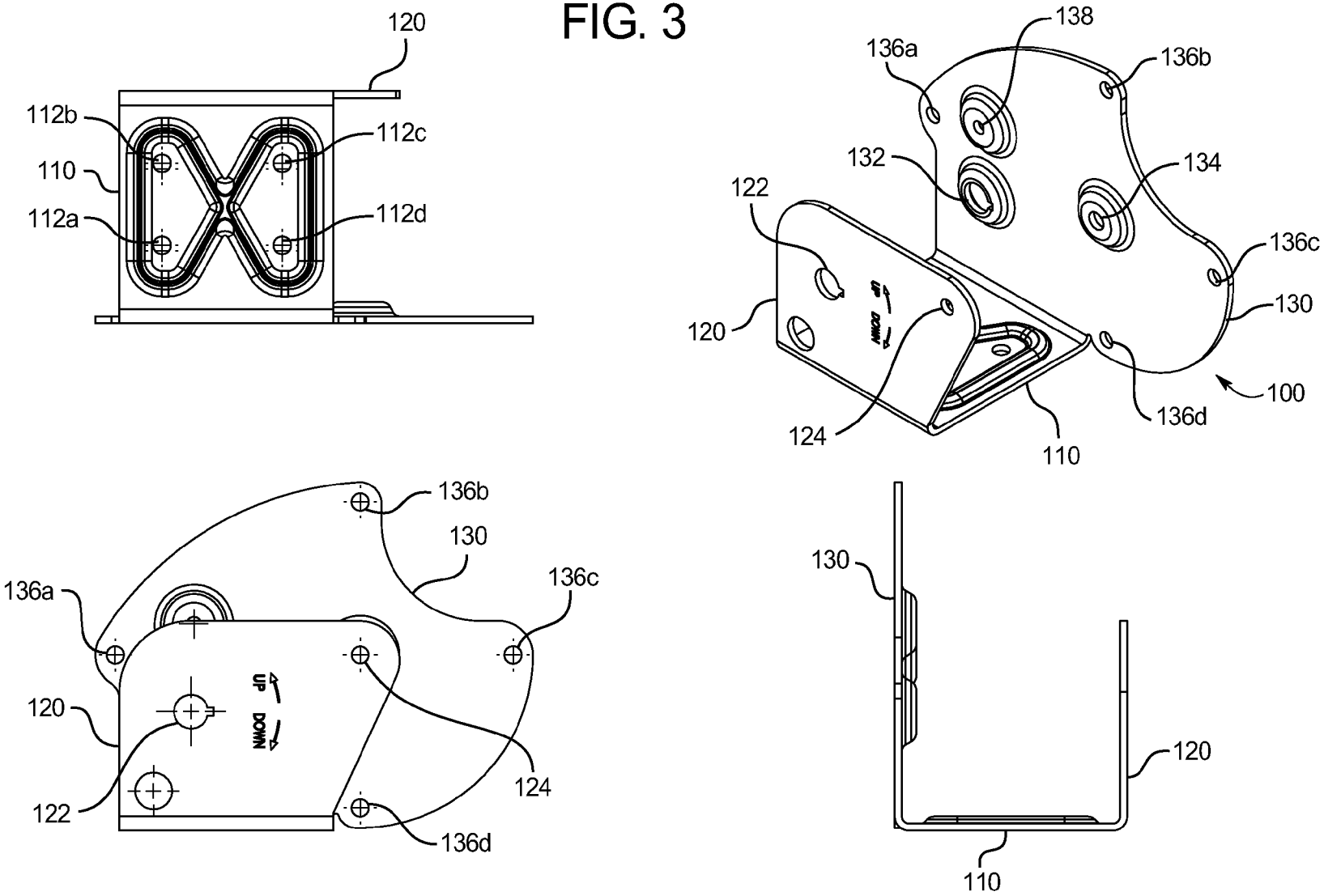
FIG. 3 includes a perspective view, a bottom plan view, a side elevational view, and a front elevational view of the frame of the winch of FIG. 1A.

As illustrated in FIG. 3, the frame 100 includes a base 110, a right side wall 120 extending from the base 110, and a left side wall 130 extending from the base 110. In this example embodiment, the right side wall 120 and the left side wall 130 are substantially parallel to one another and are each substantially perpendicular to the base 110. It should be appreciated that the base, the right side wall, and the left side wall may be configured or shaped differently in other embodiments.

The base 110 defines a first set of frame mounting openings 112*a*, 112*b*, 112*c*, and 112*d* therethrough, which may be used to mount the frame 100 (and the winch 10) to a suitable surface, such as a stud or a wall surface (such as drywall) mounted to the stud. The right side wall 120 defines a drive shaft receiving opening 122 and a center shaft receiving opening 124 therethrough. The left side wall defines: (a) a drive shaft receiving opening 132; (b) a center shaft receiving opening 134; (c) a second set of frame mounting openings 136*a*, 136*b*, 136*c*, and 136*d*; and (d) a lock lever mounting opening 138 therethrough. The drive shaft receiving opening 122 of the right side wall 120 and the drive shaft receiving opening 132 of the left side wall 130 are aligned, and are configured to receive the drive shaft 1100. Similarly, the center shaft receiving opening 124 of the right side wall 120 and the center shaft receiving opening 134 of the left side wall 130 are aligned, and are configured to receive the center shaft 200. The second set of frame mounting openings 136*a*, 136*b*, 136*c*, and 136*d* may be used instead of or in addition to the first set of frame mounting openings 112*a*, 112*b*, 112*c*, and 112*d* to mount the frame 100 (and the winch 10) to a suitable surface. The lock lever mounting opening 138 is used to rotatably mount the lock lever 1400 to the frame 100, as described below.

Figure 4:
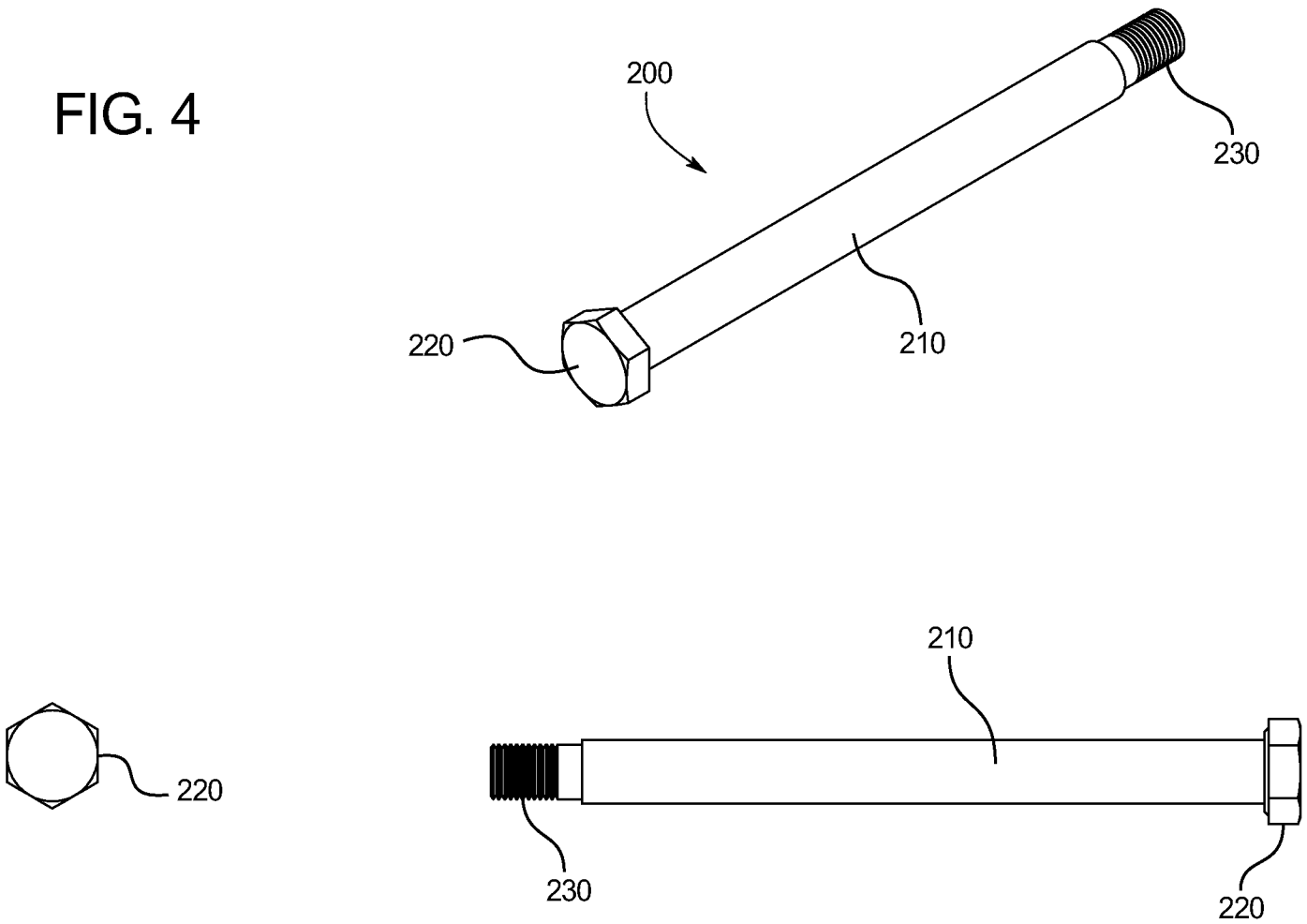
FIG. 4 includes a perspective view, a side elevational view, and a front elevational view of the center shaft of the winch of FIG. 1A.

As illustrated in FIG. 4, the center shaft 200 includes a cylindrical body 210, a head 220 at one end of the body 210, and a plurality of threads 230 at the other end of the body 220 opposite the head 220.

Figure 5:
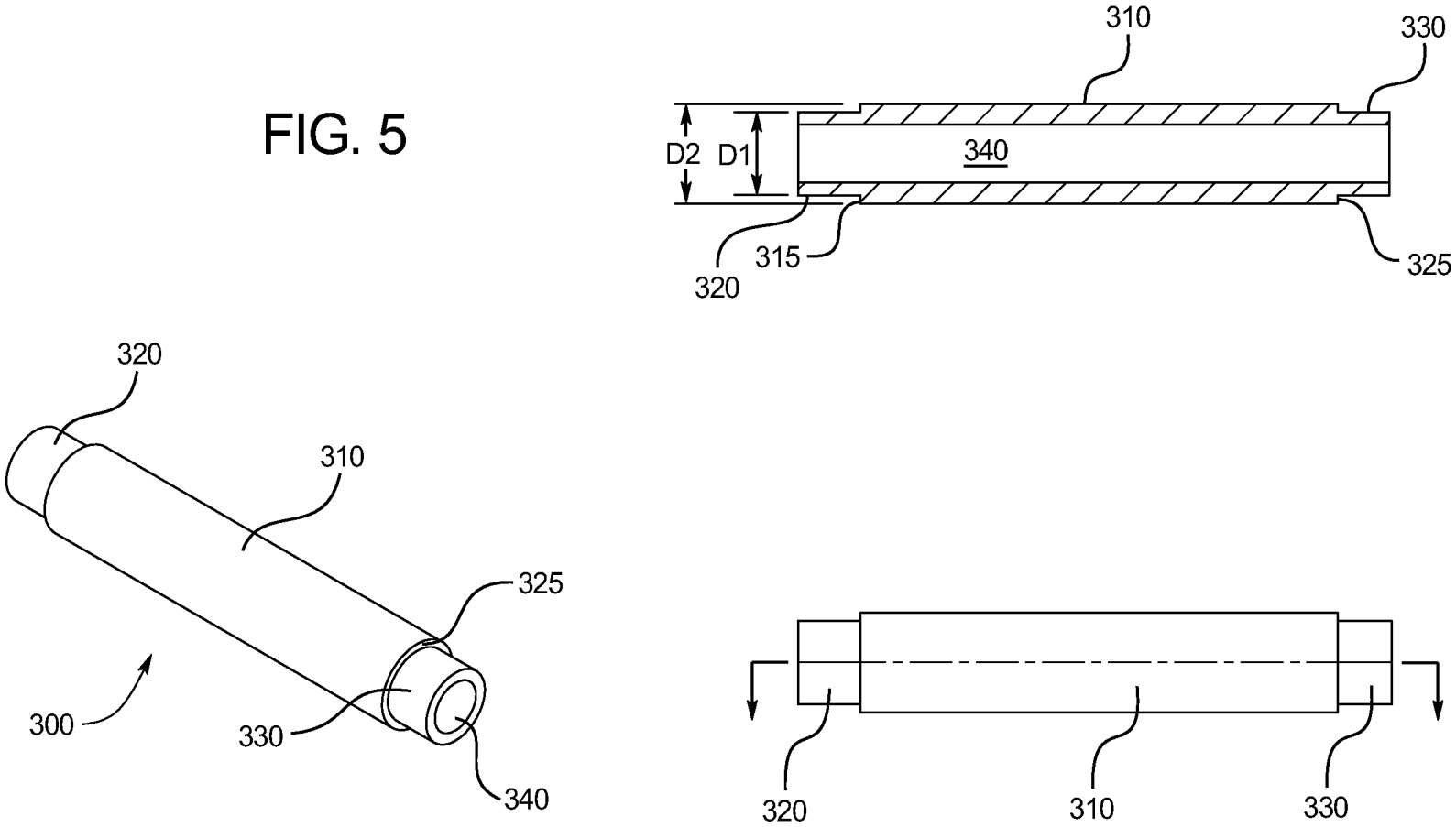
FIG. 5 includes a perspective view, a front elevational view, and a cross-sectional view of the center sleeve of the winch of FIG. 1A.

As illustrated in FIG. 5, the center sleeve 300 includes a generally annular body including a plurality of outer surfaces and an inner surface 340. The inner surface 340 defines a cylindrical center shaft receiving channel through the center sleeve 300. The center shaft receiving channel is configured to receive the center shaft 200, as described below. The outer surfaces include: (a) a component mounting surface 310 having a diameter D2; (b) a driven gear mounting surface 320 at the left end of the center sleeve 300 and having a diameter D1, which is smaller than the diameter D2; and (c) a front plate mounting surface 330 at the right end of the center sleeve 300 also having the diameter D1. The component mounting surface 310 and the driven gear mounting surface 320 are spanned by an annular driven gear constraining surface 315 that is substantially perpendicular to the component mounting surface 310 and the driven gear mounting surface 320 around their respective circumferences. The component mounting surface 310 and the front plate mounting surface 330 are spanned by an annular front plate constraining surface 325 that is substantially perpendicular to the component mounting surface 310 and the front plate mounting surface 330 around their respective circumferences.

Figure 6:
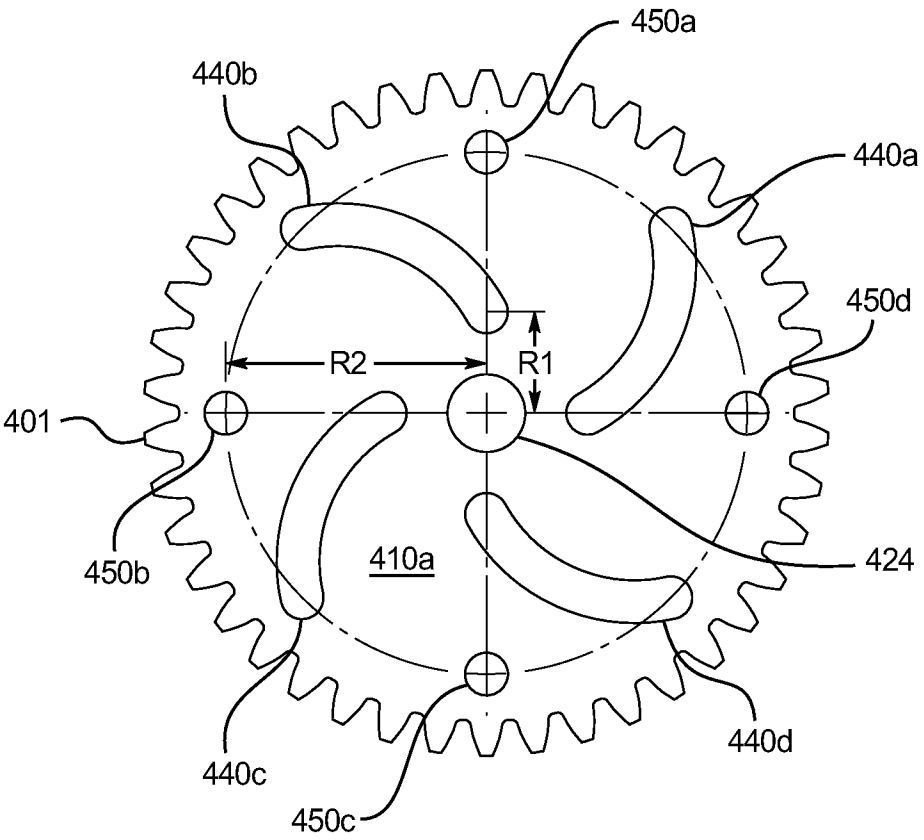
FIG. 6 includes a perspective view and a front elevational view of the driven gear of the winch of FIG. 1A.
Figure 6:
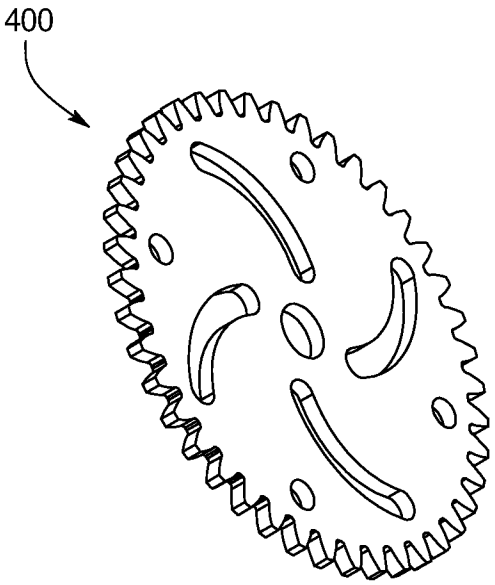

As illustrated in FIG. 6, the driven gear 400 is generally disc-shaped and includes: (a) a front surface 410*a*, (b) a back surface opposite the front surface (not shown), and (c) a plurality of teeth 401 circumferentially spaced about the periphery of the driven gear 400. The driven gear 400 also defines: (a) a center sleeve receiving opening 424 through the center of the driven gear 400; (b) a plurality of circumferentially spaced, curved or arcuate adjustment slots 440*a*, 440*b*, 440*c*, and 440*d* therethrough; and (c) a plurality of circumferentially spaced, circular locking tab receiving openings 450*a*, 450*b*, 450*c*, and 450*d* therethrough.

The center sleeve receiving opening 424 has a diameter greater than the diameter D1 and less than the diameter D2, and is configured to receive the center sleeve 300 such that the driven gear 400 may be fixedly mounted to the center sleeve 300 along the driven gear mounting surface 320.

When viewed facing the front surface 410*a* (as in FIG. 6), the adjustment slots 440 are generally convex, and each include an inner end located approximately at a radial distance R1 from the center of the driven gear 400 and an outer end located counter-clockwise from the inner end approximately at a radial distance R2 (which is greater than the radial distance R1) from the center of the driven gear 400. When viewed facing the back surface, the adjustment slots 440 are generally convex, and each include the inner end located approximately at the radial distance R1 from the center of the driven gear 400 and the outer end located clockwise from the inner end approximately at the radial distance R2 from the center of the driven gear 400.

As described below, each adjustment slot 440 is configured to receive one of the adjustment pins 900, and facilitates the adjustment of the radial location of that adjustment pin 900 (i.e., facilitates the adjustment of the outer drum diameter of the winch 10). In this example embodiment, each adjustment slot 440 includes an inner pin holding area proximate the inner end of the adjustment slot 440 located at the radial distance R1 from the center of the driven gear 400, an outer pin holding area proximate the outer end of the adjustment slot 440 located at the radial distance R2 from the center of the driven gear 400, and a pin movement area spanning the inner and outer pin holding areas along which the adjustment pin 900 may move to adjust the radial location of the adjustment pin from the inner pin holding area to the outer pin holding area (or vice-versa). As described in detail below, in this example embodiment, the orientation of the adjustment slots of the driven gear 400, the rear adjustment plate 700, the partition 600, the front adjustment plate 1700, and the front plate 500 enable the adjustment pin 900 to be held in place at the inner pin holding area or the outer pin holding area (i.e., held such that the radial distance from the center of the center sleeve does not substantially change).

Each locking tab receiving opening 450 is centered at the radial distance R2 from the center of the driven gear 400. Locking tab receiving opening 450*a* is centered between the outer pin holding areas of adjustment slots 440*a* and 440*b*, locking tab receiving opening 450*b* is centered between the outer pin holding areas of adjustment slots 440*b* and 440*c*, locking tab receiving opening 450*c* is centered between the outer pin holding areas of adjustment slots 440*c* and 440*d*, and locking tab receiving opening 450*d* is centered between the outer pin holding areas of adjustment slots 440*d* and 440*a*. Each locking tab receiving opening 450 is configured to receive a locking tab 750 of the rear adjustment plate 700, as described below.

As illustrated in FIG. 7, the front plate 500 is generally disc-shaped and includes a front surface 510*a* and a back surface opposite the front surface (not shown). The front plate 500 also defines: (a) a center sleeve receiving opening 524 through the center of the front plate 500; (b) a plurality of circumferentially spaced, curved or arcuate adjustment slots 540*a*, 540*b*, 540*c*, and 540*d* therethrough; and (c) a plurality of circumferentially spaced, circular locking tab receiving openings 550*a*, 550*b*, 550*c*, and 550*d* therethrough.

The center sleeve receiving opening 524 has a diameter greater than the diameter D1 and less than the diameter D2, and is configured to receive the center sleeve 300 such that the front plate 500 may be fixedly mounted to the center sleeve 300 along the front plate mounting surface 330.

The adjustment slots 540 are substantially identical to the adjustment slots 440 of the driven gear 400. That is, when viewed from the front surface 510*a* (as in FIG. 7), the adjustment slots 540 are generally convex, and each include an inner end located approximately at the radial distance R1 from the center of the front plate 500 and an outer end located counter-clockwise from the inner end approximately at the radial distance R2 from the center of the front plate 500. When viewed facing the back surface, the adjustment slots 540 are generally convex, and each include the inner end located approximately at the radial distance R1 from the center of the front plate 500 and the outer end located clockwise from the inner end approximately at the radial distance R2 from the center of the front plate 500.

As described below, each adjustment slot 540 is configured to receive one of the adjustment pins 900, and facilitates the adjustment of the radial location of that adjustment pin 900 (i.e., facilitates the adjustment of the outer drum diameter of the winch 10). In this example embodiment, each adjustment slot 540 includes an inner pin holding area proximate the inner end of the adjustment slot 540 located at the radial distance R1 from the center of the front plate 500, an outer pin holding area proximate the outer end of the adjustment slot 540 located at the radial distance R2 from the center of the front plate 500, and a pin movement area spanning the inner and outer pin holding areas along which the adjustment pin 900 may move to adjust the radial location of the adjustment pin from the inner pin holding area to the outer pin holding area (or vice-versa). As described in detail below, in this example embodiment, the orientation of the adjustment slots of the driven gear 400, the rear adjustment plate 700, the partition 600, the front adjustment plate 1700, and the front plate 500 enable the adjustment pin 900 to be held in place at the inner pin holding area or the outer pin holding area (i.e., held such that the radial distance from the center of the center sleeve does not substantially change).

The locking tab receiving openings 550 are substantially identical to the locking tab receiving openings 450 of the driven gear 400. That is, each locking tab receiving opening 550 is centered at the radial distance R2 from the center of the front plate 500. Locking tab receiving opening 550*a* is centered between the outer pin holding areas of adjustment slots 540*a* and 540*b*, locking tab receiving opening 550*b* is centered between the outer pin holding areas of adjustment slots 540*b* and 540*c*, locking tab receiving opening 550*c* is centered between the outer pin holding areas of adjustment slots 540*c* and 540*d*, and locking tab receiving opening 550*d* is centered between the outer pin holding areas of adjustment slots 540*d* and 540*a*. Each locking tab receiving opening 550 is configured to receive a locking tab 1750 of the front adjustment plate 1700, as described below.

As illustrated in FIG. 8, the partition 600 is generally disc-shaped and includes a front surface 610*a* and a back surface opposite the front surface (not shown). The partition 600 also defines a center sleeve receiving opening 624 through the center of the partition 600, and a plurality of circumferentially spaced, curved or arcuate adjustment slots 640*a*, 640*b*, 640*c*, and 640*d* therethrough.

The center sleeve receiving opening 624 is configured to receive the center sleeve 300 such that the partition 600 may be fixedly mounted to the center sleeve 300 along the component mounting surface 310.

The adjustment slots 640 are substantially identical to the adjustment slots 440 of the driven gear 400 and the adjustment slots 540 of the front plate 500. That is, when viewed from the front surface 610*a* (as in FIG. 8), the adjustment slots 640 are generally convex, and each include an inner end located approximately at the radial distance R1 from the center of the partition 600 and an outer end located counter-clockwise from the inner end approximately at the radial distance R2 from the center of the partition 600. When viewed facing the back surface, the adjustment slots 640 are generally convex, and each include the inner end located approximately at the radial distance R1 from the center of the partition 600 and the outer end located clockwise from the inner end approximately at the radial distance R2 from the center of the driven gear 400.

As described below, each adjustment slot 640 is configured to receive one of the adjustment pins 900, and facilitates the adjustment of the radial location of that adjustment pin 900 (i.e., facilitates the adjustment of the outer drum diameter of the winch 10). In this example embodiment, each adjustment slot 640 includes an inner pin holding area proximate the inner end of the adjustment slot 640 located at the radial distance R1 from the center of the partition 600, an outer pin holding area proximate the outer end of the adjustment slot 640 located at the radial distance R2 from the center of the partition 600, and a pin movement area spanning the inner and outer pin holding areas along which the adjustment pin 900 may move to adjust the radial location of the adjustment pin from the inner pin holding area to the outer pin holding area (or vice-versa). As described in detail below, in this example embodiment, the orientation of the adjustment slots of the driven gear 400, the rear adjustment plate 700, the partition 600, the front adjustment plate 1700, and the front plate 500 enable the adjustment pin 900 to be held in place at the inner pin holding area or the outer pin holding area (i.e., held such that the radial distance from the center of the center sleeve does not substantially change).

As illustrated in FIG. 9, the rear adjustment plate 700 includes: (a) a generally disc-shaped body 710 having a front surface 710*a* and a back surface opposite the front surface (not shown), and (b) an annular mounting sleeve 720 extending transversely from the center of the front surface 710*a*. The body 710 defines a plurality of indentations 701 circumferentially spaced around the periphery of the body 710. The body 710 also defines a center sleeve receiving opening through the center of the body 710, and a plurality of circumferentially spaced, curved or arcuate adjustment slots 740*a*, 740*b*, 740*c*, and 740*d* therethrough.

The mounting sleeve 720 includes an outer surface 722 and an inner surface 724. The inner surface 724 has a diameter approximately equal to that of the center sleeve receiving opening of the body 710. The inner surface 724 of the mounting sleeve 720 and the center sleeve receiving opening defined by the body 710 together define a generally cylindrical center sleeve receiving channel through the rear adjustment plate 700. The center sleeve receiving channel of the rear adjustment plate 700 is configured to receive the center sleeve, as described below.

The adjustment slots 740 are substantially identical in size and shape to the adjustment slots 440 of the driven gear 400, the adjustment slots 540 of the front plate 500, and the adjustment slots 640 of the partition 600. However, the adjustment slots 740 have orientations opposite of the orientations of the corresponding adjustment slots 440, 540, and 640. More specifically, when viewed from the front surface 710*a* (as in FIG. 9), the adjustment slots 740 are generally convex, and each include an inner end located approximately at the radial distance R1 from the center of the rear adjustment plate 700 and an outer end located clockwise (i.e., opposite the counter-clockwise orientation of the corresponding adjustment slots 440, 540, and 640 when viewed from the front surfaces of their respective components) from the inner end approximately at the radial distance R2 from the center of the rear adjustment plate 700. When viewed from the back surface, the adjustment slots 740 are generally convex, and each include the inner end located approximately at the radial distance R1 from the center of the rear adjustment plate 700 and the outer end located counter-clockwise (i.e., opposite the clockwise orientation of the corresponding adjustment slots 440, 540, and 640 when viewed from the back surfaces of their respective components) from the inner end approximately at the radial distance R2 from the center of the rear adjustment plate 700.

As described below, each adjustment slot 740 is configured to receive one of the adjustment pins 900, and facilitates the adjustment of the radial location of that adjustment pin 900 (i.e., facilitates the adjustment of the outer drum diameter of the winch 10). In this example embodiment, each adjustment slot 740 includes an inner pin holding area proximate the inner end of the adjustment slot 740 located at the radial distance R1 from the center of the rear adjustment plate 700, an outer pin holding area proximate the outer end of the adjustment slot 740 located at the radial distance R2 from the center of the rear adjustment plate 700, and a pin movement area spanning the inner and outer pin holding areas along which the adjustment pin 900 may move to adjust the radial location of the adjustment pin from the inner pin holding area to the outer pin holding area (or vice-versa). As described in detail below, in this example embodiment, the orientation of the adjustment slots of the driven gear 400, the rear adjustment plate 700, the partition 600, the front adjustment plate 1700, and the front plate 500 enable the adjustment pin 900 to be held in place at the inner pin holding area or the outer pin holding area (i.e., held such that the radial distance from the center of the center sleeve does not substantially change).

The rear adjustment plate 700 also includes two circumferentially spaced locking tabs 750*a* and 750*b* extending transversely from the back surface of the base 710. Each locking tab 750 is centered at the radial distance R2 from the center of the base 710. Locking tab 750*a* is centered between adjustment slots 740*b* and 740*c*, and locking tab 750*b* is centered between adjustment slots 740*d* and 740*a*.

Figure 2A:
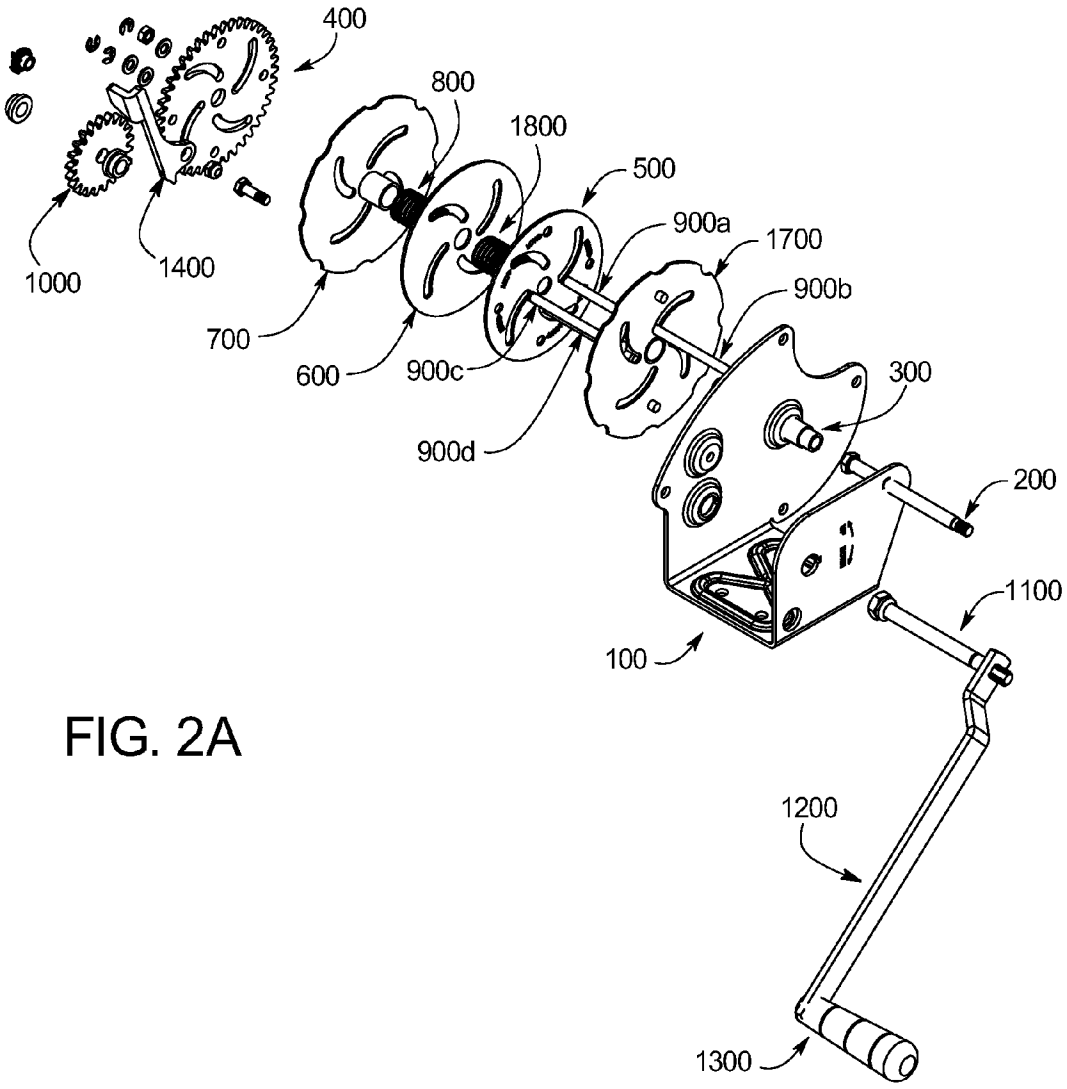
FIG. 2A is an exploded top perspective view of the winch of FIG. 1A.
Figure 2B:
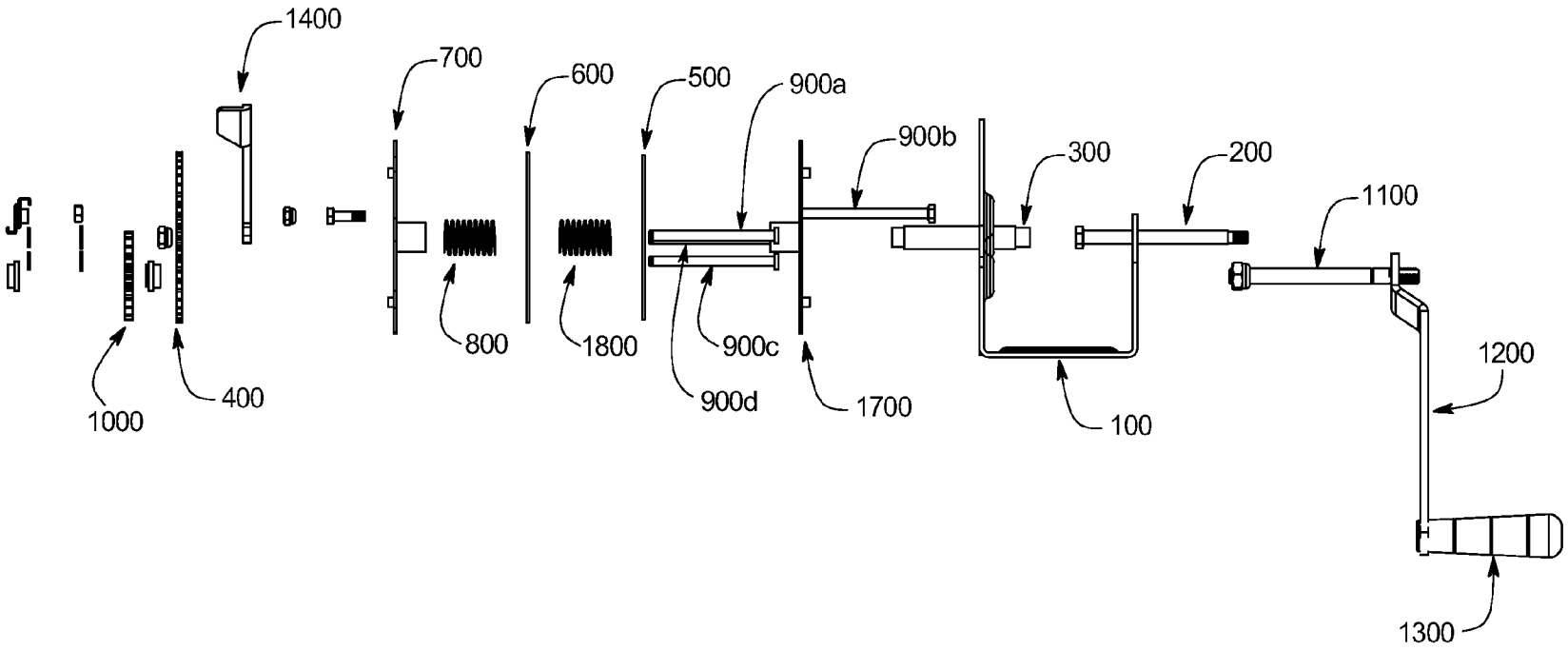
FIG. 2B is an exploded top plan view of the winch of FIG. 1A.

As best illustrated in FIGS. 2A and 2B, the front adjustment plate 1700 is substantially identical to the rear adjustment plate 700. For brevity, components of the front adjustment plate 1700 that are similar to corresponding components of the rear adjustment plate 700 are not separately described or labeled. For clarity, however, these components of the front adjustment plate 1700 are referred to via corresponding reference numbers in the 1700 series. One difference between the front adjustment plate 1700 and the rear adjustment plate 700 is that the adjustment slots 1740 of the front adjustment plate 1700 have orientations opposite the orientations of the adjustment slots 740 of the rear adjustment plate 700. More specifically, when viewed from the front surface 1710*a* of the front adjustment plate 1700, the adjustment slots 1740 are generally convex, and each include an inner end located approximately at the radial distance R1 from the center of the adjustment plate 1700 and an outer end located counter-clockwise (i.e., opposite the clockwise orientation of the adjustment slots 740 when viewed from the front surface 710*a* of the rear adjustment plate 700) from the inner end approximately at the radial distance R2 from the center of the front adjustment plate 1700. When viewed from the back surface (as in FIG. 2A), the adjustment slots 1740 are generally convex, and each include the inner end located approximately at the radial distance R1 from the center of the front adjustment plate 1700 and the outer end located clockwise (i.e., opposite the counter-clockwise orientation of the adjustment slots 740 when viewed from the back surface of rear adjustment plate 700) from the inner end approximately at the radial distance R2 from the center of the front adjustment plate 1700.

As described below, each adjustment slot 1740 is configured to receive one of the adjustment pins 900, and facilitates the adjustment of the radial location of that adjustment pin 900 (i.e., facilitates the adjustment of the outer drum diameter of the winch 10). In this example embodiment, each adjustment slot 1740 includes an inner pin holding area proximate the inner end of the adjustment slot 1740 located at the radial distance R1 from the center of the front adjustment plate 1700, an outer pin holding area proximate the outer end of the adjustment slot 1740 located at the radial distance R2 from the center of the front adjustment plate 1700, and a pin movement area spanning the inner and outer pin holding areas along which the adjustment pin 900 may move to adjust the radial location of the adjustment pin from the inner pin holding area to the outer pin holding area (or vice-versa). As described in detail below, in this example embodiment, the orientation of the adjustment slots of the driven gear 400, the rear adjustment plate 700, the partition 600, the front adjustment plate 1700, and the front plate 500 enable the adjustment pin 900 to be held in place at the inner pin holding area or the outer pin holding area (i.e., held such that the radial distance from the center of the center sleeve does not substantially change).

Figure 10:
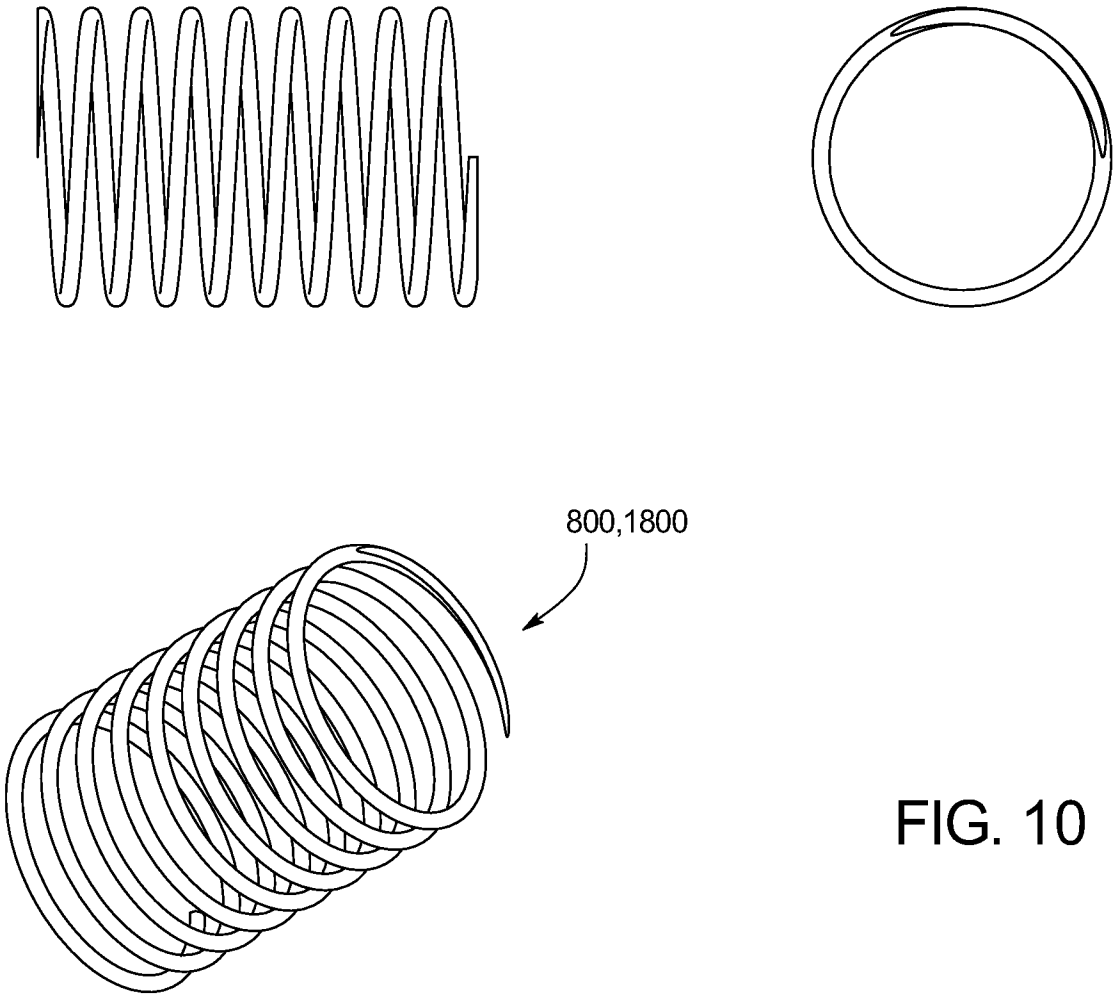
FIG. 10 includes a perspective view, a side elevational view, and a front elevational view of the rear and front compression springs of the winch of FIG. 1A.

As illustrated in FIG. 10, the rear compression spring 800 and the front compression spring 1800 are helical compression springs. The rear and front compression springs 800 and 1800 have a relaxed (i.e., non-compressed) state (in which the compression springs have a relaxed length) when unloaded and a compressed state (in which the compression springs have a compressed length) when loaded. When in the compressed state, the compression springs 800 and 1800 are biased to return to their relaxed state.

Figure 11:
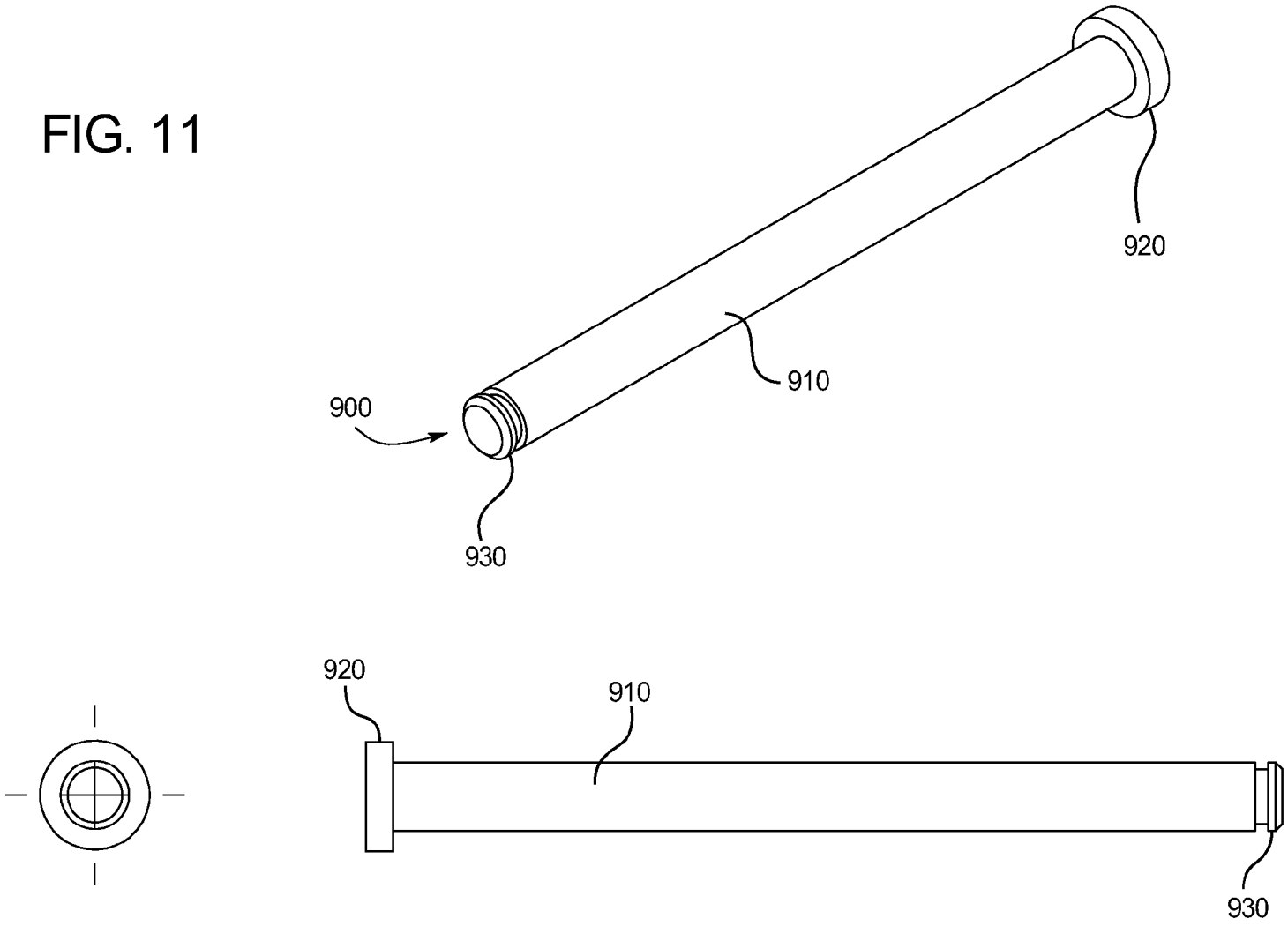
FIG. 11 includes a perspective view, a side elevational view, and a front elevational view of the adjustment pins of the winch of FIG. 1A.

As illustrated in FIG. 11, the adjustment pin 900 includes a cylindrical body 910, a head 920 at one end of the body 910, and a fastening end 930 opposite the head 920.

As illustrated in FIG. 12, the drive gear 1000 is generally disc-shaped and includes a plurality of teeth 1001 that are circumferentially spaced about its periphery and that are configured to mesh with the teeth 401 of the driven gear 400. The drive gear 1000 also defines a drive shaft receiving opening 1024 through the center of the drive gear 1000. The drive shaft receiving opening 1024 is configured to receive the drive shaft 1100 such that the drive gear 1000 may be fixedly mounted to the drive shaft 1100.

Figure 13:
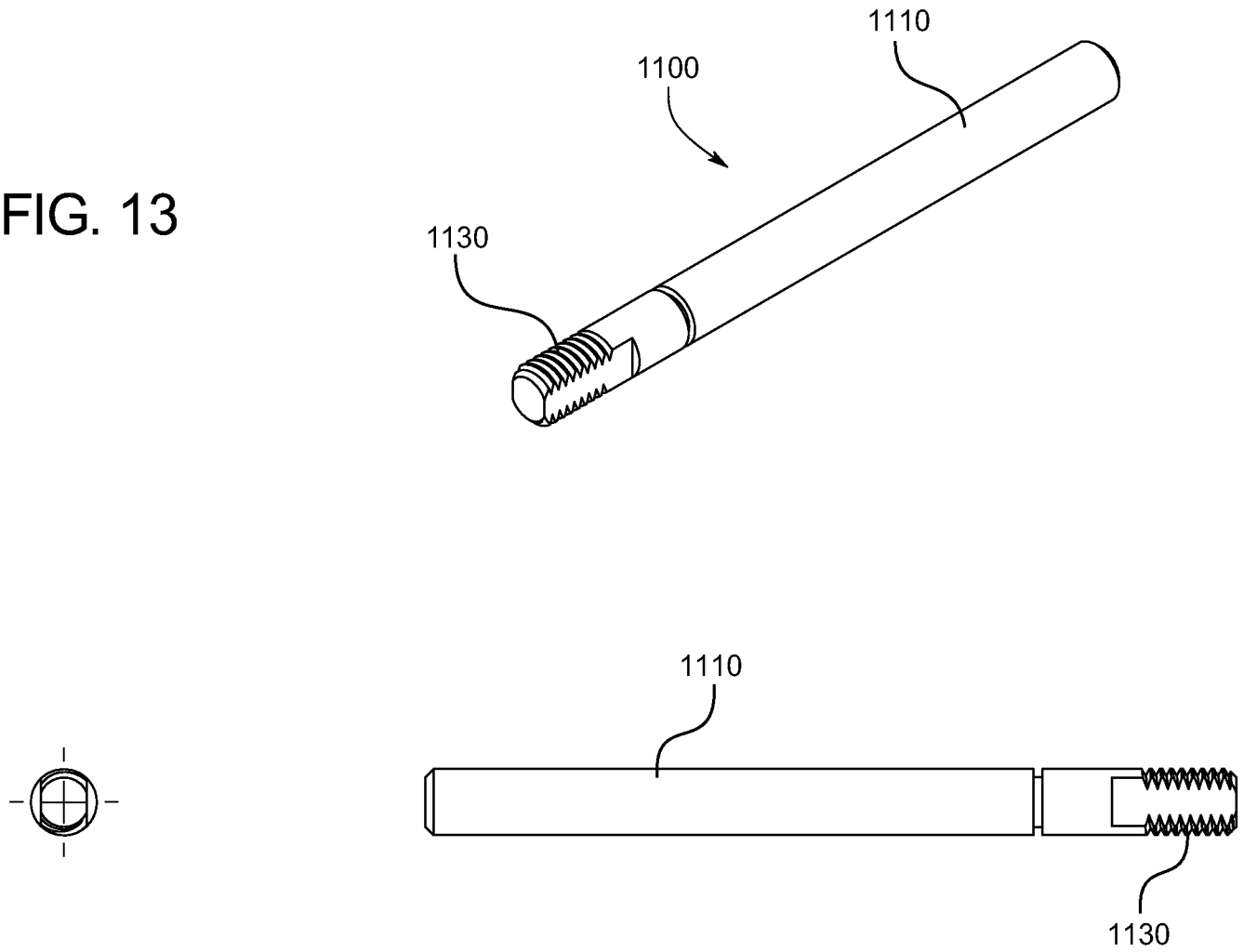
FIG. 13 includes a perspective view, a side elevational view, and a front elevational view of the drive shaft of the winch of FIG. 1A.

As illustrated in FIG. 13, the drive shaft 1100 includes a cylindrical body 1110 having a plurality of threads 1130 at one end.

Figure 14:
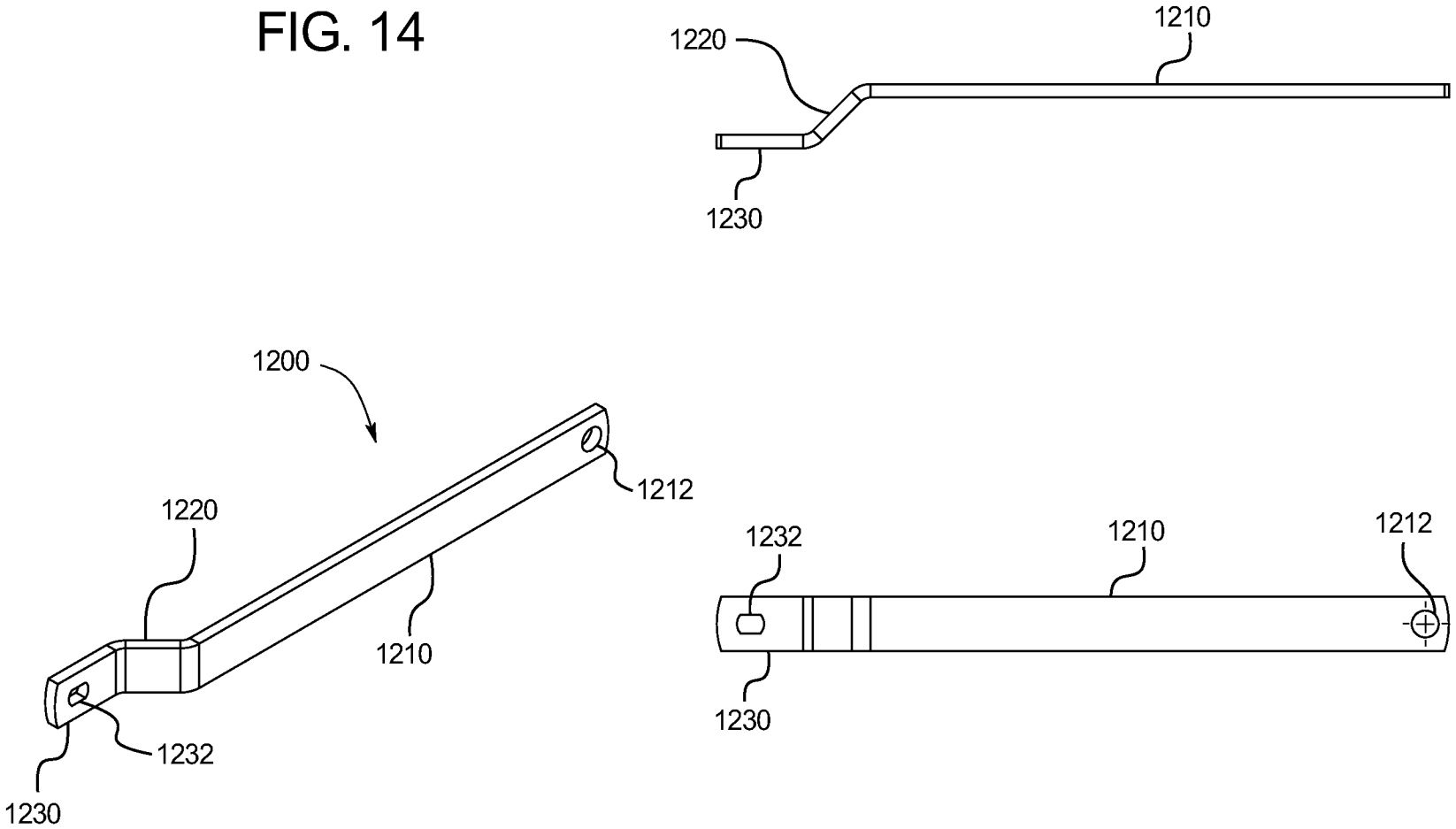
FIG. 14 includes a perspective view, a top plan view, and a front elevational view of the crank arm of the winch of FIG. 1A.

As illustrated in FIG. 14, the crank arm 1200 includes a generally straight drive shaft connector 1230 defining a drive shaft receiving opening 1232 therethrough and a generally straight handle connector 1210 defining a handle fastener receiving opening 1212 therethrough. The drive shaft connector 1230 and the handle connector 1210 are substantially parallel to one another, are offset from one another, and are connected by an angled transitioner 1220. The drive shaft receiving opening 1232 is configured to receive the threaded end 1130 of the drive shaft 1100, and the handle fastener receiving opening 1212 is configured to receive a handle fastener (not shown).

Figure 15:
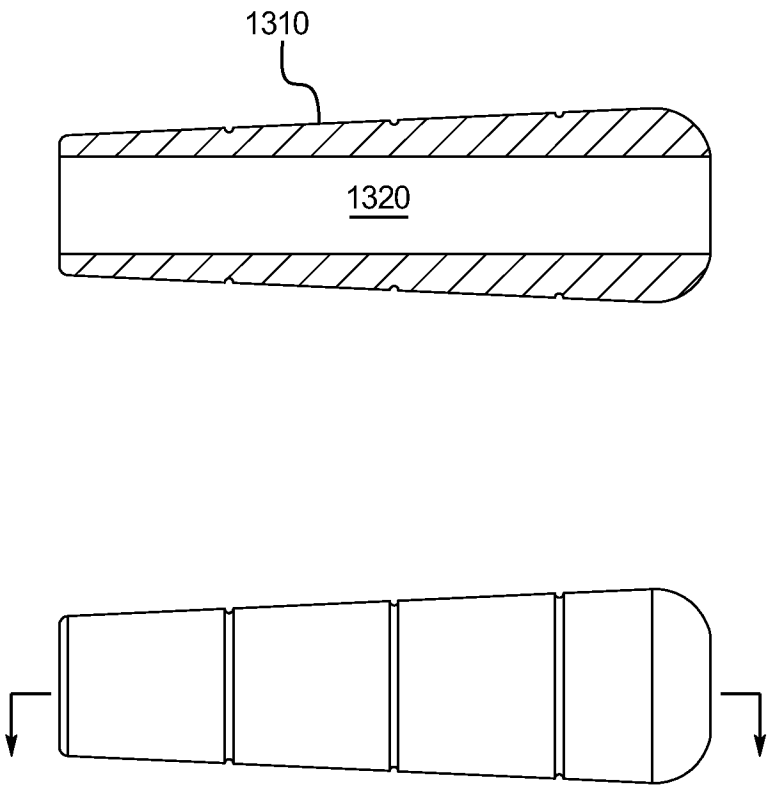
FIG. 15 includes a perspective view, a front elevational view, and a cross-sectional view of the handle of the winch of FIG. 1A.
Figure 15:
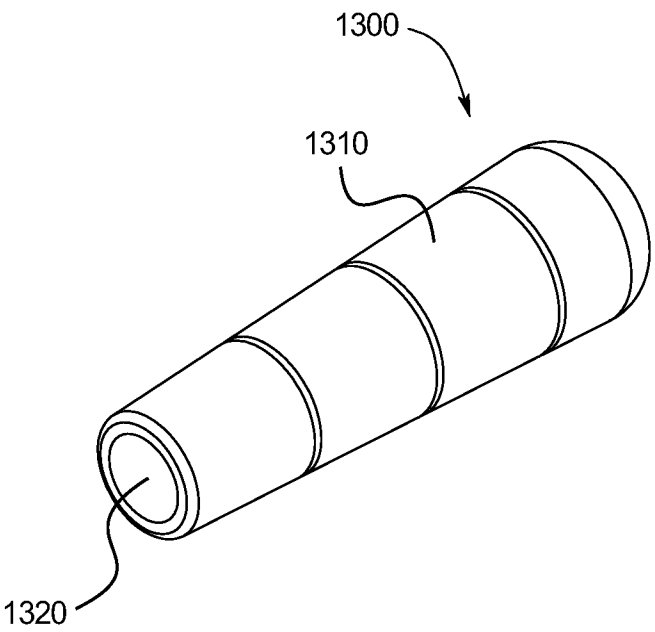

As illustrated in FIG. 15, the handle 1300 includes a tapered, annular body defined by an outer surface 1310 and an inner surface 1320. The inner surface 1320 defines a fastener receiving channel through the handle 1300.

Figure 16:
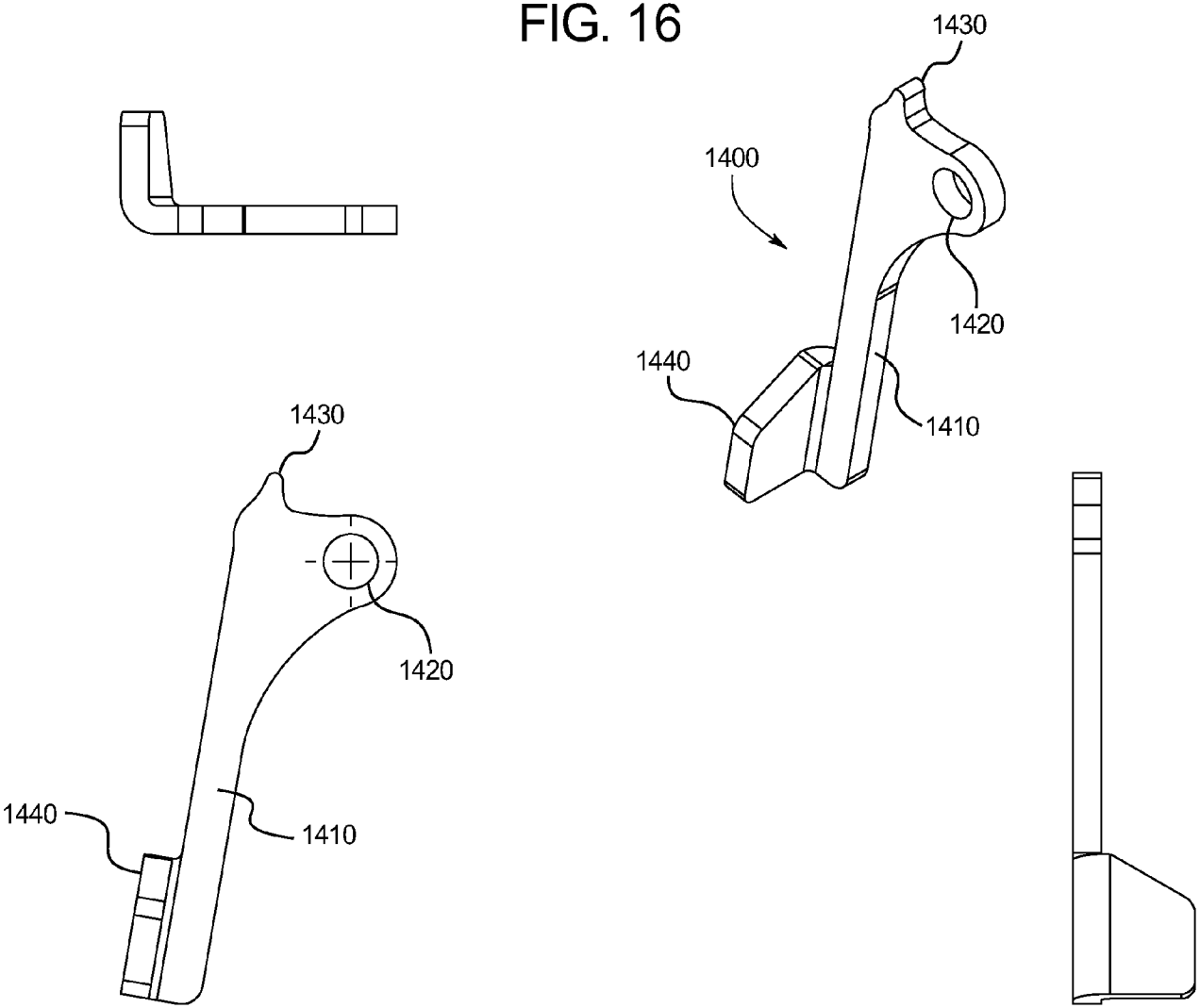
FIG. 16 includes a perspective view, top plan view, a side elevational view, and a front elevational view of the lock lever of the winch of FIG. 1A.

As illustrated in FIG. 16, the lock lever 1400 includes a body 1410, defines a lock lever mounting opening 1420 therethrough, includes a locking tooth 1430 proximate the lock lever mounting opening 1420, and includes a release tab 1440 extending transversely from the body 1410.

In this example embodiment: (a) the frame 100 is made of sheet metal, (b) the center shaft 200 is made of hardened steel, (c) the center sleeve 300 is made of steel, (d) the driven gear 400 is made of stamped steel, (e) the front plate 500 is made of stamped steel, (f) the partition 600 is made of stamped steel, (g) the rear adjustment plate 700 is made of steel, (h) the front adjustment plate 1700 is made of steel, (h) the front and rear compression springs 800 and 1800 are made of spring steel, (i) the adjustment pins 900 are made of steel, (j) the drive gear 1000 is made of steel, (k) the drive shaft 1100 is made of hardened steel, (l) the crank arm 1200 is made of stamped steel, (m) the handle 1300 is made of plastic, and (n) the lock lever 1400 is made of stamped steel.

It should be appreciated, however, that such components may be made of any suitable materials, such as (but not limited to) stainless steel, aluminum, brass, copper, bronze, tin, nickel, titanium, and rubber.

It should be also be appreciated that the above-described components of the winch may be made in different shapes or sizes to accommodate various different uses and different desired initial mechanical advantages.

Winch Assembly

To assemble the winch 10, the driven gear 400, the rear adjustment plate 700, the rear compression spring 800, the partition 600, the front compression spring 1800, the front adjustment plate 1700, and the front plate 500 are first mounted to the center sleeve 300.

More specifically, the left end of the center sleeve 300 including the driven gear mounting surface 320 is slid through the center sleeve receiving opening 424 of the driven gear 400 until the front surface 410*a* of the driven gear 400 abuts the drive gear constraining surface 315 of the center sleeve 300. The driven gear 400 is then fixedly attached to the center sleeve 300 (using any suitable fasteners) such that the driven gear 400 may not rotate or slide relative to the center sleeve 300.

The rear adjustment plate 700 is slid over the center sleeve 300 via the center sleeve receiving channel and manipulated (e.g., rotated and or slid relative to the center shaft 300) until: (a) the locking tabs 750*a* and 750*b* of the rear adjustment plate 700 are received by two of the locking tab receiving openings 450*a*, 450*b*, 450*c*, and 450*d* of the driven gear 400; and (b) the back surface of the rear adjustment plate 700 abuts the front surface 410*a* of the driven gear 400.

The rear compression spring 800 is slid over the center sleeve 300 and the mounting sleeve 720 of the rear adjustment plate 700 until one end of the rear compression spring 800 abuts the front surface 710*a* of the rear adjustment plate 700.

The partition 600 is slid, back surface first, over the center sleeve 300 via the center sleeve receiving opening 624 until the back surface of the partition 600 abuts the other end of the rear compression spring 800. The partition 600 is then manipulated (e.g., rotated or slid relative to the center sleeve 300) and fixedly attached to the center sleeve 300 substantially at a point along the center of the length of the center sleeve 300 such that: (a) the adjustment slot 640*a* of the partition 600 aligns with the adjustment slot 440*a* of the driven gear 400, (b) the adjustment slot 640*b* of the partition 600 aligns with the adjustment slot 440*b* of the driven gear 400, (c) the adjustment slot 640*c* of the partition 600 aligns with the adjustment slot 440*c* of the driven gear 400, (d) the adjustment slot 640*d* of the partition 600 aligns with the adjustment slot 440*d* of the driven gear 400, and (e) the partition 600 does not rotate or slide relative to the center sleeve 300. It should be appreciated that, after the partition 600 is fixedly attached to the center sleeve 300, the rear compression spring 800 is slightly compressed between the partition 600 and the rear adjustment plate 700 such that the rear compression spring 800 forces the rear adjustment plate 700 to maintain contact with the driven gear 400.

The front compression spring 1800 is slid over the center sleeve 300 until one end of the front compression spring 1800 abuts the front surface 610*a* of the partition 600.

The front adjustment plate 1700 is slid, front surface 1710*a* first, over the center sleeve 300 via the center sleeve receiving channel until the front surface 1710*a* of the front adjustment plate 1700 abuts the other end of the front compression spring 1800. It should be appreciated that the mounting sleeve 1720 of the front adjustment plate 1700 is disposed between the center sleeve 300 and the front compression spring 1800. The front adjustment plate 1700 is manipulated (e.g., rotated and/or slid relative to the center sleeve 300) such that: (a) the adjustment slot 1700*a* of the front adjustment plate 1700 aligns with the adjustment slot 700*a* of the rear adjustment plate 700; (b) the adjustment slot 1700*b* of the front adjustment plate 1700 aligns with the adjustment slot 700*b* of the rear adjustment plate 700; (c) the adjustment slot 1700*c* of the front adjustment plate 1700 aligns with the adjustment slot 700*c* of the rear adjustment plate 700; and (d) the adjustment slot 1700*d* of the front adjustment plate 1700 aligns with the adjustment slot 700*d* of the rear adjustment plate 700.

The front plate 500 is slid, back side first, over the center sleeve 300 via the center sleeve receiving opening 524 and manipulated (e.g., rotated and/or slid relative to the center sleeve 300) until: (a) the adjustment slot 540*a* of the front plate 500 aligns with the adjustment slot 640*a* of the partition 600 and the adjustment slot 440*a* of the driven gear 400; (b) the adjustment slot 540*b* of the front plate 500 aligns with the adjustment slot 640*b* of the partition 600 and the adjustment slot 440*b* of the driven gear 400; (c) the adjustment slot 540*c* of the front plate 500 aligns with the adjustment slot 640*c* of the partition 600 and the adjustment slot 440*c* of the driven gear 400; (d) the adjustment slot 540*d* of the front plate 500 aligns with the adjustment slot 640*d* of the partition 600 and the adjustment slot 440*d* of the driven gear 400; (e) the locking tabs 1750*a* and 1750*b* of the front adjustment plate 1700 are received by two of the locking tab receiving openings 550*a*, 550*b*, 550*c*, and 550*d* of the front plate 500; (f) the back surface of the front plate 500 abuts the back surface of the front adjustment plate 1700; and (g) the back surface of the front plate 500 abuts the front plate constraining surface 325 of the center sleeve 300. The front plate 500 is then fixedly attached to the center sleeve 300 such that the front plate 500 does not rotate or slide relative to the center sleeve 300. It should be appreciated that, after the front plate 500 is fixedly attached to the center sleeve 300, the front compression spring 1800 is slightly compressed between the partition 600 and the front adjustment plate 1700 such that the front compression spring 1800 forces the front adjustment plate 1700 to maintain contact with the front plate 500.

After the above components are mounted to the center sleeve 300: (a) at least a portion of each of a first set of corresponding adjustment slots 440*a*, 540*a*, 640*a*, 740*a*, and 1740*a* align with one another (such as at their respective inner pin holding areas or their respective outer pin holding areas), (b) at least a portion of each of a second set of corresponding adjustment slots 440*b*, 540*b*, 640*b*, 740*b*, and 1740*b* align with one another (such as at their respective inner pin holding areas or their respective outer pin holding areas), (c) at least a portion of each of a third set of corresponding adjustment slots 440*c*, 540*c*, 640*c*, 740*c*, and 1740*c* align with one another (such as at their respective inner pin holding areas or their respective outer pin holding areas); and (d) at least a portion of each of a fourth set of corresponding adjustment slots 440*d*, 540*d*. 640*d*, 740*d*, and 1740*d* align with one another (such as at their respective inner pin holding areas or their respective outer pin holding areas).

The radial distance from the center of the center sleeve 300 at which the portions of the respective sets of adjustment slots align (e.g., whether they align at their respective inner pin holding areas located at the radial distance R1 from the center of the center sleeve 300 or their respective outer pin holding areas located at the radial distance R2 from the center of the center sleeve 300) depends on the rotational orientation of the rear and front adjustment plates 700 and 1700 with respect to the driven gear 400, the partition 600, and the front plate 500. The rotational orientation of the rear and front adjustment plates 700 and 1700 with respect to the driven gear 400, the partition 600, and the front plate 500 depends on which locking tab receiving openings 450 and 550 of the driven reel 400 and the front plate 500, respectively, receive the locking tabs 750 and 1750 of the rear and front adjustment plates 700 and 1700, respectively.

More specifically, in this example embodiment, if the rear and front adjustment plates 700 and 1700 have a first rotational orientation with respect to the driven gear 400, the partition 600, and the front plate 500 (e.g., the locking tab 750*a* is received in the locking tab receiving opening 450*a*, the locking tab 750*b* is received in the locking tab receiving opening 450*c*, the locking tab 1750*a* is received in the locking tab receiving opening 550*a*, and the locking tab 1750*b* is received in the locking tab receiving opening 550*c*), the respective sets of adjustment slots align at their respective inner pin holding areas (i.e., substantially at the radial distance R1 from the center of the center sleeve 300). If the rear and front adjustment plates 700 and 1700 have a second rotational orientation with respect to the driven gear 400, the partition 600, and the front plate 500 (e.g., the locking tab 750*a* is received in the locking tab receiving opening 450*b*, the locking tab 750*b* is received in the locking tab receiving opening 450*d*, the locking tab 1750*a* is received in the locking tab receiving opening 550*b*, and the locking tab 1750*b* is received in the locking tab receiving opening 550*d*), the respective sets of adjustment slots align at their respective outer pin holding areas (i.e., substantially at the radial distance R2 from the center of the center sleeve 300).

The adjustment pin 900*a* is inserted through the aligned portions of the adjustment slots 540*a*, 1740*a*, 640*a*, 740*a*, and 440*a* of the first set of adjustment slots (such that an axis along the length of the adjustment pin 900*a* is substantially parallel to an axis along the length of the center sleeve 300) until the inner surface of the head 920*a* of the adjustment pin 900*a* abuts the front surface 510*a* of the front plate 500, and is then fastened at the fastening end 930 (using any suitable fasteners) such that the adjustment pin 900*a* does not substantially slide relative to the front plate 500, the front adjustment plate 1700, the partition 600, the rear adjustment plate 700, and the driven gear 400. This is repeated for adjustment pin 900*b* with respect to the adjustment slots 540*b*, 1740*b*, 640*b*, 740*b*, and 440*b* of the second set of adjustment slots; adjustment pin 900*c* with respect to the adjustment slots 540*c*, 1740*c*, 640*c*, 740*c*, and 440*c* of the third set of adjustment slots; and adjustment pin 900*d* with respect to the adjustment slots 540*d*, 1740*d*, 640*d*, 740*d*, and 440*d* of the fourth set of adjustment slots. Once installed, the axes along the lengths of the adjustment pins 900 are substantially parallel to one another and to the axis along the length of the center sleeve 300.

It should be appreciated that, after the above components are mounted to the center sleeve 300: (a) the driven gear 400, the partition 600, and the front plate 500 may not rotate or slide relative to the center sleeve 300; (b) the front adjustment plate 1700 is configured to slide relative to the center sleeve 300 toward and away from the partition 600, subject to the constraints of the front compression spring 1800; (c) the front adjustment plate 1700 is configured to rotate relative to the center sleeve 300 when slid toward the partition 600 such that the locking tabs 1750 are no longer received in the locking tab receiving openings 550 of the front plate 500, subject to the constraints of the adjustment pins 900; (d) the rear adjustment plate 700 is configured to slide relative to the center sleeve 300 toward and away from the partition 600, subject to the constraints of the rear compression spring 800; and (e) the rear adjustment plate 700 is configured to rotate relative to the center sleeve 300 when slid toward the partition 600 such that the locking tabs 750 are no longer received in the locking tab receiving openings 450 of the driven gear 400, subject to the constraints of the adjustment pins 900.

It should also be appreciated that the orientations of the adjustment slots 440, 540, 640, 740, and 1740 relative to one another cause the four adjustment pins 900 to be positioned at substantially the same radial distance from the center of the center sleeve 300. As described in detail below, a user may adjust the radial distance of the adjustment pins 900 from the center of the center sleeve 300 (e.g., whether the adjustment pins 900 are held at the inner pin holding areas of the adjustment slots or the outer pin holding areas of the adjustment slots) by rotating the front and rear adjustment plates 700 and 1700 relative to the center sleeve 300.

In this example embodiment, the four alignment pins represent the drum around which a plurality of flexible members (such as straps, ropes, chains, cords, cables, webbing, and the like) wrap (or from which the flexible members unwrap) when the crank arm is turned. Here, the furthest distance between the outer surfaces of two opposing adjustment pins (e.g., adjustment pins 900*a* and 900*c* or adjustment pins 900*b* and 900*d*) represents the outer drum diameter of the winch 10.

The center sleeve 300 is then positioned between the center shaft receiving openings 124 and 134 of the frame 100, and the center shaft 200 is inserted through the center shaft receiving opening 124, through the center shaft receiving channel of the center sleeve 300, and through the center shaft receiving opening 134. The center shaft is then fixedly mounted to the frame 100 (using any suitable fasteners) such that the center shaft does not rotate or slide relative to the frame 100.

The drive gear 1000 is positioned such that the teeth 1001 of the drive gear 1000 mesh with the teeth 401 of the driven gear 400. The drive shaft 1100 is then inserted through the drive shaft receiving opening 124, through the drive shaft receiving opening 1024 of the drive gear 1000, and through the drive shaft receiving opening 134 of the frame 100. The drive gear 1000 is fixedly mounted to the drive shaft 1100 such that the drive gear 1000 does not rotate or slide relative to the drive shaft 1100. The drive shaft 1100 is rotatably mounted to the frame 100 such that the drive shaft may rotate relative to the frame 100.

The crank arm 1200 is attached to the drive shaft 1100 via the drive shaft receiving opening 1232 and any suitable fasteners. The handle 1300 is attached to the crank arm 1200 via then handle fastener receiving opening 1212 and any suitable fasteners.

The lock lever 1400 is rotatably mounted to the lock lever mounting opening 138 of the frame 100 such that the lock lever may rotate relative to the frame 100. The lock lever 1400 is mounted such that the locking tooth 1430 is biased against and meshes with the teeth 1001 of the drive gear 1000. The configuration of the lock lever 1400 prevents the drive gear 1000 from rotating in a certain direction (counterclockwise, in this example embodiment) unless the release tab 1440 is used to disengage the locking tooth 1430 from the teeth 1001 of the drive gear 1000.

After assembly, the winch is attached to a suitable surface (such as a wall stud) using any suitable fasteners via the a first set of frame mounting openings 112*a*, 112*b*, 112*c*, and 112*d* and/or the second set of frame mounting openings 136*a*, 136*b*, 136*c*, and 136*d* of the frame 100.

In this example embodiment, though not shown, two flexible members, such as straps, are configured to be attached to one of the adjustment pins (at different locations along the length of the adjustment pin). More specifically, a first strap is configured to be attached to one of the adjustment pins between a portion of the adjustment pin located between the partition and the rear adjustment plate, and a second strap is configured to be attached to a portion of the adjustment pin located between the partition and the front adjustment plate. Here, the partition separates the two straps. Thus, in this example embodiment, when the crank arm is turned to wind up the straps, the first strap winds around the portions of the adjustment pins located between the partition and the rear adjustment plate, and the second strap winds around the portions of the adjustment pins located between the partition and the front adjustment plate. The partition thus prevents the straps from interfering with one another during operation of the winch.

In other embodiments, the winch is employed with a single flexible member. In one such embodiment, the winch does not employ a partition. In further embodiments, the winch is employed with more than two flexible members. For instance, in one example embodiment, the winch is employed with three flexible members, and includes two partitions between the rear adjustment plate and the front adjustment plate to separate the flexible members.

In the above example embodiment, the driven gear, the rear adjustment plate, the partition, the front adjustment plate, and the front plate each include four adjustment slots and, therefore, the winch employs four adjustment pins. It should be appreciated that, in other embodiments, the driven gear, the rear adjustment plate, the partition, the front adjustment plate, and the front plate include more than (such as six, eight, or any suitable quantity) or fewer than (such as two, three, or any suitable quantity) four adjustment slots such that the winch employs more or fewer adjustment pins.

In the above example embodiment, the winch is a manual winch. It should be appreciated that the present disclosure contemplates employing the winch of the present disclosure as an electric winch, a gas-powered winch, or any other suitable type of winch.

Adjusting the Initial Mechanical Advantage of the Winch

As noted above, the radial distance from the center of the center sleeve 300 at which the portions of the respective sets of adjustment slots align and, therefore, the radial distance from the center of the center sleeve 300 at which the adjustment pins 900 inserted through those adjustment slots are positioned, depends on the rotational orientation of the rear and front adjustment plates 700 and 1700 with respect to the driven gear 400, the partition 600, and the front plate 500. Since the furthest distance between the outer surfaces of two opposing adjustment pins represents the outer diameter of the drum of the winch 10, which in part determines the initial mechanical advantage provided by the winch 10, the rotational orientation of the rear and front adjustment plates 700 and 1700 with respect to the driven gear 400, the partition 600, and the front plate 500 in part determines the initial mechanical advantage provided by the winch 10.

As noted above, when the rear and front adjustment plates 700 and 1700 have the first rotational orientation with respect to the driven gear 400, the partition 600, and the front plate 500 (e.g., the locking tab 750*a* is received in the locking tab receiving opening 450*a*, the locking tab 750*b* is received in the locking tab receiving opening 450*c*, the locking tab 1750*a* is received in the locking tab receiving opening 550*a*, and the locking tab 1750*b* is received in the locking tab receiving opening 550*c*), the aligned portions of the respective sets of adjustment slots and, therefore, the adjustment pins 900, are located at the inner pin holding areas located substantially at the radial distance R1 from the center of the center sleeve 300. This first rotational orientation results in the smallest outer drum diameter of the winch 10 and, therefore, results in the winch 10 providing the maximum initial mechanical advantage. FIGS. 1A to 1J illustrate the rear and front adjustment plates 700 and 1700 having the first rotational orientation with respect to the driven gear 400, the partition 600, and the front plate 500 such that the adjustment pins 900 are located at the inner pin holding areas located substantially the radial distance R1 from the center of the center sleeve 300.

When the rear and front adjustment plates 700 and 1700 have the second rotational orientation with respect to the driven gear 400, the partition 600, and the front plate 500 (e.g., the locking tab 750*a* is received in the locking tab receiving opening 450*b*, the locking tab 750*b* is received in the locking tab receiving opening 450*d*, the locking tab 1750*a* is received in the locking tab receiving opening 550*b*, and the locking tab 1750*b* is received in the locking tab receiving opening 550*d*), the aligned portions of the respective sets of adjustment slots and, therefore, the adjustment pins 900, are located at the outer pin holding areas located substantially the radial distance R2 from the center of the center sleeve 300. This second rotational orientation results in the largest outer drum diameter of the winch 10 and, therefore, results in the winch 10 providing the minimum initial mechanical advantage.

To adjust the initial mechanical advantage of the winch 10, the user must, therefore, adjust the rotational orientation of the rear and front adjustment plates 700 and 1700 with respect to the driven gear 400, the partition 600, and the front plate 500.

Figure 1K:
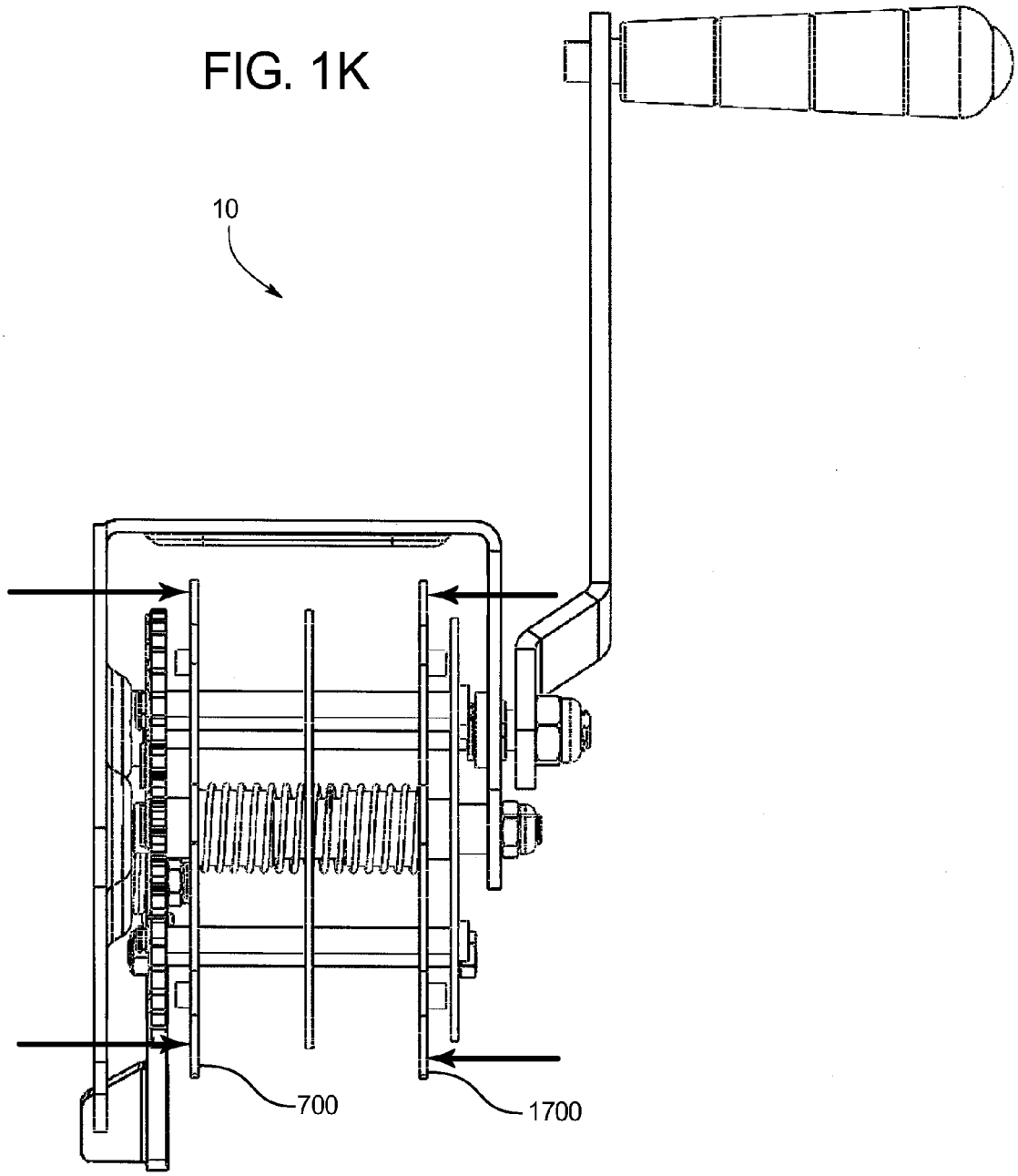
FIG. 1K is a top plan view of the winch of FIG. 1A in which: (a) the adjustment pins are located at the outer pin holding areas located substantially at the radial distance R2 from the center of the center sleeve; and (b) the first and second adjustment plates are pushed toward one another such that: (i) the rear compression spring is further compressed between the rear adjustment plate and the partition, (ii) the front compression spring is further compressed between the front adjustment plate and the partition, and (iii) the locking tabs are no longer received in the locking tab receiving openings.

For example, to adjust the initial mechanical advantage of the winch 10 from the minimum initial mechanical advantage (i.e., the adjustment pins 900 located substantially at the radial distance R2 from the center of the center sleeve 300) at to the maximum initial mechanical advantage (i.e., the adjustment pins 900 located substantially at the radial distance R1 from the center of the center sleeve 300), the user pushes the first and second adjustment plates 700 and 1700 toward one another, further compressing the rear compression spring 800 between the rear adjustment plate 700 and the partition 600 and the front compression spring 1800 between the front adjustment plate 1700 and the partition 600, until the locking tabs 750 are no longer received in the locking tab receiving openings 450 and the locking tabs 1750 are no longer received in the locking tab receiving openings 550. FIG. 1K illustrates the winch 10 having: (a) the adjustment pins 900 located at the outer pin holding areas located substantially at the radial distance R2 from the center of the center sleeve 300; and (b) the first and second adjustment plates 700 and 1700 pushed toward one another such that: (i) the rear compression spring 800 is further compressed between the rear adjustment plate 700 and the partition 600, (ii) the front compression spring 1800 is further compressed between the front adjustment plate 1700 and the partition 600, and (iii) the locking tabs 1750 are no longer received in the locking tab receiving openings 550.

Figure 1L:
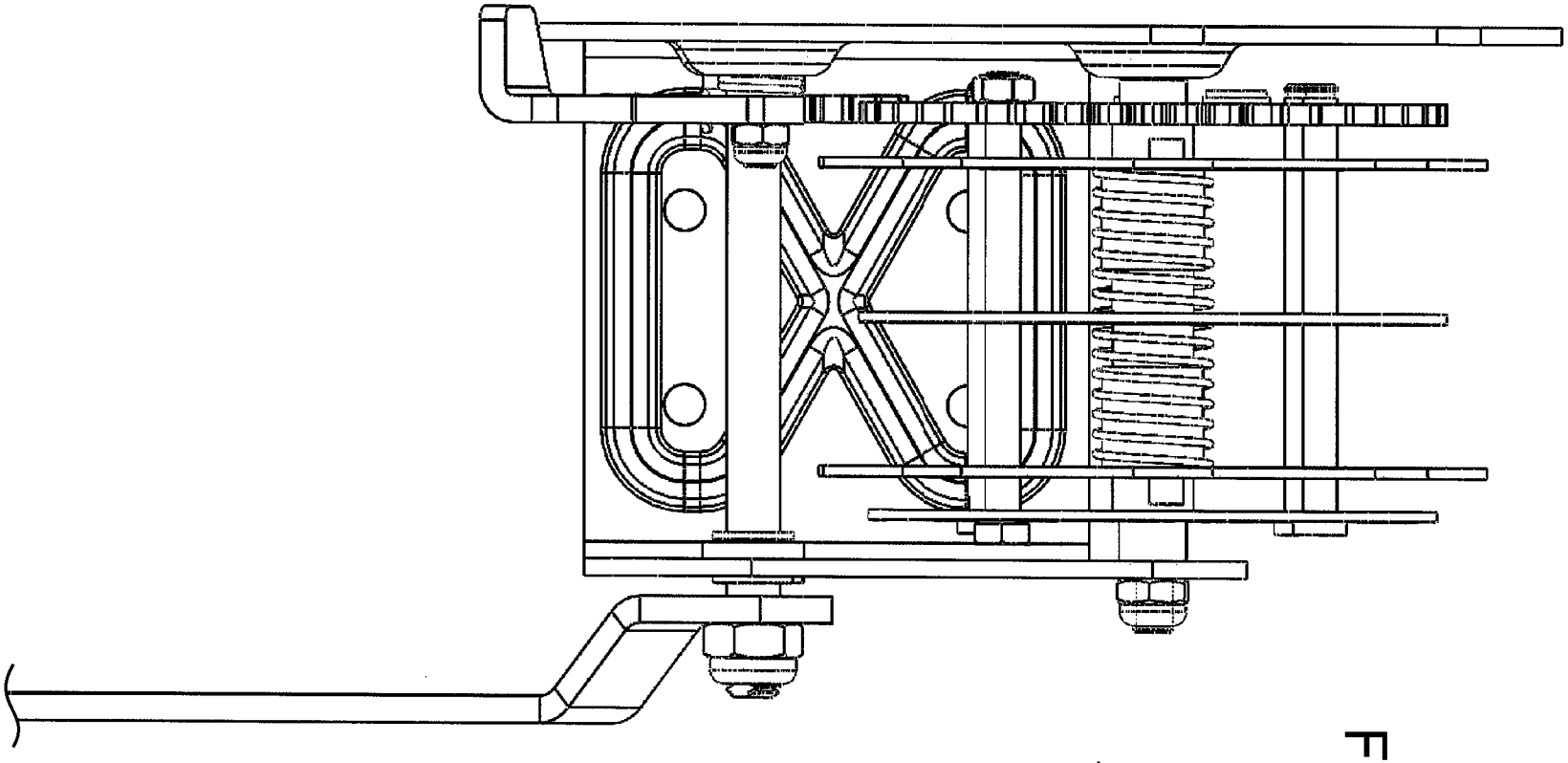
FIG. 1L is an elevational view of the front of the winch of FIG. 1K.
Figure 1M:
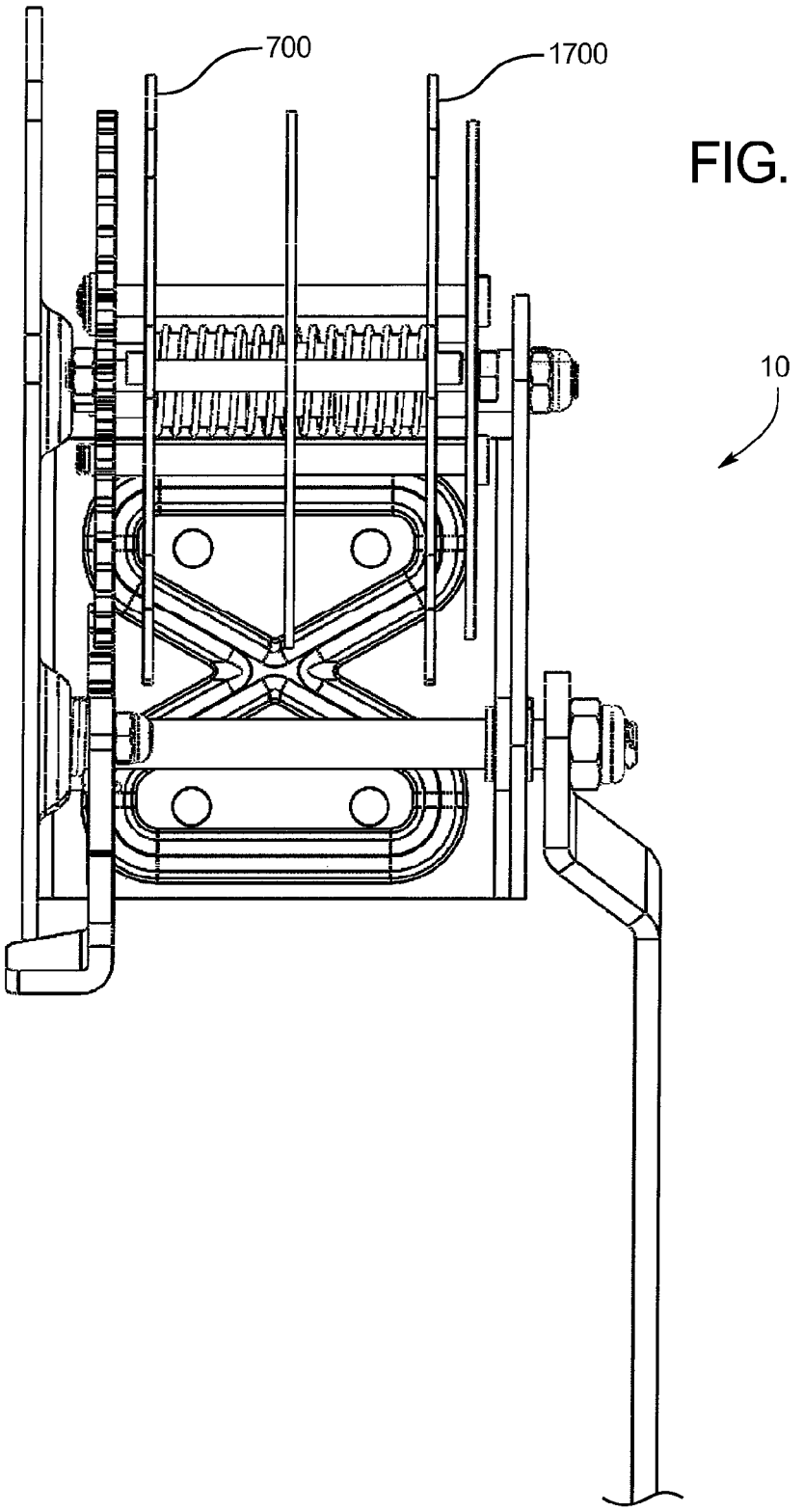
FIG. 1M is an elevational view of the front of the winch of FIG. 1K after the adjustment plates are rotated such that the adjustment pins are located at the inner pin holding areas located substantially at the radial distance R1 from the center of the center sleeve.
Figure 1N:
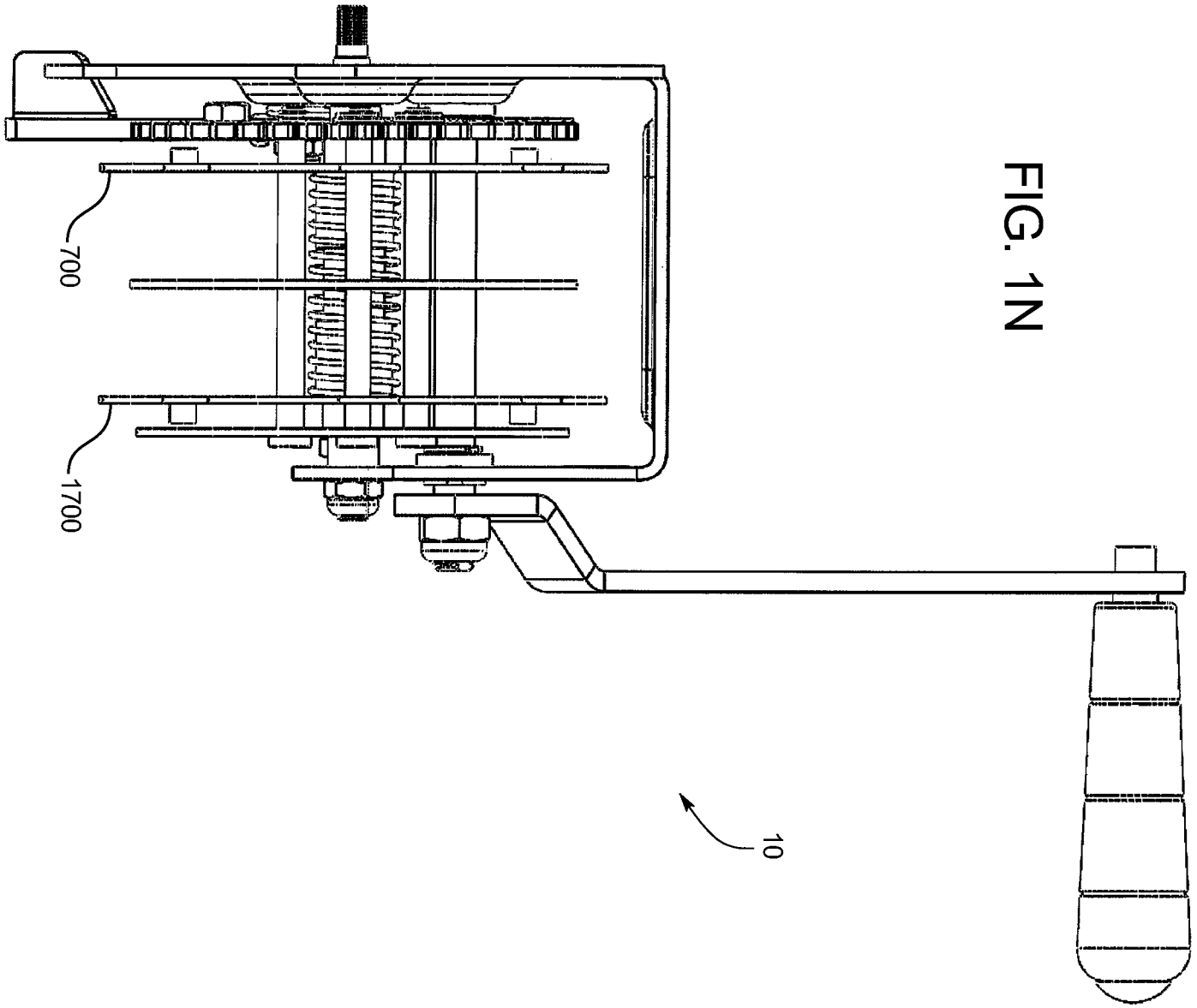
FIG. 1N is a top plan view of the winch of FIG. 1M.

At this point, the user may rotate the rear and front adjustment plates 700 and 1700 with respect to the driven gear 400, the partition 600, and the front plate 500. The user rotates the rear and front adjustment plates 700 and 1700 clockwise (as viewed from the front surface of the rear adjustment plate 700 and the back surface of the front adjustment plate 1700) until they are in the second rotational orientation with respect to the driven gear 400, the partition 600, and the front plate 500. This rotation causes the adjustment pins 900 to move through the pin movement areas of the adjustment sleeves radially inward until they are located at the inner pin holding areas located substantially at the radial distance R1 from the center of the center sleeve 300. FIG. 1L a front elevational view of the winch 10 before the rotation of the rear and front adjustment plates 700 and 1700 and FIG. 1M illustrates a front elevational view of the winch 10 after the rotation of the rear and front adjustment plates 700 and 1700. FIG. 1N illustrates a top plan view of the winch 10 after the rotation of the rear and front adjustment plates 700 and 1700. The user then releases the rear and front adjustment plates 700 and 1700. Releasing the rear and front adjustment plates 700 and 1700 allows the rear and front compression springs 800 and 1800 to revert to their prior, semi-compressed states, thereby forcing the back surface of the rear adjustment plate 700 into contact with the front surface of the driven gear 400 (and the locking tabs 750*a* and 750*b* into the locking tab receiving openings 450*b* and 450*d*, respectively) and forcing the back surface of the front adjustment plate 1700 into contact with the back surface of the front plate 500 (and the locking tabs 1750*a* and 1750*b* into the locking tab receiving openings 550*b* and 550*d*, respectively).

Conversely, to adjust the initial mechanical advantage of the winch 10 from the maximum initial mechanical advantage to the minimum initial mechanical advantage, the user pushes the first and second adjustment plates 700 and 1700 toward one another, further compressing the rear compression spring 800 between the rear adjustment plate 700 and the partition 600 and the front compression spring 1800 between the front adjustment plate 1700 and the partition 600, until the locking tabs 750 are no longer received in the locking tab receiving openings 450 and the locking tabs 1750 are no longer received in the locking tab receiving openings 550.

At this point, the user may rotate the rear and front adjustment plates 700 and 1700 with respect to the driven gear 400, the partition 600, and the front plate 500. The user rotates the rear and front adjustment plates 700 and 1700 counter-clockwise (as viewed from the front surface of the rear adjustment plate 700 and the back surface of the front adjustment plate 1700) until they are in the first rotational orientation with respect to the driven gear 400, the partition 600, and the front plate 500. This rotation causes the adjustment pins 900 to move through the pin movement areas of the adjustment sleeves radially outward until they are located at the outer pin holding areas located substantially at the radial distance R2 from the center of the center sleeve 300. The user then releases the rear and front adjustment plates 700 and 1700. Releasing the rear and front adjustment plates 700 and 1700 allows the rear and front compression springs 800 and 1800 to revert to their prior, semi-compressed states, thereby forcing the back surface of the rear adjustment plate 700 into contact with the front surface of the driven gear 400 (and the locking tabs 750*a* and 750*b* into the locking tab receiving openings 450*a* and 450*c*, respectively) and forcing the back surface of the front adjustment plate 1700 into contact with the back surface of the front plate 500 (and the locking tabs 1750*a* and 1750*b* into the locking tab receiving openings 550*a* and 550*c*, respectively).

It should be appreciated that the additional locking tab mounting openings may be employed such that the adjustment pins may be held at an area of the adjustment slots between the inner pin holding areas and the outer pin holding areas. In this example embodiment, the outer pin holding areas themselves may receive the locking tabs, resulting in the adjustment pins being held near the centers of the pin movement areas between the inner pin holding areas and the outer pin holding areas. This enables the user to set the initial mechanical advantage of the winch about halfway between the minimum and the maximum initial mechanical advantage. In other words, the rear and front adjustment plates and have a third rotational orientation with respect to the driven gear, the partition, and the front plate about halfway between the first and second rotational orientations described above.

It should be appreciated that the above is one example of a manner in which the outer diameter of the drum of the winch of the present disclosure may be adjusted or varied by a user, and that any other suitable manner or manners of adjusting or varying the outer diameter of the drum of the winch may be employed.

It should also be appreciated that the winch of the present disclosure may be employed in any of a variety of different manners or applications, such as for lifting, lowering, pulling, hauling, holding an object in place, and the like. For example, the winch may be installed on the deck of a ship to facilitate pulling up an anchor, raising or lowering a sail, or moving a mast. In another example, the winch may be installed on an automobile, such as a car or a truck, to facilitate pulling objects. In another example, the winch may be installed on an all-terrain vehicle, and can be used to pull the vehicle when getting stuck (such as in mud) while traveling through rugged terrain. In another example, the winch facilitates hauling a boat onto a trailer for towing. In another example, the winch may be used in industrial applications to haul heavy items in a warehouse or factory, lift items onto a scaffolding structure, or even raise and lower heavy doors or windows.

Object Lifting System Components

Figure 17A:
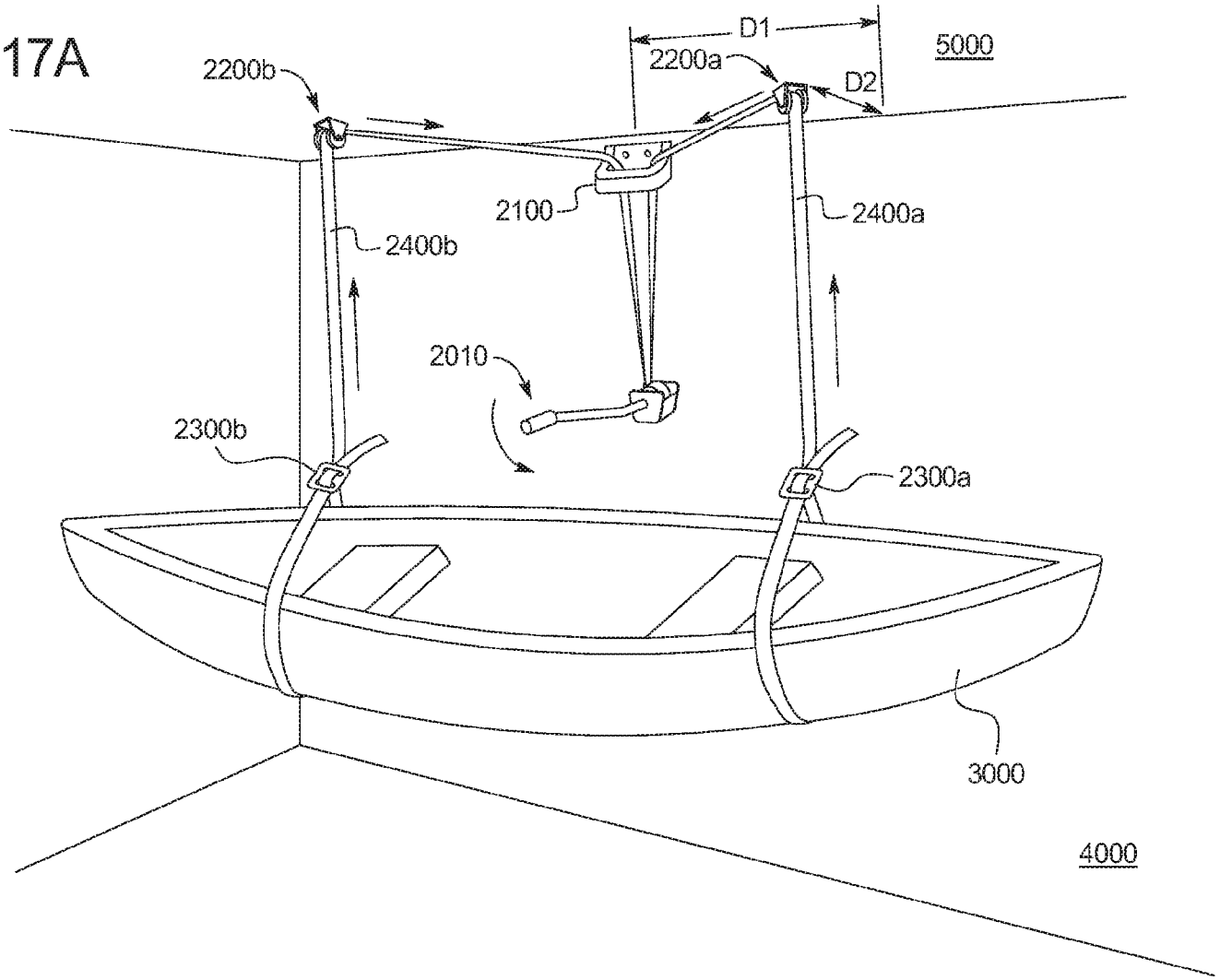
FIG. 17A is a top perspective view of an example embodiment of the object lifting system of the present disclosure.

FIG. 17A illustrates one example embodiment of the object lifting system of the present disclosure. FIGS. 18A to 20 illustrate various components of this example embodiment of the object lifting system. In this example embodiment, the object lifting system is employed with a plurality of flexible members in the form of straps, though it should be appreciated that the object lifting may employ any suitable flexible members instead of or in addition to straps, such as ropes, chains, cords, cables, and the like.

In this example embodiment, the object lifting system includes the following components: (a) a winch 2010, such as the winch having the user-adjustable or variable mechanical advantage of the present disclosure described above; (b) a strap receiver 2100; (c) a first pulley 2200*a* and a second pulley 2200*b*; (d) a first strap securer 2300*a* and a second strap securer 2300*b*; and (e) a first strap 2400*a* and a second strap 2400*b*.

Figure 18A:
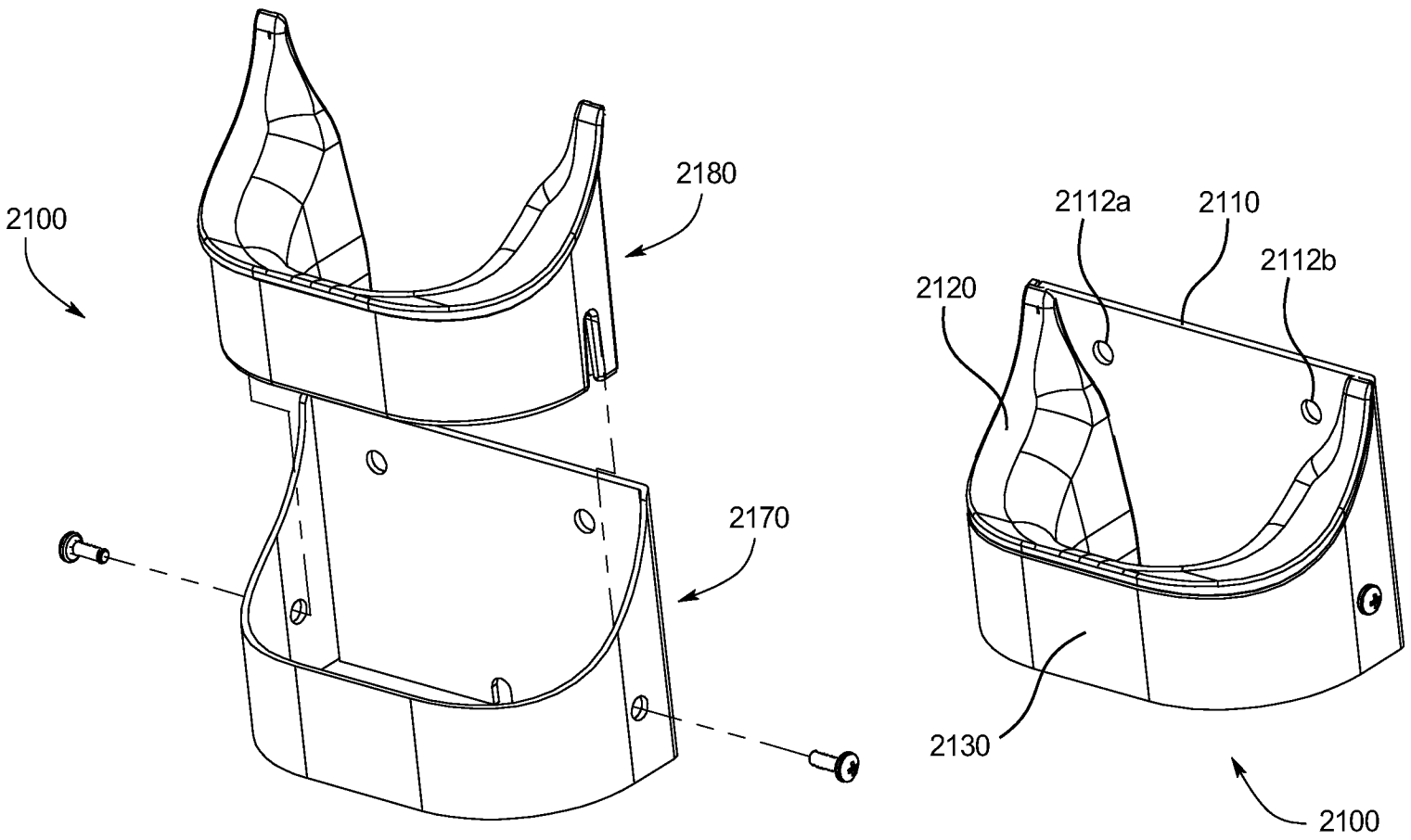
FIG. 18A includes an exploded top perspective view and an assembled top perspective view of the flexible member receiver of the object lifting system of FIG. 17A.
Figure 18B:
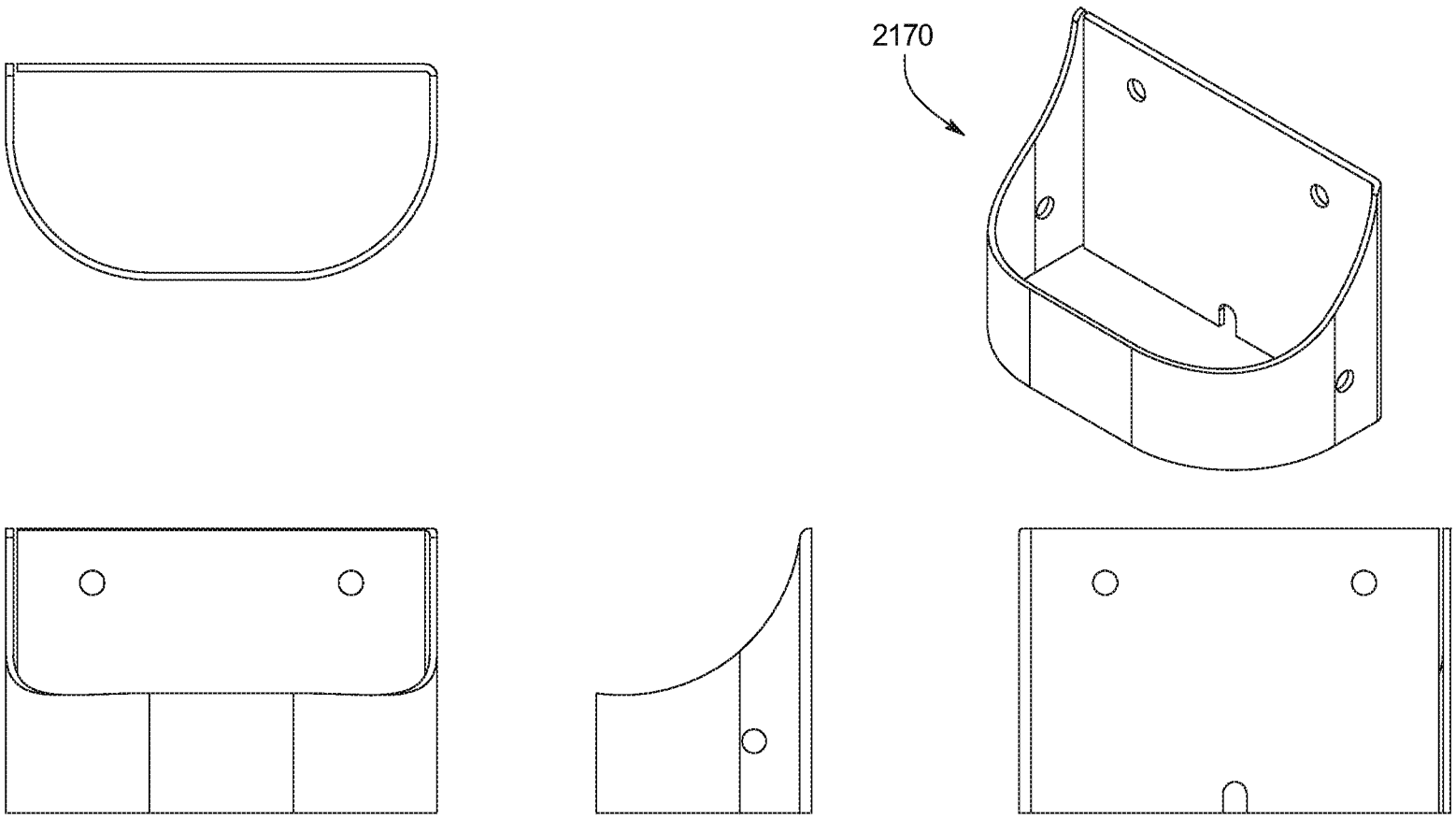
FIG. 18B includes a perspective view, a top plan view, a side elevational view, a front elevational view, and a back elevational view of an outer portion of the flexible member receiver of FIG. 18A.
Figure 18C:
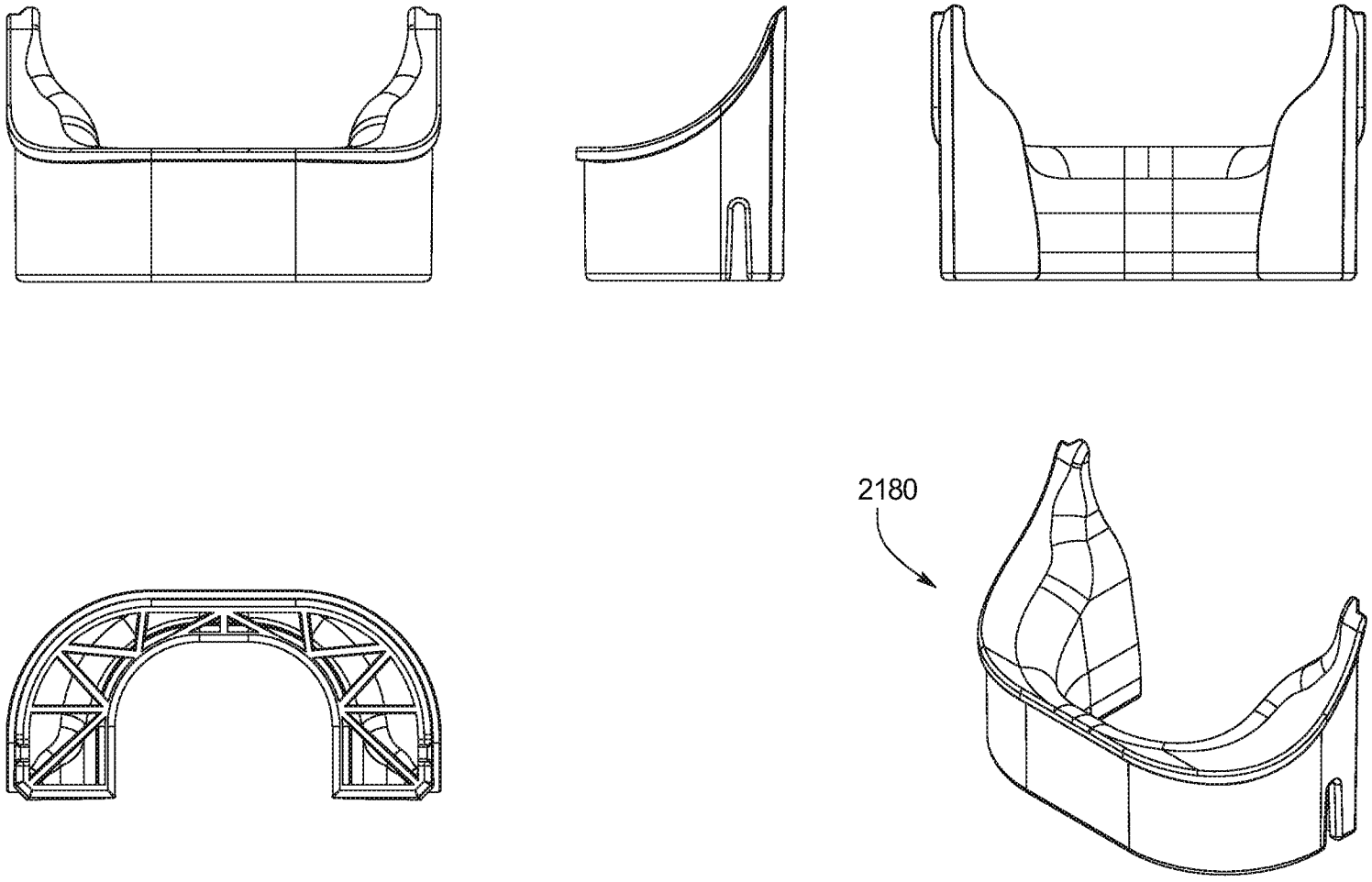
FIG. 18C includes a perspective view, a bottom plan view, a side elevational view, a front elevational view, and a back elevational view of an inner portion of the flexible member receiver of FIG. 18A.

As illustrated in FIGS. 18A, 18B, and 18C, the strap receiver 2100 is a two-piece assembly formed by securing an inner portion 2180 to an exterior shell 2170 via fasteners, such as screws. The strap receiver 2100 includes a back wall 2110, a curved or arcuate front wall 2130 extending transversely from and connecting two opposing edges of the back wall 2110, and a funnel-shaped sliding surface 2120 extending from a top edge of the front wall 2130 downward and inward toward the back wall 2110. The back wall 2110 and the sliding surface 2120 define a funnel-shaped strap receiving opening through the strap receiver 2100. It should be appreciated that the sliding surface 2120 is configured to accommodate straps moving through the strap receiving opening at a wide range of angles. The back wall 2110 defines a plurality of strap receiver mounting openings 2112*a* and 2112*b* therethrough, which are used to mount the strap receiver to a suitable surface. While in this embodiment the strap receiver includes two separate pieces attached via fasteners, in other embodiments the strap receiver is a single piece.

Figure 19A:
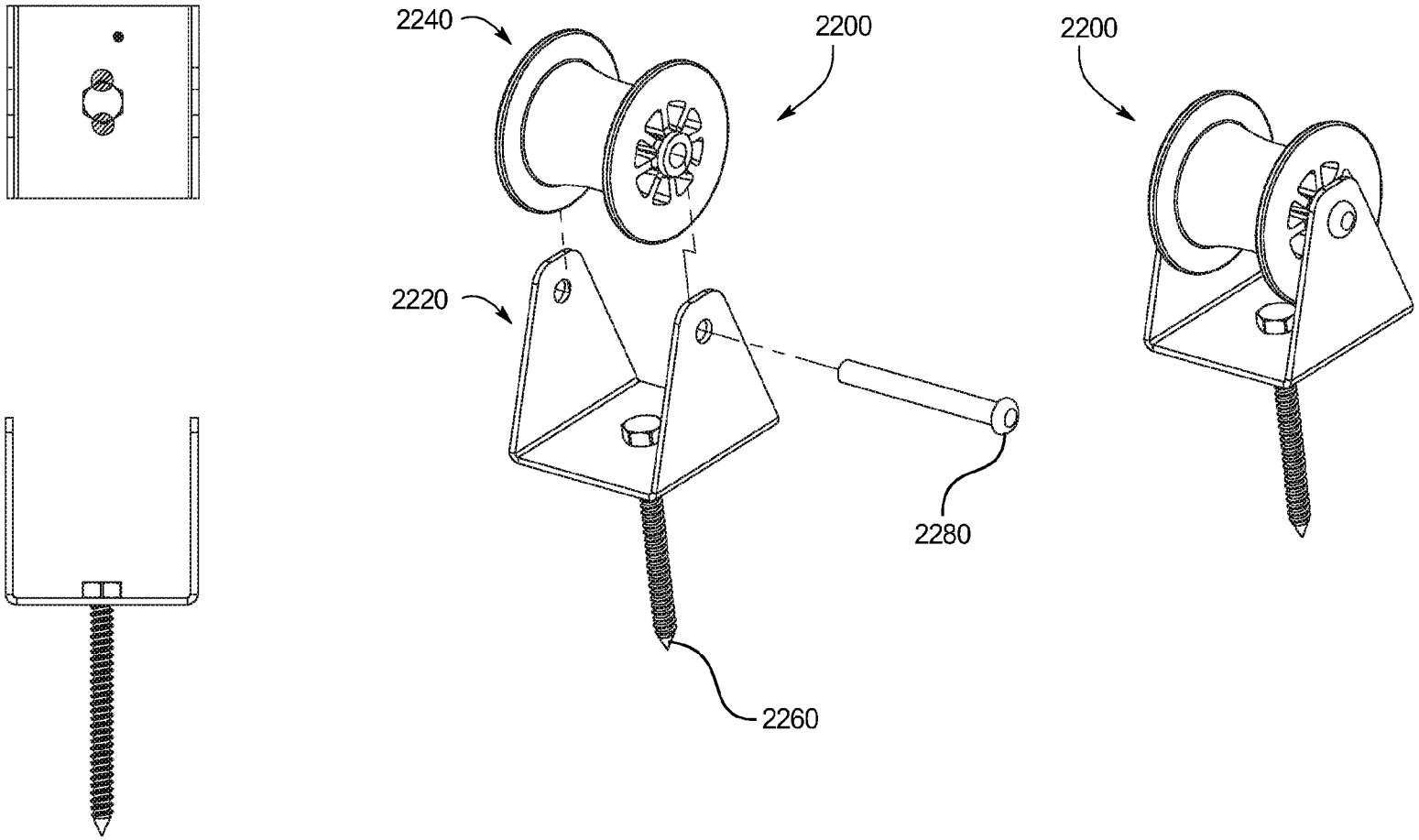
FIG. 19A includes an exploded top perspective view and an assembled top perspective view of the pulley of the object lifting system of FIG. 17A, and also includes a top plan view and a front elevational view of the frame and the fastener of the pulley.

As illustrated in FIG. 19A, the first and second pulleys 2200*a* and 2200*b* (referred to below as the pulley 2200 for brevity) include a frame 2220, a wheel 2240, a fastener 2260, and an axle 2280.

Figure 19B:
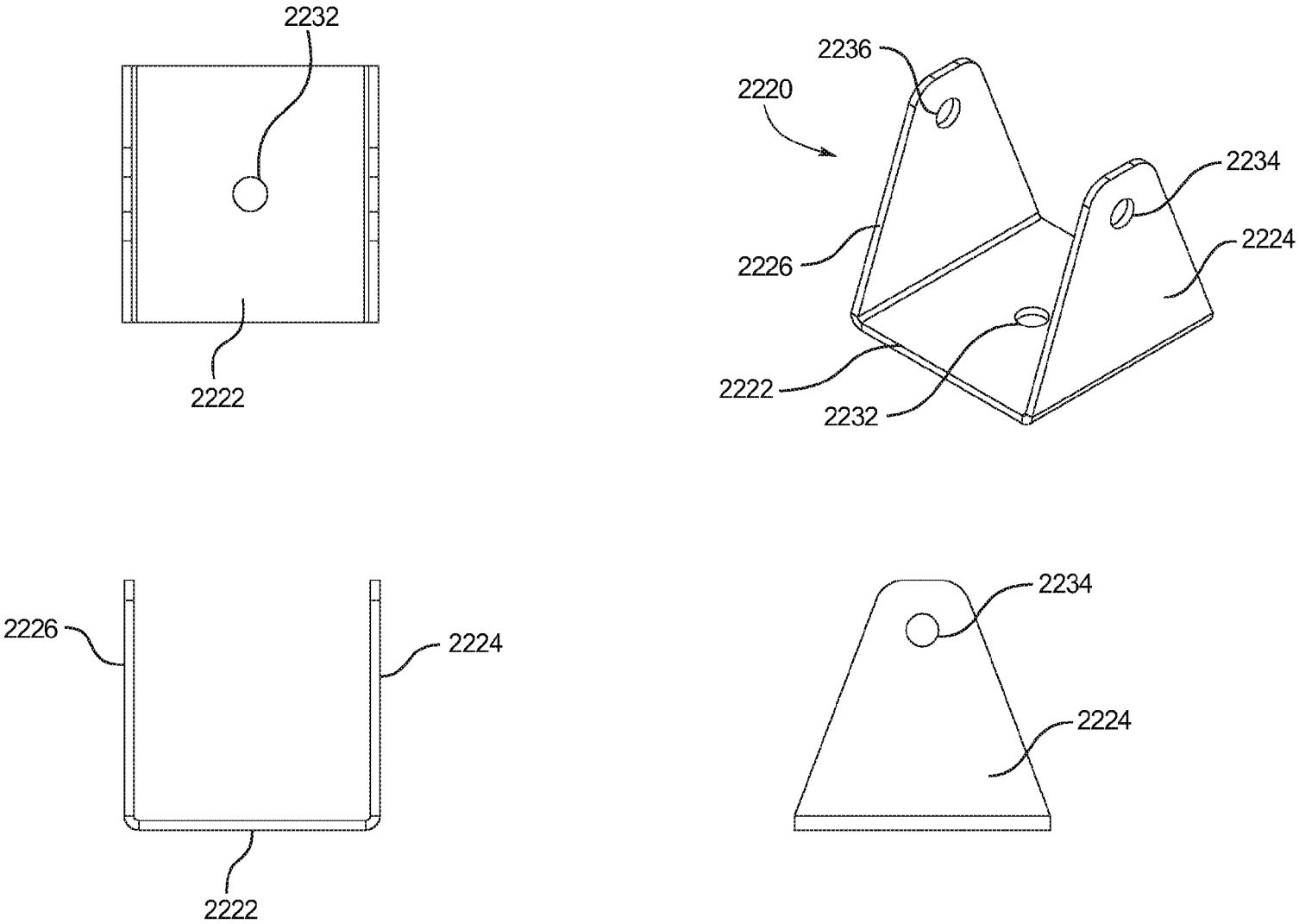
FIG. 19B includes a perspective view, a top plan view, a side elevational view, and a front elevational view of the frame of the pulley of FIG. 19A.

As illustrated in FIG. 19B, the frame 2220 includes a base 2222, a right side wall 2224 extending from the base 2222, and a left side wall 2226 extending from the base 2222. In this example embodiment, the right side wall 2224 and the left side wall 2226 are substantially identical, substantially parallel to one another, and substantially perpendicular to the base 2222. It should be appreciated that the base, the right side wall, and the left side wall maybe configured differently in other embodiments. The base 2222 defines a frame mounting opening 2232 therethrough at about the center of the base 2222, which is configured to receive the fastener 2260 to mount the frame 2220 (and the pulley 2200) to a suitable surface, such as a stud or a surface (such as drywall) mounted to the stud. The right side wall 2224 defines an axle receiving opening 2234 therethrough proximate an end of the right side wall 2224 opposite the base 2222. Similarly, the left side wall 2226 defines an axle receiving opening 2236 therethrough proximate an end of the left side wall 2226 opposite the base 2222. The axle receiving opening 2234 of the right side wall 2224 and the axle receiving opening 2236 of the left side wall 2226 are aligned, and are configured to receive the axle 2280.

Figure 19C:
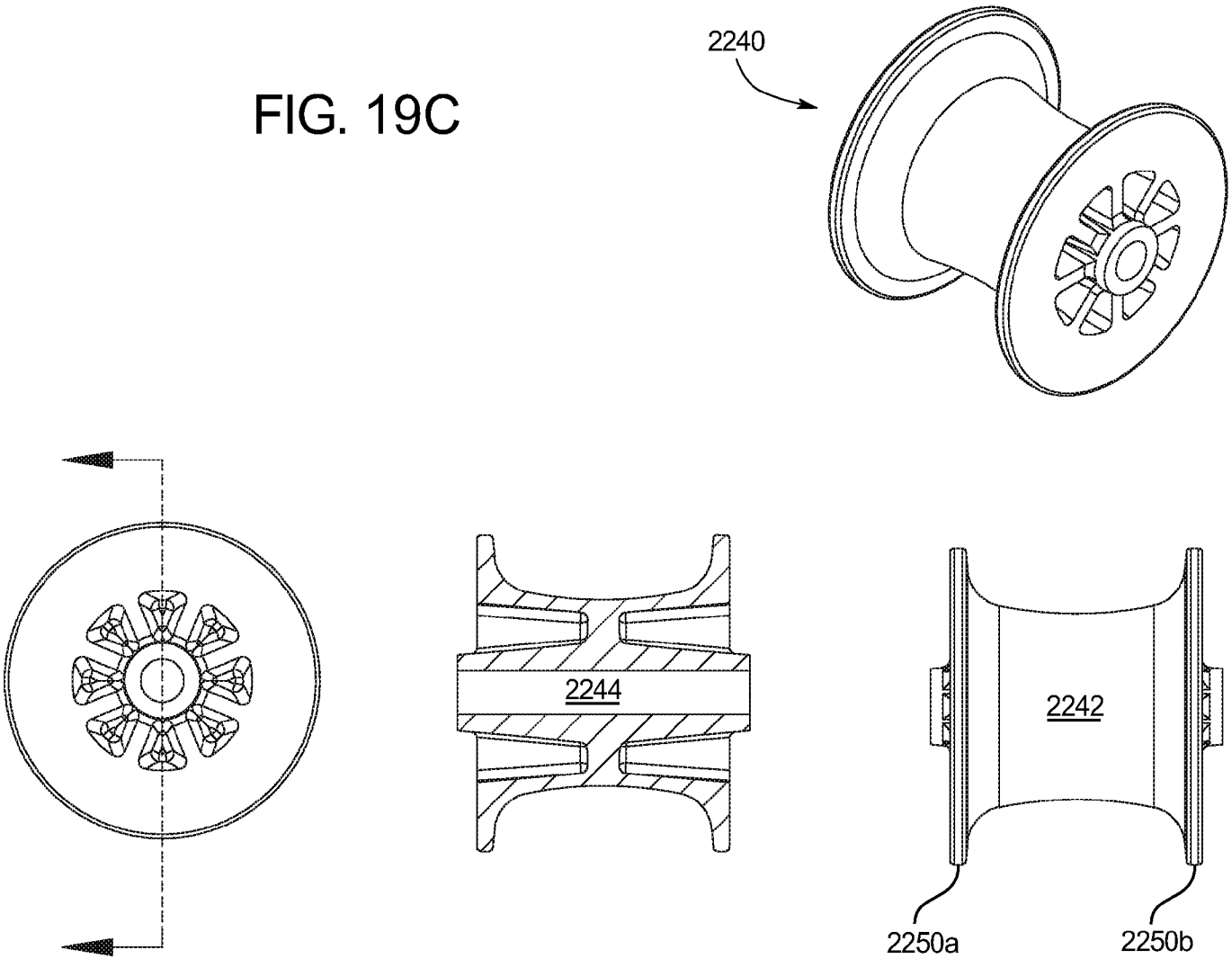
FIG. 19C includes a perspective view, a side elevational view, a front elevational view, and a cross-sectional view of the wheel of the pulley of FIG. 19A.

As illustrated in FIG. 19C, the wheel 2240 includes a generally annular body having an outer cylindrical strap sliding surface 2242, a flange 2250*a* at one end of the body, and a flange 2250*b* at the other end of the body. The wheel 2240 includes a cylindrical inner surface 2244 defining an axle receiving channel therethrough.

To assemble the pulley 2200, as shown in FIG. 19A, the fastener 2260 is threaded through the fastener receiving opening 2232 of the base 2222 of the frame 2220. The wheel 2240 is positioned between the right side wall 2224 and the left side wall 2226 of the frame 2220 such that the axle receiving channel aligns with the axle receiving openings 2234 and 2236 of the right side wall 2224 and the left side wall 2226, respectively. The axle is then slid through the axle receiving opening 2234, the axle receiving channel, and the axle receiving opening 2236 and fastened (using any suitable fastener) such that the axle does not substantially slide relative to the frame 2220 or the wheel 2240. The wheel 2240 may rotate relative to the axle 2280.

Figure 20:
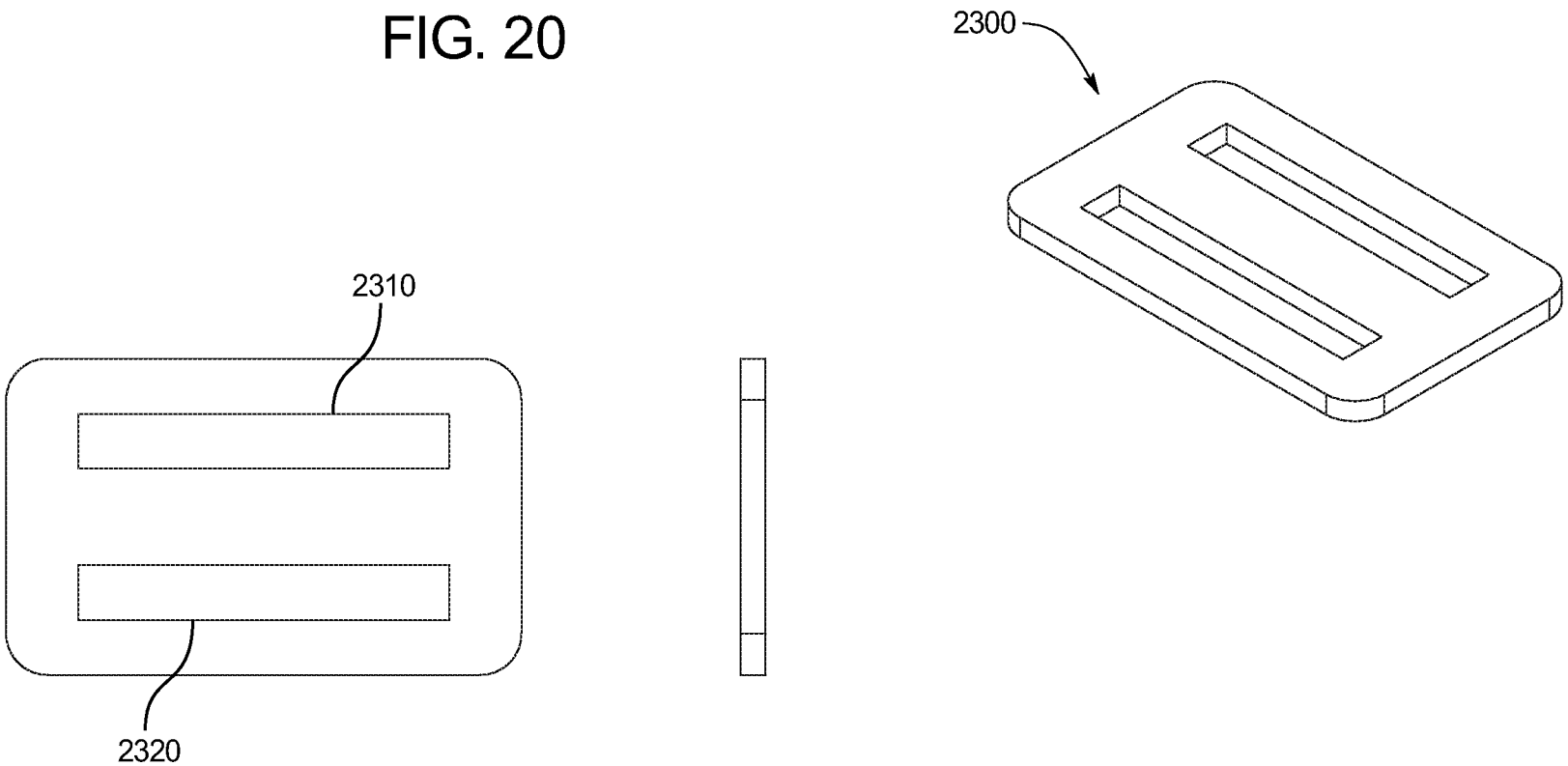
FIG. 20 includes a perspective view, a side elevational view, and a front elevational view of the strap securer of the object lifting system of FIG. 17A.

As illustrated in FIG. 20, the first and second strap securers 2300*a* and 2300*b* (referred to below as the strap securer 2300 for brevity) includes a generally rectangular body having rounded corners. The strap securer defines two rectangular strap receiving slots 2310 and 2320 therethrough. The strap receiving slots 2310 and 2320 are substantially parallel to one another and to the long edges of the body of the strap securer 2300.

Object Lifting System Installation and Operation

In this example embodiment, to install the object lifting system: (a) the winch 2010 is mounted to a vertical wall 4000 (as described above); (b) the strap receiver 2100 is mounted to the wall 4000 (or any other suitable surface) above the winch 2010 proximate a ceiling 5000 using the strap receiver mounting openings 2112*a* and 2112*b*; (c) the first pulley 2200*a* is mounted to the ceiling 5000 at a first anchor point located: (i) a first distance D1 from the strap receiver 2100 measured from the center of the strap receiver 2100 along the wall 4000 to the right of the strap receiver 2100 (as shown in FIG. 17A), and (ii) a second distance D2 from the wall 4000; (d) the second pulley 2200*b* is mounted to the ceiling 5000 (or any other suitable surface) at a second anchor point located: (i) a first distance D1 from the center of the strap receiver 2100 measured from the strap receiver 2100 along the wall 4000 to the left of the strap receiver 2100 (as shown in FIG. 17A), and (ii) a second distance D2 from the wall 4000; (e) a secured end of the first strap 2400*a* is attached to the drum of the winch 2010, and a free end of the first strap 2400*a* is fed through the strap receiving opening of the strap receiver 2100, along the sliding surface 2120 of the strap receiver 2100, and over the strap sliding surface 2242 of the pulley first 2200*a*; and (f) a secured end of the second strap 2400*b* is attached to the drum of the winch 2010, and a free end of the second strap 2400*b* is fed through the strap receiving opening of the strap receiver 2100, along the sliding surface 2120 of the strap receiver 2100, and over the strap sliding surface 2242 of the second pulley 2200*b*.

In operation, as shown in FIG. 17A, to lift an object 3000, which may be a canoe, kayak, cargo box, paddle boat, paddle board, surface board, ladder, bicycle(s), lawn mower, snow blower, power washer, car-top carrier, or any other suitable object, using the object lifting system, (such as to store the object storage), a user first attaches, such as by wrapping, the free end of each of the straps 2400*a* and 2400*b* around the object 3000. Using the strap securers 2300*a* and 2300*b*, the user tightens the straps 2400*a* and 2400*b* around the object 3000 until the straps 2400*a* and 2400*b* securely hold the object 3000. The use of the strap securers 2300*a* and 2300*b* enables the user to adjust the straps 2400*a* and 2400*b* to objects of a variety of different shapes and sizes. After securing the straps 2400*a* and 2400*b*, the user turns the crank arm of the winch 2010 in a direction that causes the straps to wind onto the drum of the winch 2010. This causes the straps 2400*a* and 2400*b* to: (a) travel over the strap sliding surfaces 2242 respective pulleys 2200*a* and 2200*b*, (b) travel through the strap receiving opening and along the sliding surface 2120 of the strap receiver 2100, and (c) wind onto the drum of the winch 2010, thereby lifting the object 3000.

Alternative Embodiments of the Object Lifting System

Figure 17B:
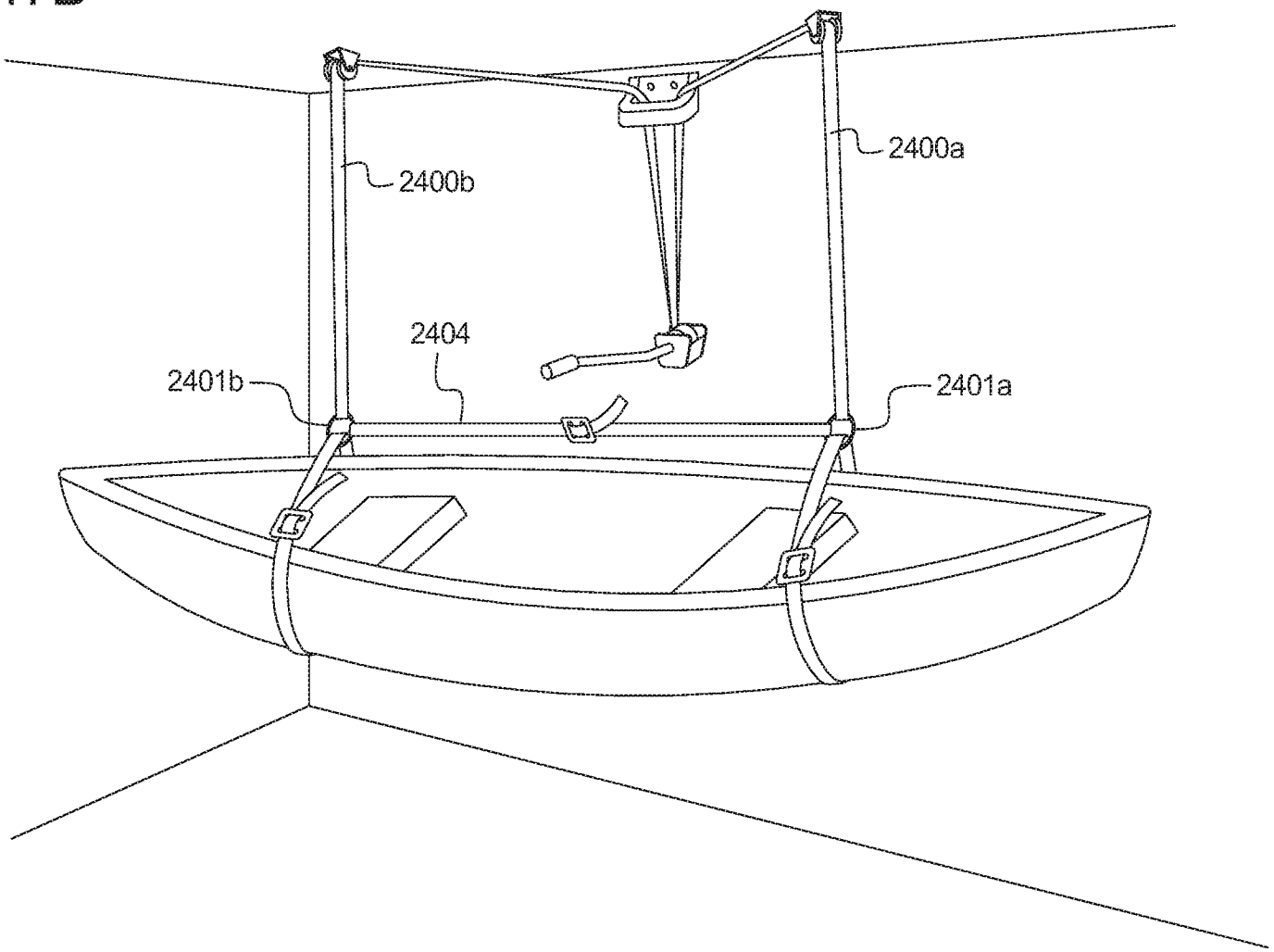
FIG. 17B is a top perspective view of another example embodiment of the object lifting system of the present disclosure.

In another embodiment, as shown in FIG. 17B, the free end of each of the straps 2400*a* and 2400*b* includes a loop 2401*a* and 2401*b*, respectively. In this embodiment, a substantially horizontal spacing strap 2404 is routed through the loops 2401*a* and 2401*b* to connect the loops and ensure the distance between the loops (i.e., the distance between the free ends of the straps) is a designated distance (such as substantially equal to the distance between the anchor points of the pulleys) or within a designated range of distances. Additionally, in this embodiment, the first strap 2400*a* is attached to (such as wrapped around) the object and routed through one of the loops, and the second strap 2400*b* is attached to (such as wrapped around) the object and routed through the other one of the loops. This enables the winch to lift (and lower) the object.

In another embodiment (not shown), the free end of each of the straps includes a hook or other attachment member. In this embodiment, the user attaches the hooks to the object to enable the winch to lift (and lower) the object.

Figure 21:
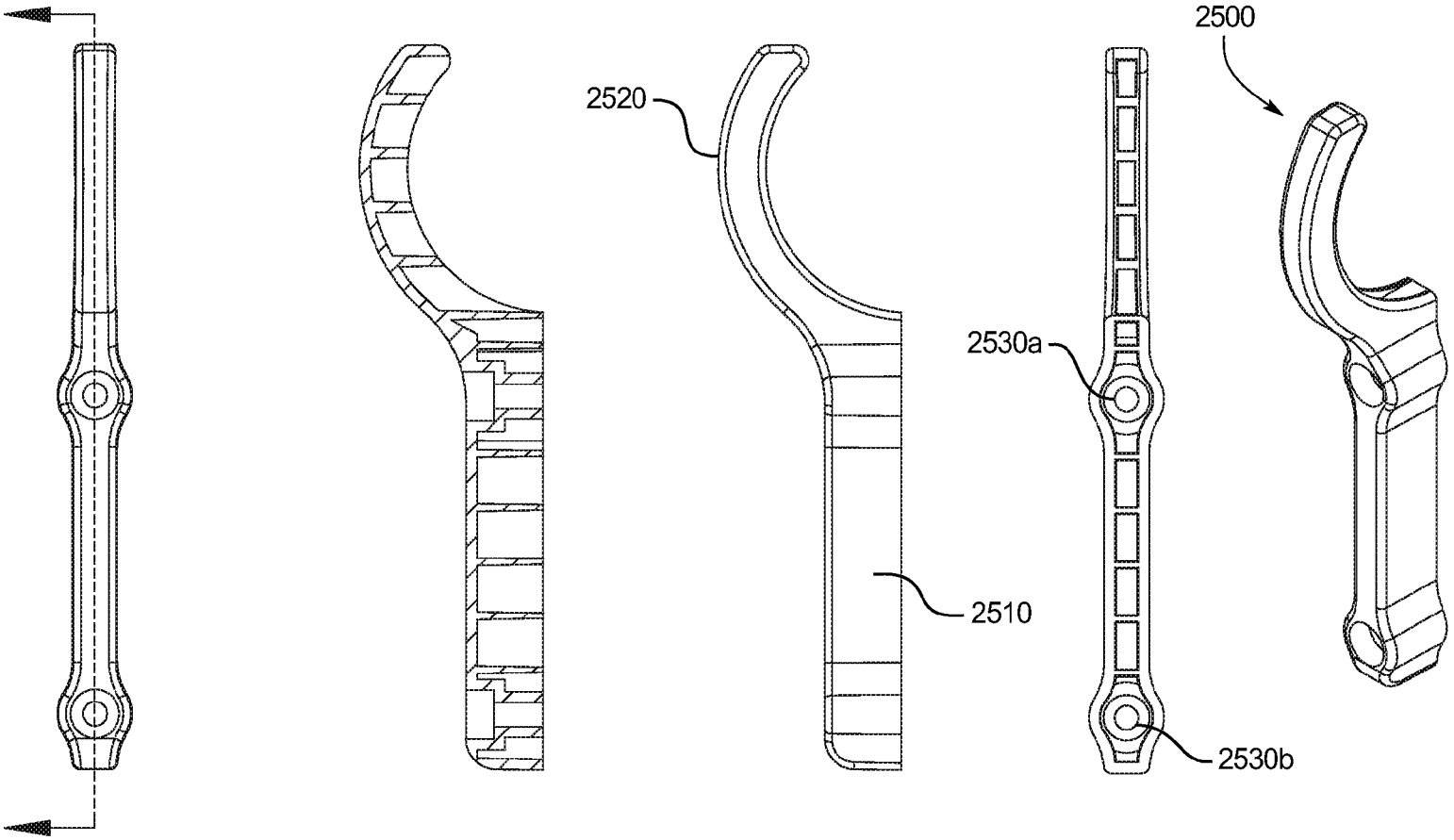
FIG. 21 includes a perspective view, a side elevational view, a front elevational view, a back elevational view, and a cross-sectional view of the wall cleat of another embodiment of the object lifting system.

In another embodiment, the object lifting system includes a wall cleat 2500, shown in FIG. 21. The wall cleat 2500 includes a generally rectangular mounting body 2510 and a curved or arcuate flexible member storage hook 2520 extending in a convex manner from the top of the mounting body 2510. The mounting body 2510 defines a plurality of wall cleat mounting openings 2530*a* and 2530*b* therethrough, which are used to mount the wall cleat 2500 to a suitable surface (such as a wall) near the winch. This enables the user to wrap the flexible members of the object lifting system around the flexible member storage hook 2520 for storage when the flexible members are not secured around an object.

Figure 22:
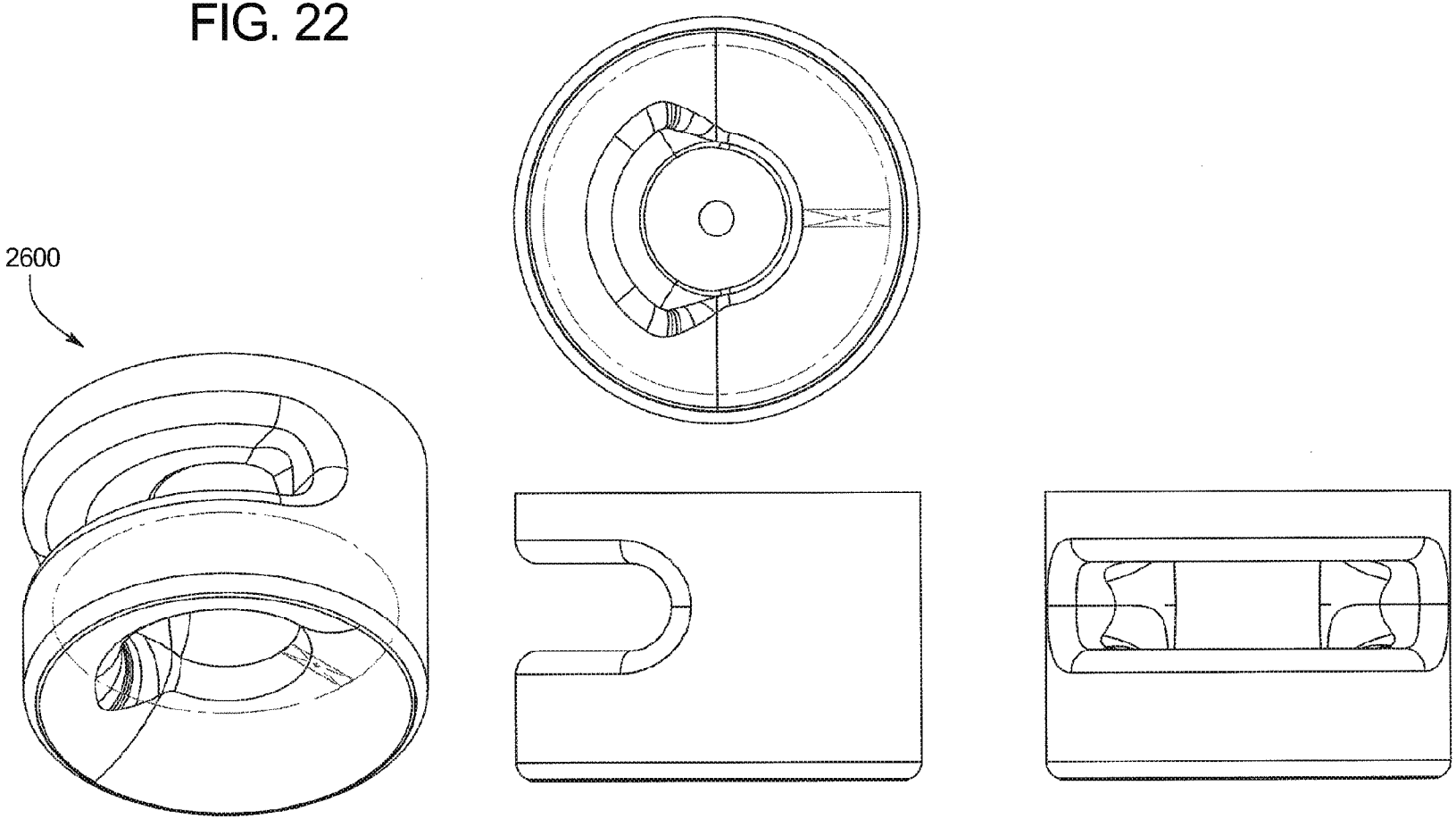
FIG. 22 includes a perspective view, a top plan view, a side elevational view, and a front elevational view of the flexible member router of another embodiment of the object lifting system.

It should be appreciated that any suitable flexible member guide may be used in place of or in addition to the pulleys. In one embodiment, the object lifting system employs a flexible member router 2600, shown in FIG. 22, in place of each of the first and second pulleys. The flexible member router is similar to the flexible member receiver, and is configured to accommodate straps routed through the flexible member router at a wide range of angles.

In another embodiment (not shown), the object lifting system employs a plurality of additional pulleys instead of the flexible member receiver. That is, in this embodiment, a first additional pulley and a second additional pulley are mounted to the ceiling and/or to the wall above the winch. In this embodiment: (a) the secured end of the first flexible member is attached to the drum of the winch, and the free end of the first flexible member is fed over the flexible member sliding surface of the first additional pulley and then over the flexible member sliding surface of the first pulley; and (b) the secured end of the second flexible member is attached to the drum of the winch, and the free end of the second flexible member is fed over the flexible member sliding surface of the second additional pulley and then over the flexible member sliding surface of the second pulley.

It should be understood that modifications and variations may be effected without departing from the scope of the novel concepts of the present disclosure, and it should be understood that this application is to be limited only by the scope of the appended claims.

The invention is claimed as follows:

1. A winch having an adjustable initial mechanical advantage, said winch comprising:

a frame including a center shaft;

a front adjustment plate rotatably mounted to the center shaft;

a rear adjustment plate rotatably mounted to the center shaft; and a drum rotatably mounted to the frame, wherein the drum is, while rotatably mounted to the frame, adjustable between a first outer diameter associated with a first mechanical advantage and a second different outer diameter associated with a second mechanical advantage different from the first mechanical advantage to adjust an initial mechanical advantage of the winch via relative movement of the front adjustment plate and the rear adjustment plate towards one another and rotation of the front adjustment plate and the rear adjustment plate.

2. The winch of claim 1, wherein the first outer diameter is greater than the second outer diameter, and the first mechanical advantage is less than the second mechanical advantage.

3. The winch of claim 1, wherein the first outer diameter is a maximum outer diameter and the second outer diameter is a minimum outer diameter, and the first mechanical advantage is a minimum mechanical advantage and the second mechanical advantage is a maximum mechanical advantage.

4. The winch of claim 1, wherein the drum includes a plurality of adjustment pins.

5. The winch of claim 4, which includes a center sleeve rotatably mounted to the center shaft.

6. The winch of claim 5, which includes a front plate fixedly mounted to a first end of the center sleeve, the front plate including a plurality of adjustment slots having a first orientation.

7. The winch of claim 6, wherein each of the front adjustment plate and the rear adjustment plate is rotatably and slidably mounted to the center shaft, each adjustment plate including a plurality of adjustment slots having a second orientation different than the first orientation of the plurality of adjustment slots of the front plate, each of the adjustment pins in one of the adjustment slots of the front plate and a corresponding one of the adjustment slots of each adjustment plate, wherein a distance of each of the adjustment pins from a center of the center shaft is based on a rotational orientation of the adjustment plates relative to the front plate.

8. The winch of claim 7, wherein, for each adjustment pin, an axis along the length of said adjustment pin is substantially parallel to an axis along the length of the center sleeve.

9. A winch having an adjustable initial mechanical advantage, said winch comprising:

a frame;

a center shaft fixedly mounted to the frame;

a center sleeve rotatably mounted to the center shaft;

a front plate fixedly mounted to a first end of the center sleeve, the front plate including a plurality of adjustment slots having a first orientation;

a drum including a plurality of adjustment pins; and an adjustment plate rotatably and slidably mounted to the center shaft, the adjustment plate including a plurality of adjustment slots having a second orientation different from the first orientation, each adjustment pin in one of the adjustment slots of the front plate and a corresponding one of the adjustment slots of the second plate, wherein a radial distance of each adjustment pin from a longitudinal axis of the center shaft is based on a rotational orientation of the adjustment plate relative to the front plate such that the radial distance is a first radial distance when the rotational orientation is a first rotational orientation and the radial distance is a second radial distance different from the first radial distance when the rotational orientation is a second rotational orientation different from the first rotational orientation, wherein the drum is adjustable between a first outer diameter and a second different outer diameter, the first outer diameter associated with a first mechanical advantage and the second outer diameter associated with a second different mechanical advantage.

10. The winch of claim 9, wherein, for each adjustment pin, a longitudinal axis of that adjustment pin is substantially parallel to a longitudinal axis of the center sleeve.

* * * * *